US011499794B2

(12) United States Patent
Vanek et al.

(10) Patent No.: US 11,499,794 B2
(45) Date of Patent: Nov. 15, 2022

(54) ADJUSTABLE STOCK SYSTEMS FOR FIREARMS

(71) Applicant: RBK II, LLC, Las Vegas, NV (US)

(72) Inventors: Joede Thomas Vanek, Florence, MT (US); Bret Pitman, Kalispell, MT (US)

(73) Assignee: Vantac Technologies, LLC, Florence, MT (US)

( * ) Notice: Subject to any disclaimer, the term of this patent is extended or adjusted under 35 U.S.C. 154(b) by 0 days.

(21) Appl. No.: 17/182,746

(22) Filed: Feb. 23, 2021

(65) Prior Publication Data

US 2021/0199404 A1 Jul. 1, 2021

Related U.S. Application Data

(63) Continuation of application No. 16/238,373, filed on Jan. 2, 2019, now Pat. No. 10,928,159.

(60) Provisional application No. 62/612,989, filed on Jan. 2, 2018.

(51) Int. Cl.

| | |
|---|---|
| ***F41C 23/04*** | (2006.01) |
| ***F41C 23/20*** | (2006.01) |
| ***F41C 23/22*** | (2006.01) |

(52) U.S. Cl.

CPC ..... *F41C 23/04* (2013.01); *F41C 23/20* (2013.01); *F41C 23/22* (2013.01)

(58) Field of Classification Search

CPC ..... F41C 23/04; F41C 23/14; F41C 23/20

See application file for complete search history.

(56) References Cited

U.S. PATENT DOCUMENTS

| | | | | |
|---|---|---|---|---|
| 7,984,580 | B1 | 7/2011 | Giauque et al. | |
| 8,991,088 | B1 | 3/2015 | Young | |
| 2011/0283584 | A1 | 11/2011 | Walters | |
| 2016/0187099 | A1* | 6/2016 | Cottle | F41C 23/14 42/73 |

(Continued)

FOREIGN PATENT DOCUMENTS

| | | | |
|---|---|---|---|
| DE | 1225517 | B | 9/1966 |
| KR | 200409586 | Y1 | 2/2006 |

(Continued)

*Primary Examiner* — J. Woodrow Eldred

(74) *Attorney, Agent, or Firm* — Locke Lord LLP; Daniel J. Fiorello

(57) ABSTRACT

An adjustable stock system for a firearm can include a buttstock slider configured to be slidably attached to the firearm for moving relative to the firearm between a collapsed position and at least one extended position. The buttstock slider can include a plurality of buttstock grooves defined therein. The system can include a lower stock assembly that is configured to mount to a firearm and a latch assembly disposed within the lower stock assembly. The latch assembly is configured to be moveable between a latched position where the buttstock slider cannot slide relative to the firearm and an unlatched position where the buttstock slider is free to slide relative to the firearm. The latch assembly can include at least one latch tooth configured to mate with the plurality of buttstock slider grooves when the latch assembly is in the latched position. The latch assembly is biased to the latched position. The system includes an actuator assembly configured to move the latch assembly between the latched position and the unlatched position.

16 Claims, 59 Drawing Sheets

(56) References Cited

U.S. PATENT DOCUMENTS

| | | | | |
|---|---|---|---|---|
| 2018/0080736 | A1* | 3/2018 | Olsen | F41C 23/14 |
| 2018/0120055 | A1 | 5/2018 | Silverman et al. | |
| 2019/0195595 | A1 | 6/2019 | Kielsmeier et al. | |
| 2020/0200505 | A1 | 6/2020 | Brown, Jr. | |

FOREIGN PATENT DOCUMENTS

| | | | |
|---|---|---|---|
| KR | 20080004805 | U | 10/2008 |
| WO | 2016115209 | A1 | 7/2016 |

* cited by examiner

ADJUSTABLE STOCK SYSTEMS FOR FIREARMS

CROSS REFERENCE TO RELATED APPLICATIONS

This application is a continuation of U.S. patent application Ser. No. 16/238,373, filed Jan. 2, 2019, which claims priority under 35 U.S.C. § 119 from U.S. Provisional Application No. 62/612,989, filed on Jan. 2, 2018, the entire contents of which are incorporated by reference herein.

BACKGROUND

1. Field

The present disclosure relates to buttstocks, more specifically to adjustable stocks for firearms (e.g., rifles, handguns, airsoft weapons, or any other suitable projectile weapon).

2. Description of Related Art

Traditional adjustable buttstocks require the user to take one or both hands off a grip (e.g., a non-shooting hand off of a fore grip or shooting hand off of a pistol grip) and/or trigger off the firearm to adjust the length of the stock. This action takes time, destabilizes the user's accuracy, and diminishes or eliminates the user's ability to fire the weapon while adjusting the length of their firearm. In a dangerous scenario where the user is exposed to a threat, such a disruptive action to adjust the length of the stock can mean the difference between life and death.

Such conventional methods and systems have generally been considered satisfactory for their intended purpose. However, there is still a need in the art for improved adjustable stock systems. The present disclosure provides a solution for this need.

SUMMARY

An adjustable stock system for a firearm can include a buttstock slider configured to be slidably attached to the firearm for moving relative to the firearm between a collapsed position and at least one extended position. The buttstock slider includes a plurality of buttstock grooves defined therein. The system includes a lower stock assembly that is configured to mount to a firearm and a latch assembly disposed within the lower stock assembly. The latch assembly is configured to be moveable between a latched position where the buttstock slider cannot slide relative to the firearm and an unlatched position where the buttstock slider is free to slide relative to the firearm. The latch assembly can include at least one latch tooth configured to mate with the plurality of buttstock slider grooves when the latch assembly is in the latched position. The latch assembly is biased to the latched position. The system includes an actuator assembly configured to move the latch assembly between the latched position and the unlatched position.

The latch assembly can include a plurality of lever teeth configured to mate with a plurality of buttstock slider grooves in a latched position. The latch assembly can include a cam member and a follower member having the at least one latch tooth, wherein the actuator assembly can be operatively connected to the cam member to move the cam member relative to the follower member to cause the follower member to move relative to the buttstock slider. The latch assembly can be connected to the cam member via a wire or linkage such that actuation of an actuator trigger causes a cam member of the latch assembly to be pulled relative to a follower member to cause the follower member to move away from the buttstock slider toward the unlatched position.

The actuator assembly can include an actuation trigger that is configured to be positioned adjacent a grip of the firearm when the system is installed on a firearm such that a user can actuate the latch assembly without removing a hand from the firearm or grip. The actuation trigger can be configured to be positioned below a trigger guard of the firearm when the system is installed on the firearm such that the user's trigger finger or other trigger hand digit can actuate the actuation trigger without removing a hand from the firearm or grip.

The buttstock slider can be biased to the at least one extended position. The buttstock slider can be biased with one or more internal springs disposed within the buttstock slider. The buttstock slider can be configured to be slidably mounted over a buffer tube of the firearm, wherein the internal spring is positioned between the buffer tube and an internal surface of the buttstock slider to bias the buttstock to the at least one extended position.

The firearm can be an AR-15. Any other suitable firearm (including airsoft or any other suitable projectile launchers) is contemplated herein.

An adjustable stock system for a firearm can include a latch assembly and an actuator assembly configured to allow a buttstock to move between a plurality of positions including at least a collapsed position and at least one extended position, wherein the actuator assembly includes an actuation trigger configured to be positioned adjacent a trigger guard of the firearm when the system is installed on the firearm such that a user can actuate the latch assembly without removing a hand from the grip or the firearm. The actuation trigger can be configured to be positioned below the trigger guard of the firearm and actuatable with a trigger finger or other trigger hand digit.

The actuation trigger can be a two stage actuation trigger moveable between a first position and a second position, such that the actuation trigger cannot be moved to actuate the actuation assembly and the latch assembly in the first position. The actuation trigger can be biased to the first position, and the actuation trigger can be moved to actuate that actuation assembly and the latch assembly in the second position.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIGS. 14-22 show the embodiment of the buttstock slider of FIG. 10 having the embodiment of a lower cover attached thereto, wherein FIG. 20 shows an embodiment of a lower cover closure plate in accordance with this disclosure.

FIGS. 22 and 23 show the portions of FIGS. 14-22 slidably disposed on a lower stock assembly and in an extended position.

FIGS. 59-63 show the latch assembly disposed relative to the buttstock slider, wherein FIG. 62 shows an example of the buttstock slider in a collapsed position and FIG. 63 shows the buttstock slider in an extended position.

DETAILED DESCRIPTION

Figure 1:
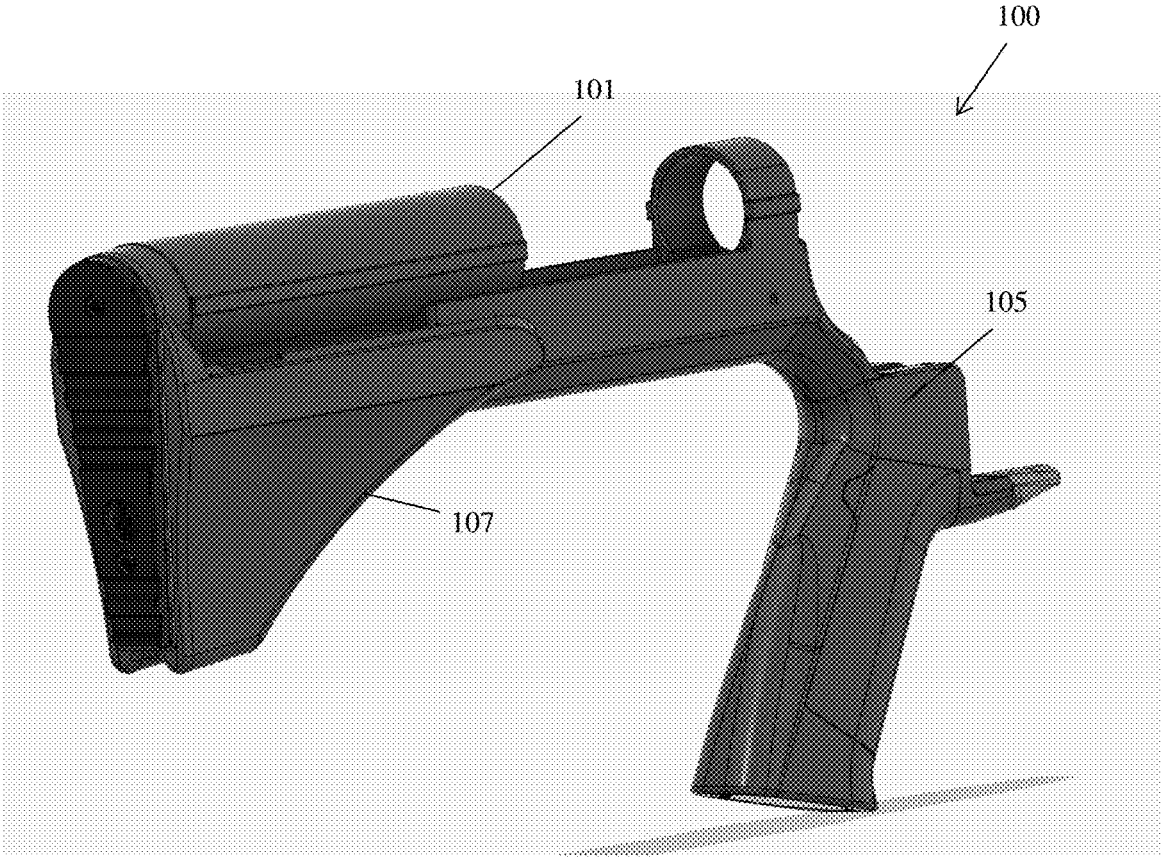
FIG. 1 shows a perspective view of a portion of an embodiment of an adjustable stock assembly in accordance with this disclosure, shown in isolation from a firearm.

Reference will now be made to the drawings wherein like reference numerals identify similar structural features or aspects of the subject disclosure. For purposes of explanation and illustration, and not limitation, an illustrative view of an embodiment of a system in accordance with the disclosure is shown throughout the figures is designated generally by reference character 100. The systems and methods described herein can be used to change a length of a stock of a gun without removing a hand from the gun.

Figure 2:
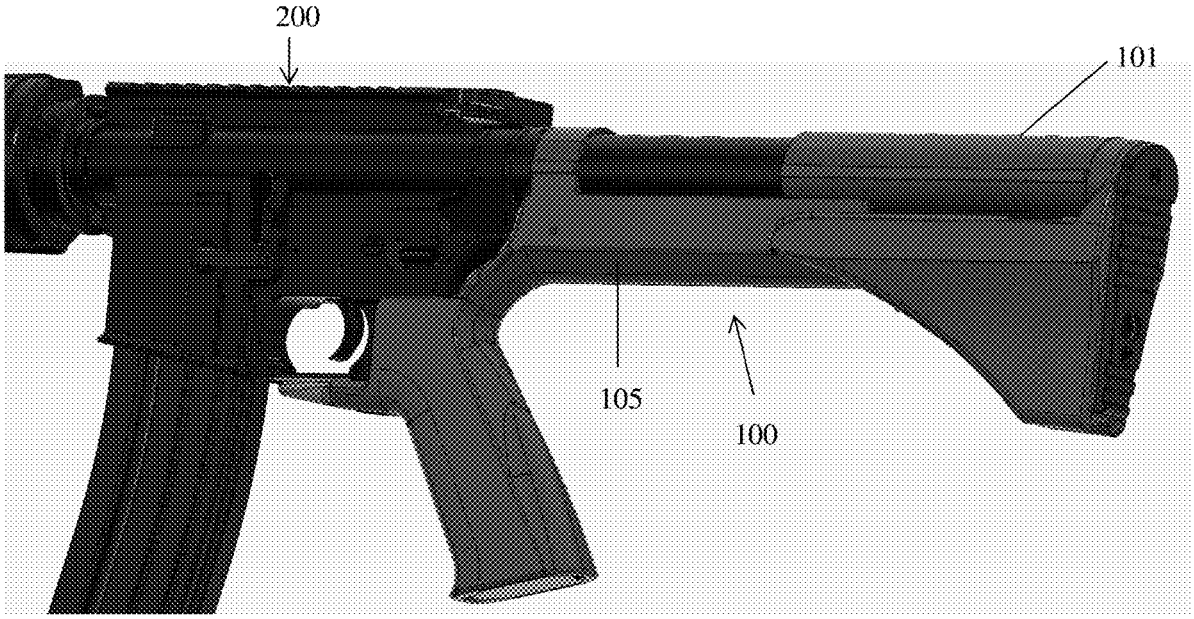
FIGS. 2 and 3 show the embodiment of FIG. 1 disposed on a firearm.
Figure 3:
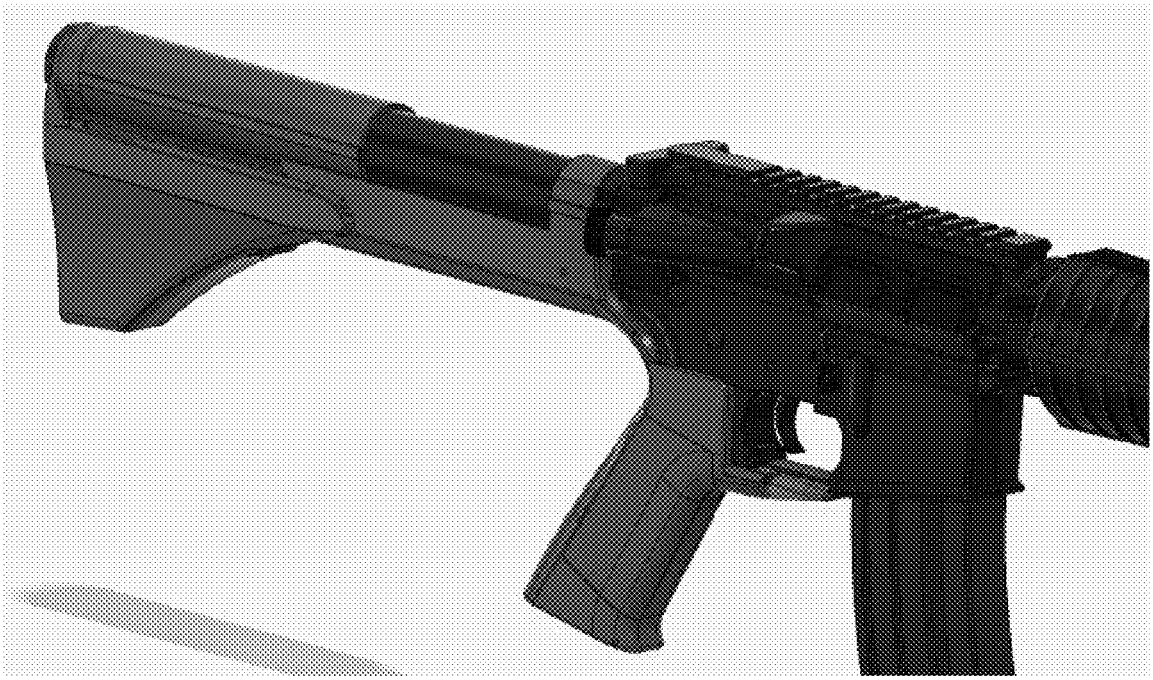
Figure 4:
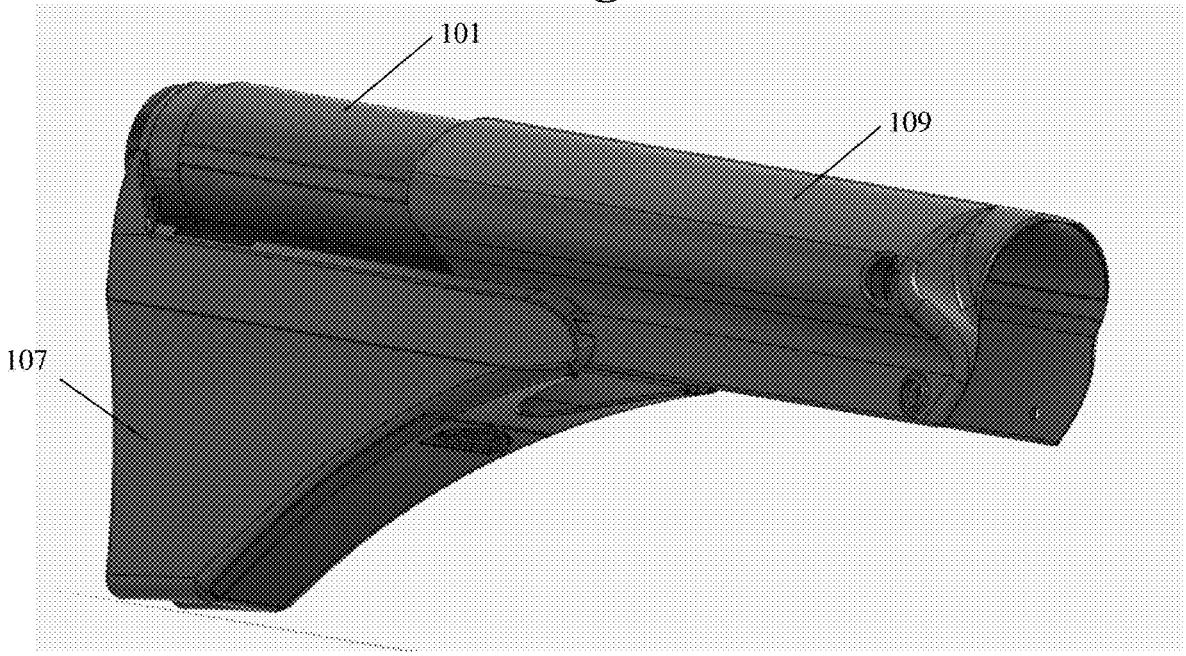
FIGS. 4-9 show an embodiment a buttstock assembly in accordance with this disclosure, shown in isolation from the adjustable stock assembly, shown having an embodiment of a buttstock slider, and embodiments of a lower cover and an upper cover attached to the buttstock slider.
Figure 5:
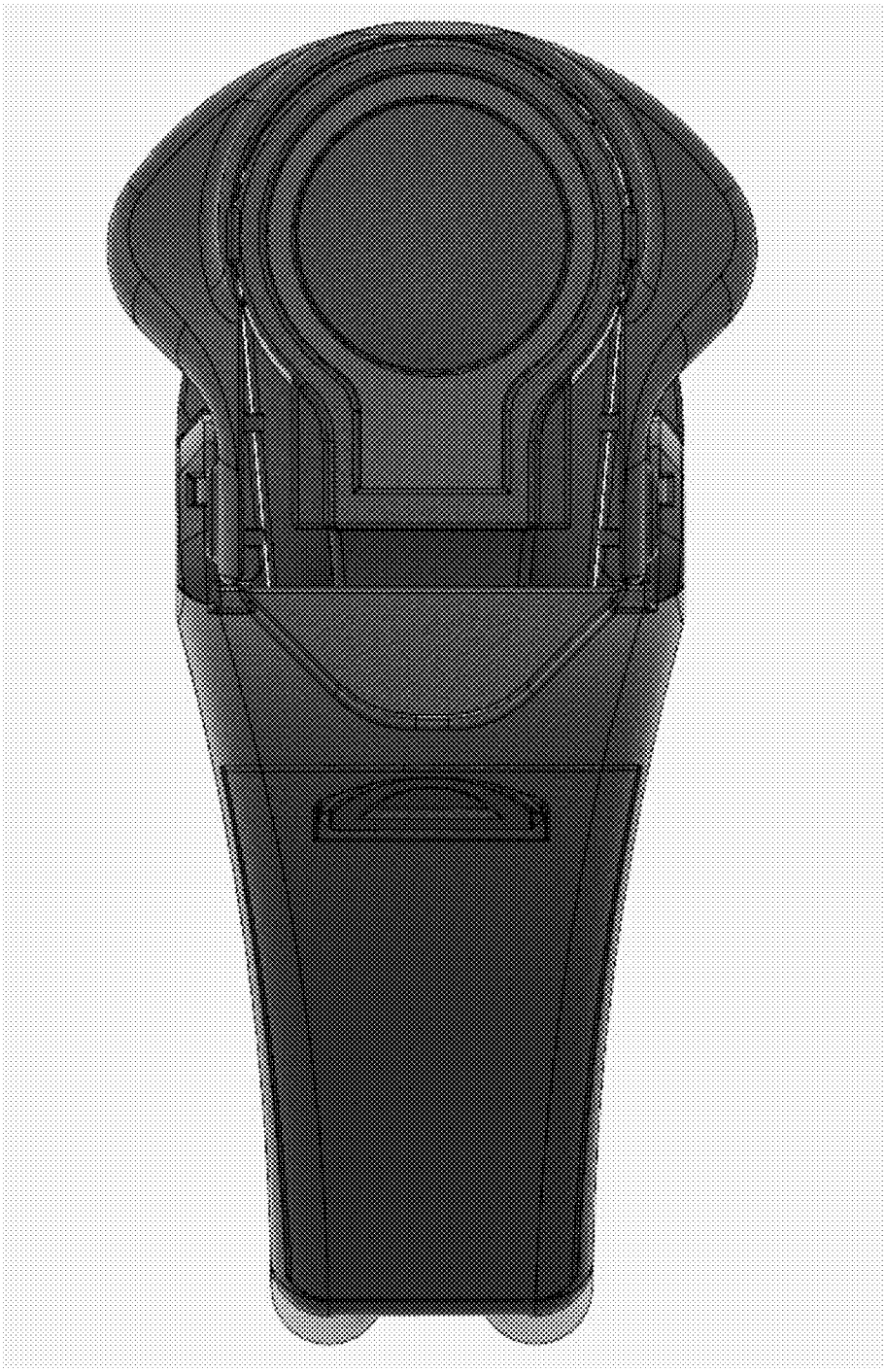
Figure 6:
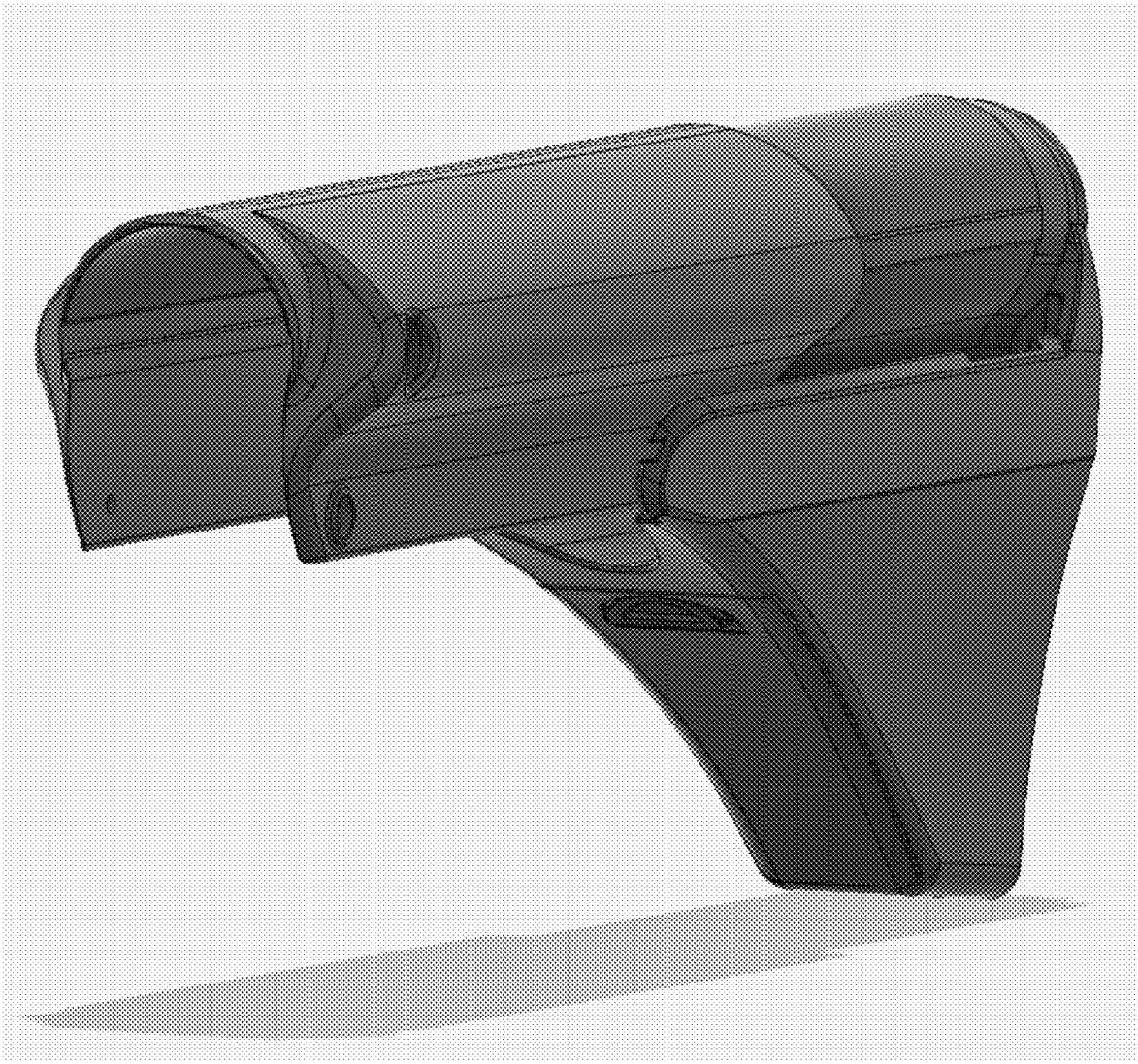
Figure 7:
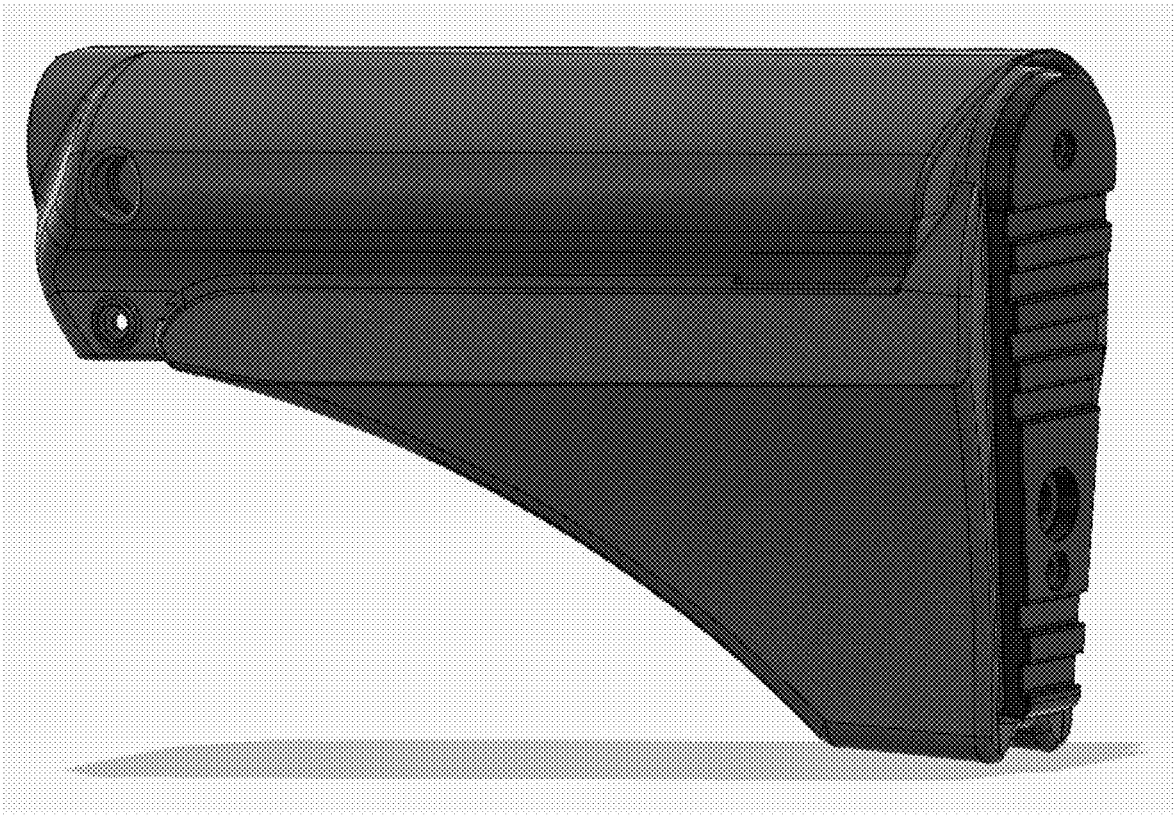
Figure 8:
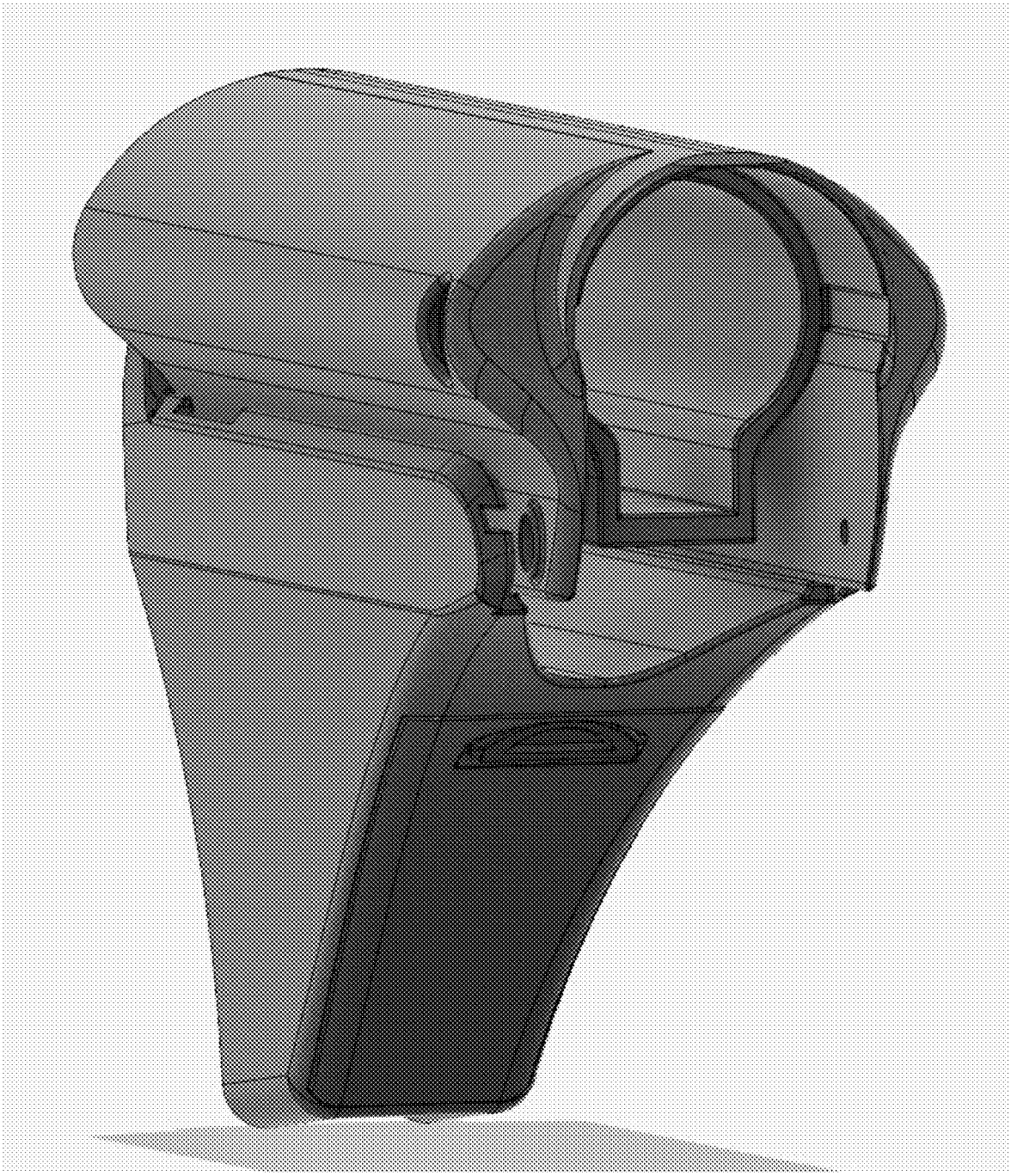
Figure 9:
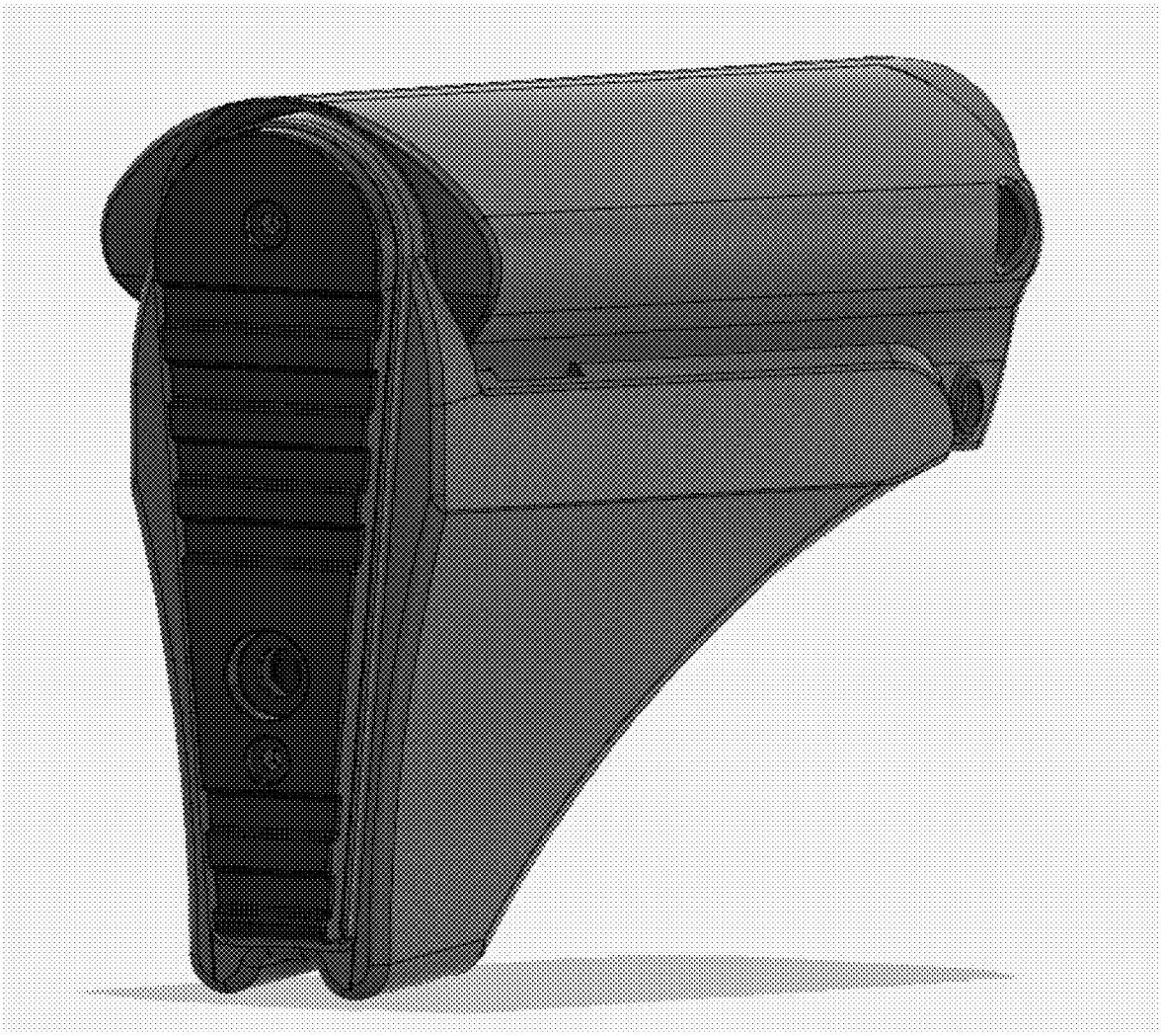
Figure 10:
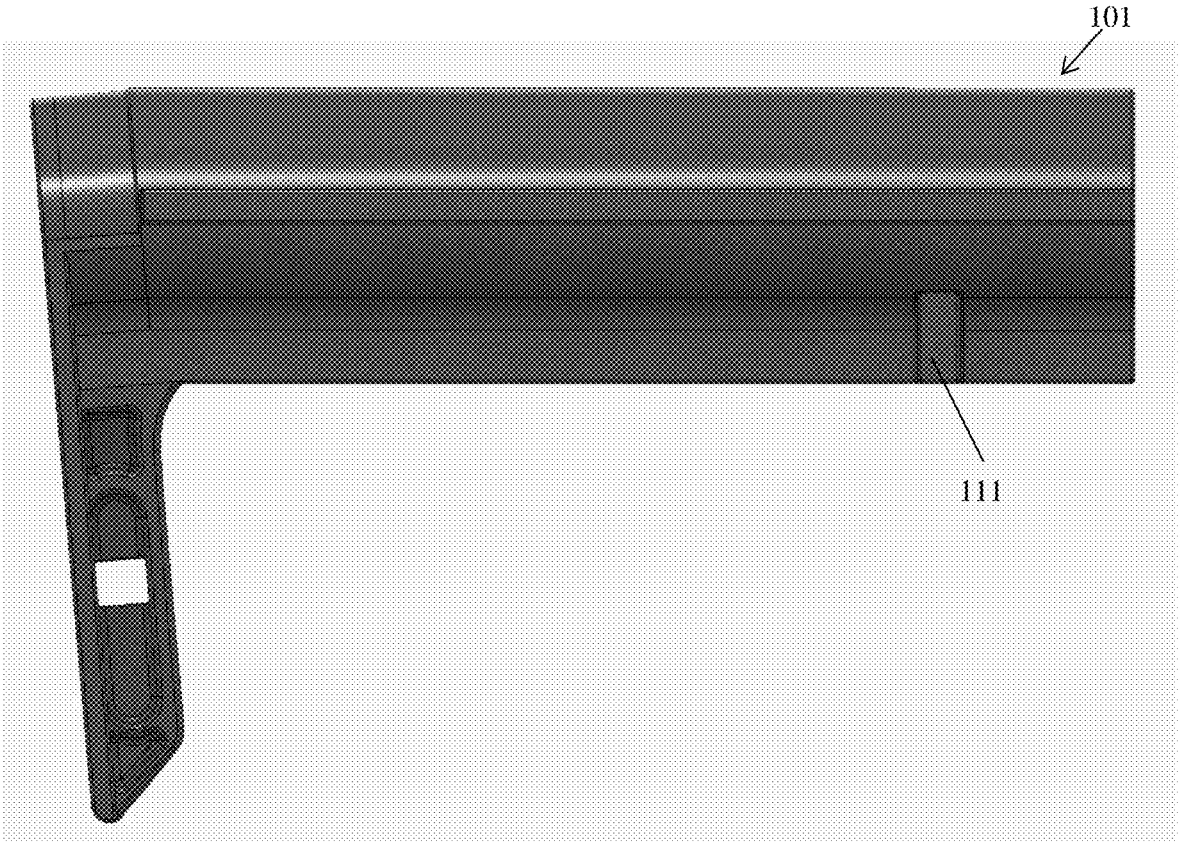
FIGS. 10-13 show an embodiment of a buttstock slider in accordance with this disclosure.

Referring to FIGS. 1-2, an adjustable stock system 100 for a firearm 200 (e.g., any suitable gun or projectile device) can include a buttstock slider 101 configured to be slidably attached to the firearm 200 or the stock system 100 for moving relative to the firearm 200 between a collapsed position (e.g., as shown in FIGS. 7, 62, and 67-70 for example) and at least one extended position (e.g., as shown in FIGS. 1-6 and FIGS. 71-73 for example). The system 100 includes a lower stock assembly 105 that is configured to mount to a firearm 200. As shown, in certain embodiments, the lower stock assembly 105 can include a handle (e.g., a pistol grip) configured to mount to the firearm in proximity to a trigger of the firearm.

Referring additionally to FIGS. 4-9, an embodiment a buttstock assembly in accordance with this disclosure, shown in isolation from the adjustable stock assembly 100, and is shown having an embodiment of a buttstock slider 101 and embodiments of a lower cover 107 and an upper cover 109 attached to the buttstock slider 101. The upper cover 109 can be fixed to the lower stock assembly 105 or to the firearm, for example, and in any suitable manner (e.g., snap fit, screw, or any other suitable fastener). The lower cover 107 can be fixed to the buttstock slider 101, and in any suitable manner.

The buttstock slider 101 can slide relative to the lower stock assembly 105, and may be limited to a maximum extended position by the lower stock assembly 105. Referring additionally to FIGS. 10-13, the buttstock slider 101 includes a plurality of buttstock grooves 103 defined therein. The buttstock grooves 103 can include any suitable aperture size and/or shape (e.g., slots as shown). The buttstock slider 101 can also include a buttstock stop 111 configured to interact with the lower stock assembly 105 to limit a maximum extension of the buttstock slider 101.

Figure 16:
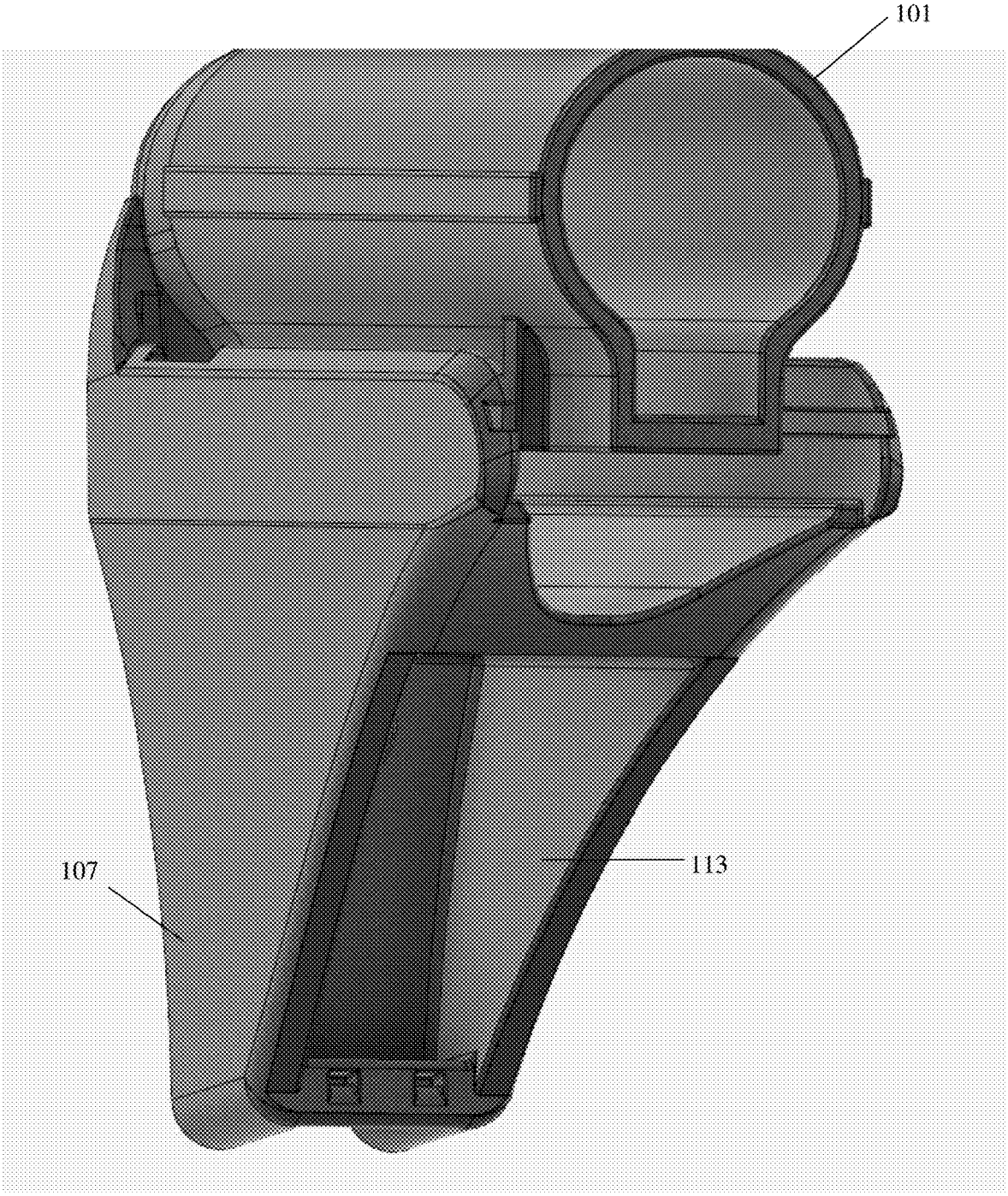
Figure 17:
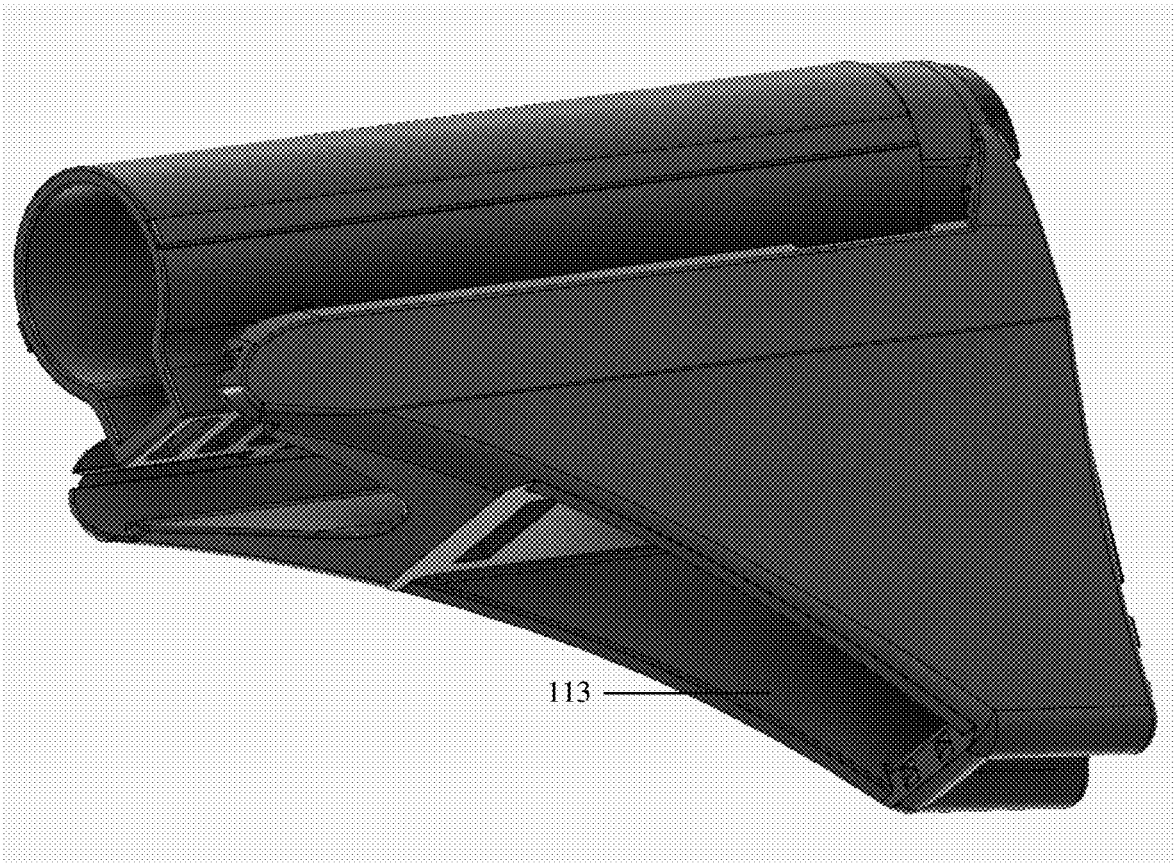
Figure 18:
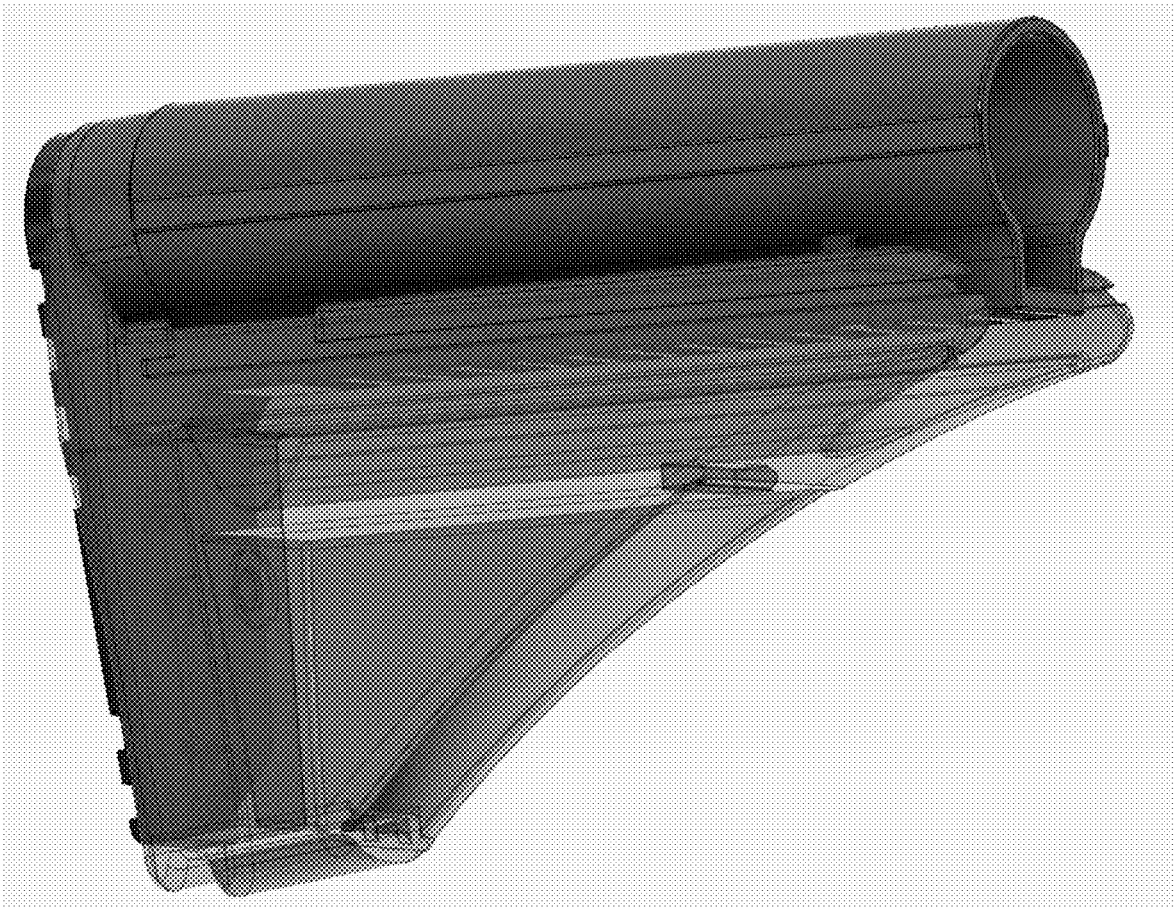
Figure 19:
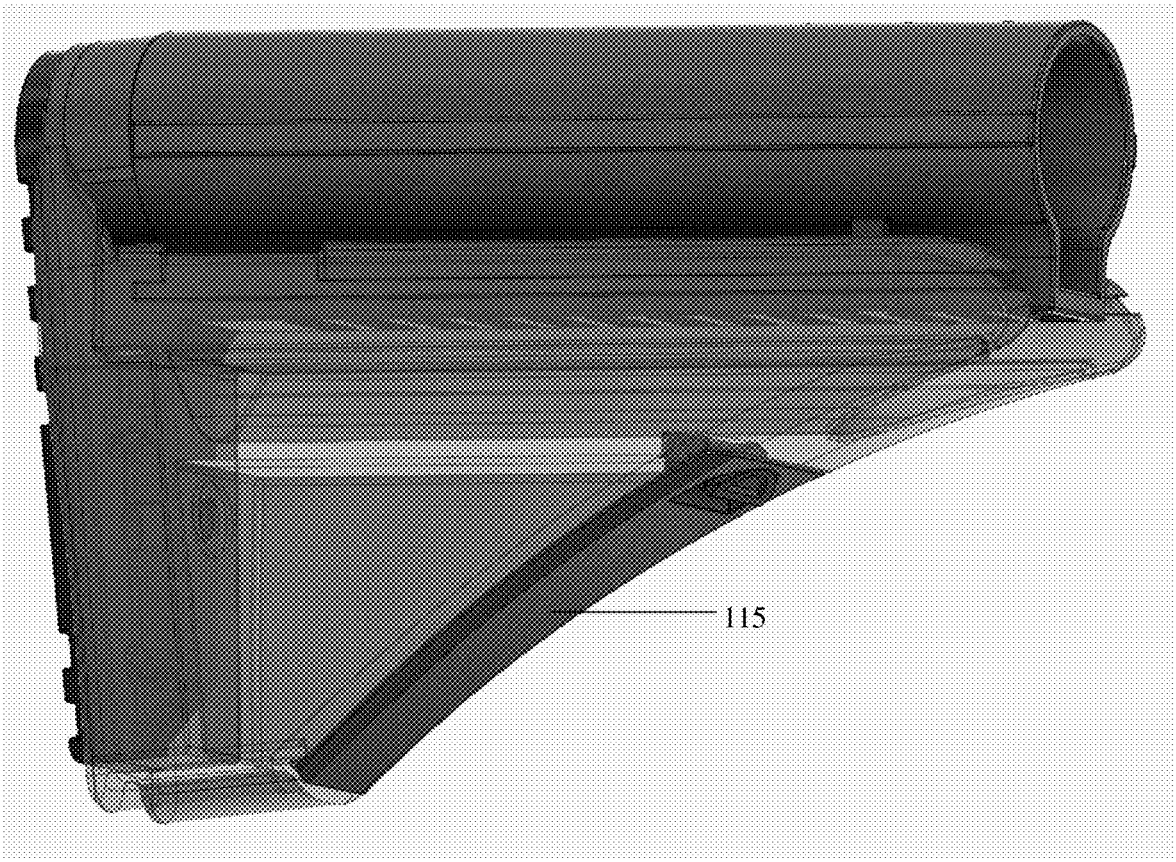
Figure 20:
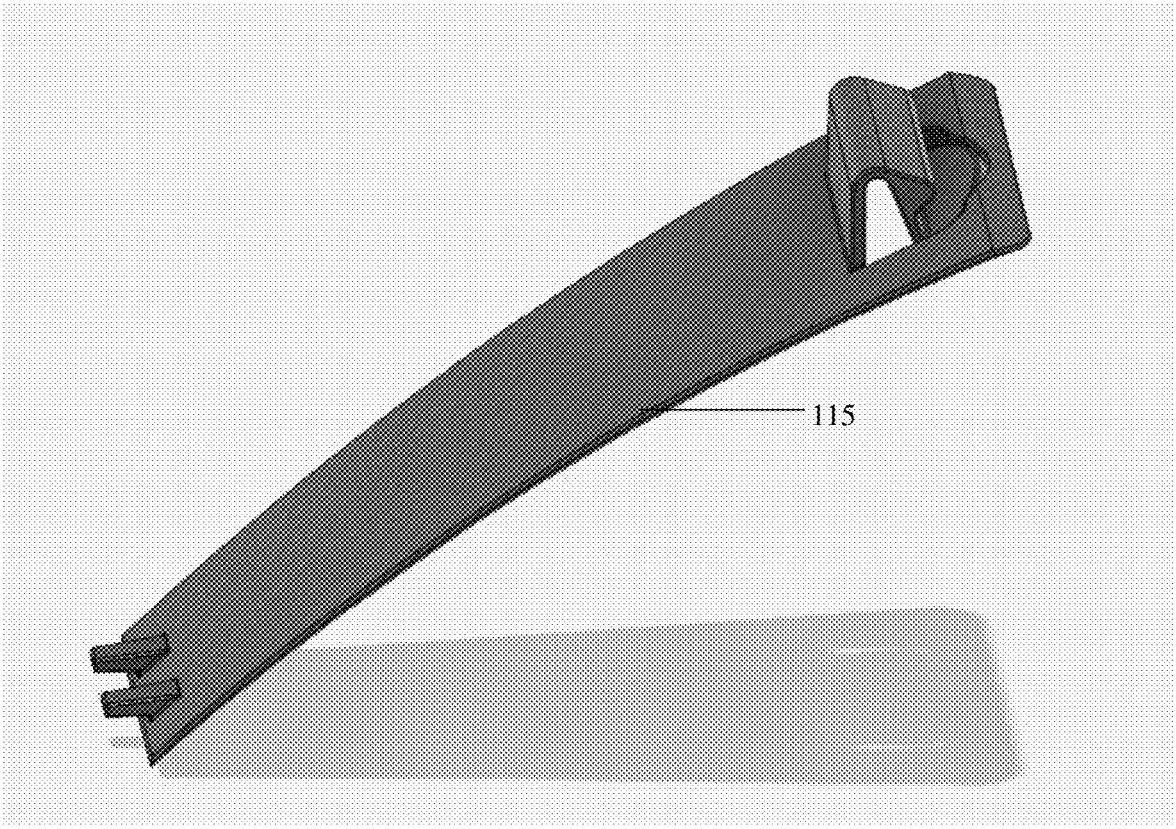
Figure 21:
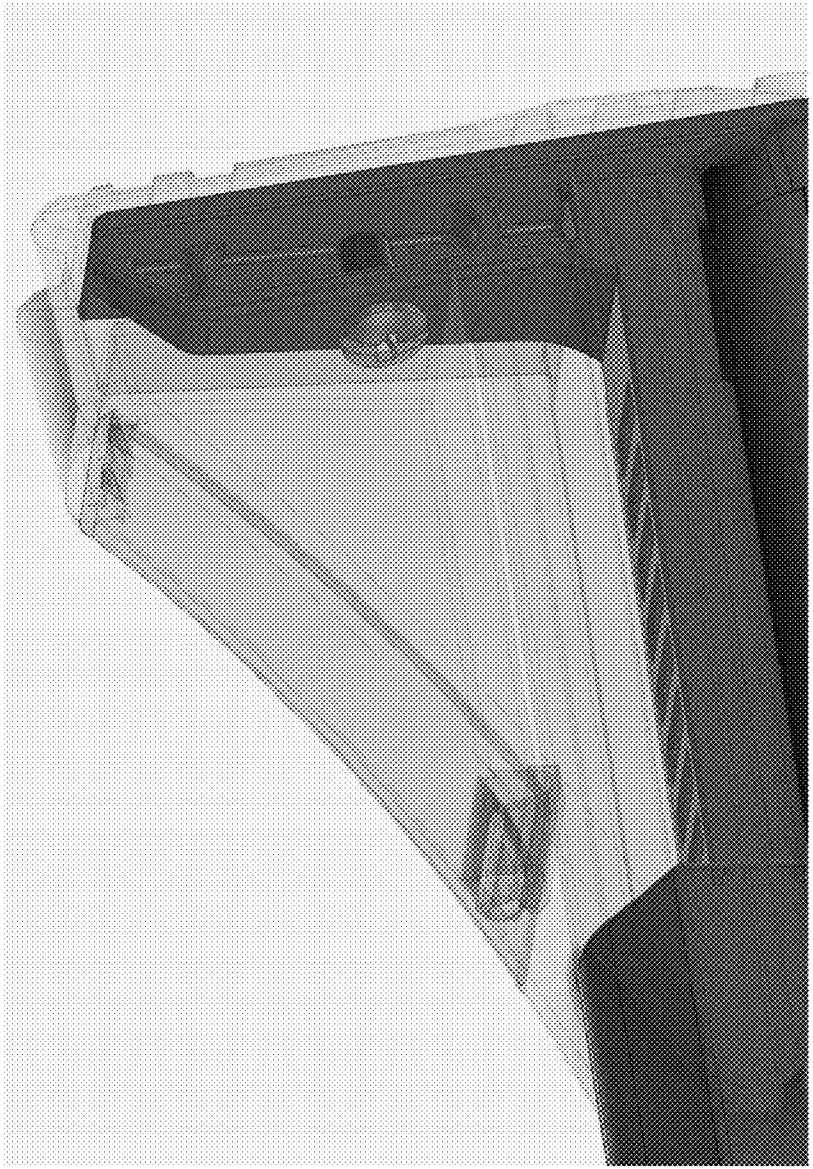

FIGS. 14-21 show the buttstock slider 101 having the lower cover 107 attached thereto. Referring additionally to FIG. 16, the lower cover can form a lower cover compartment 113 (e.g., a utility compartment). Referring additionally to FIGS. 19 and 20, an embodiment of a lower cover closure plate 115 is shown and is configured to enclose the lower cover compartment 113.

Figure 22:
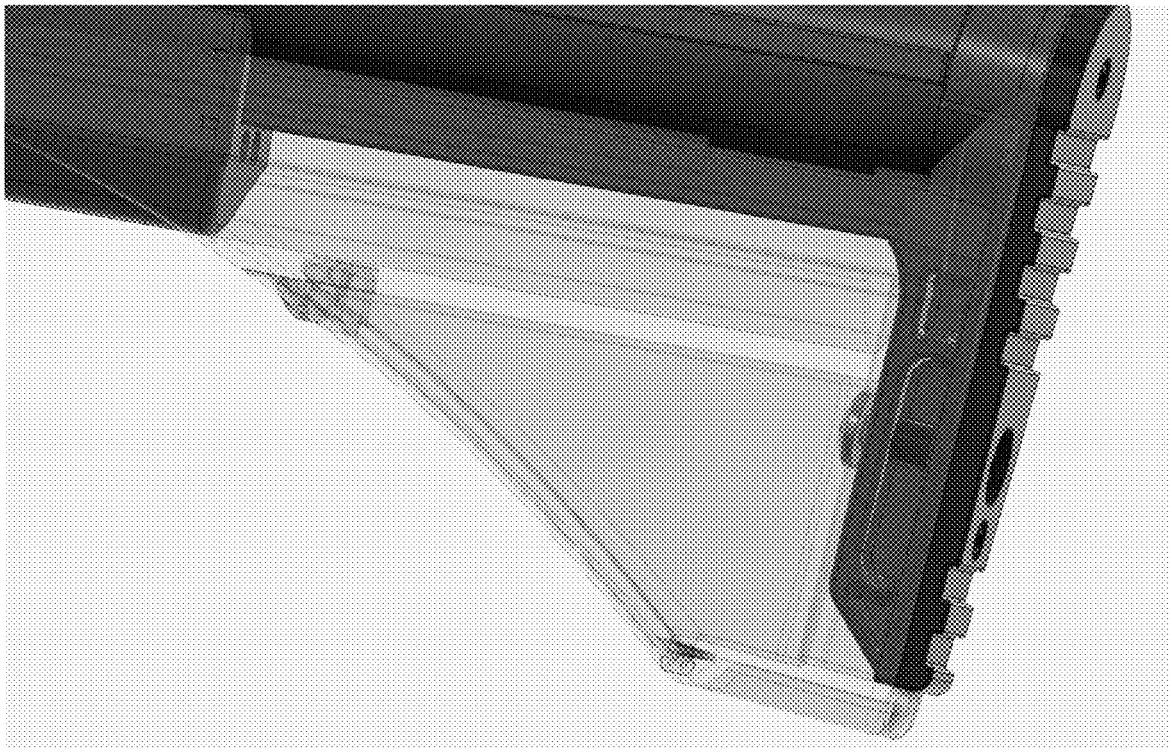
Figure 23:
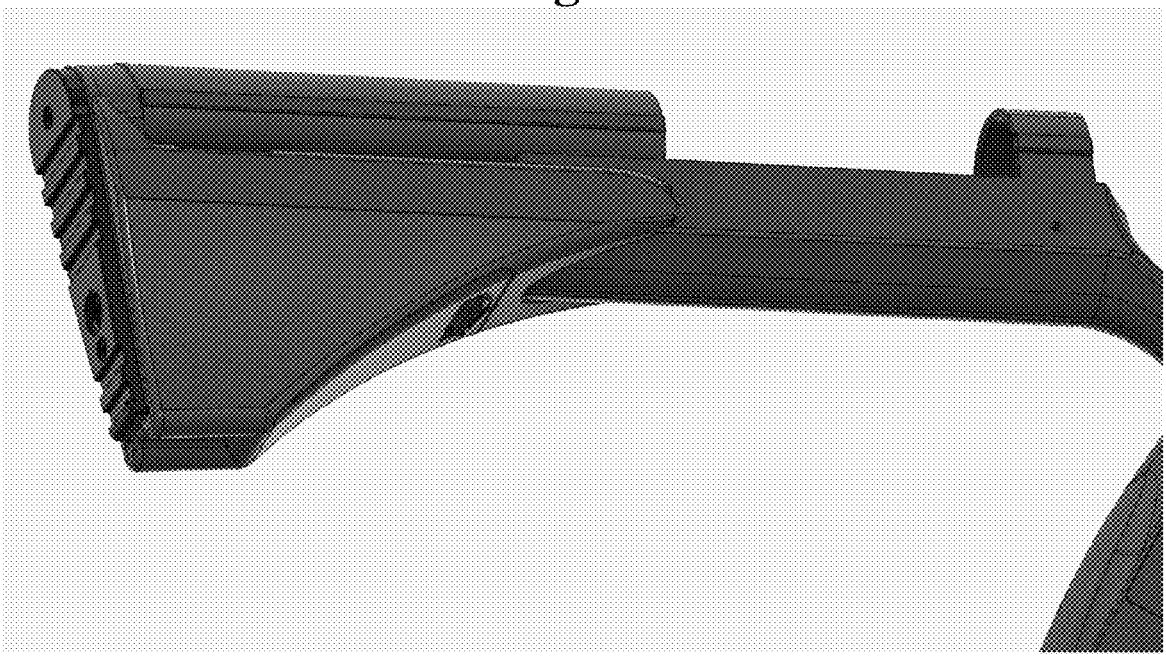
Figure 24:
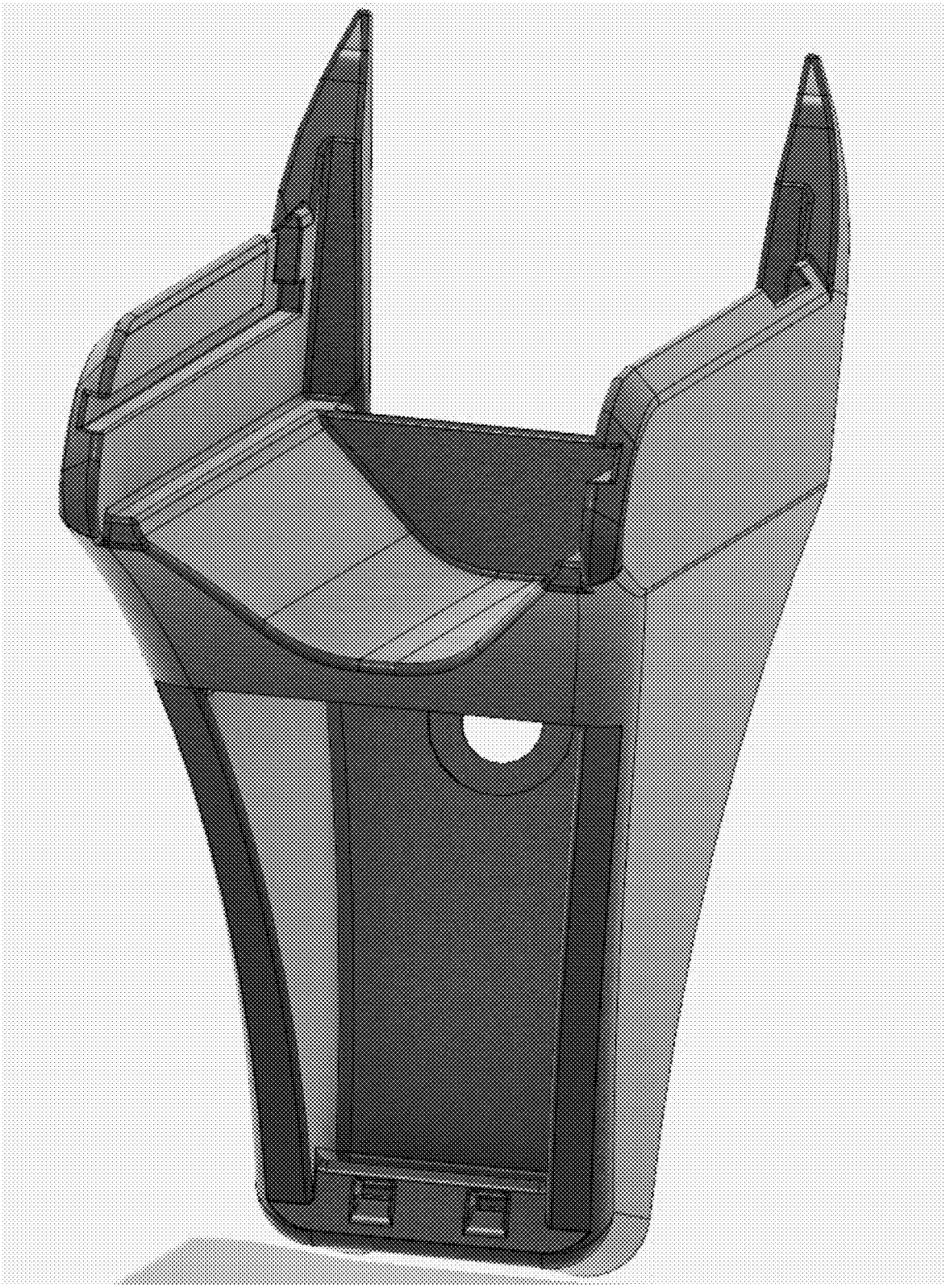
FIGS. 24 and 25 show an embodiment of a lower cover in accordance with this disclosure.
Figure 25:
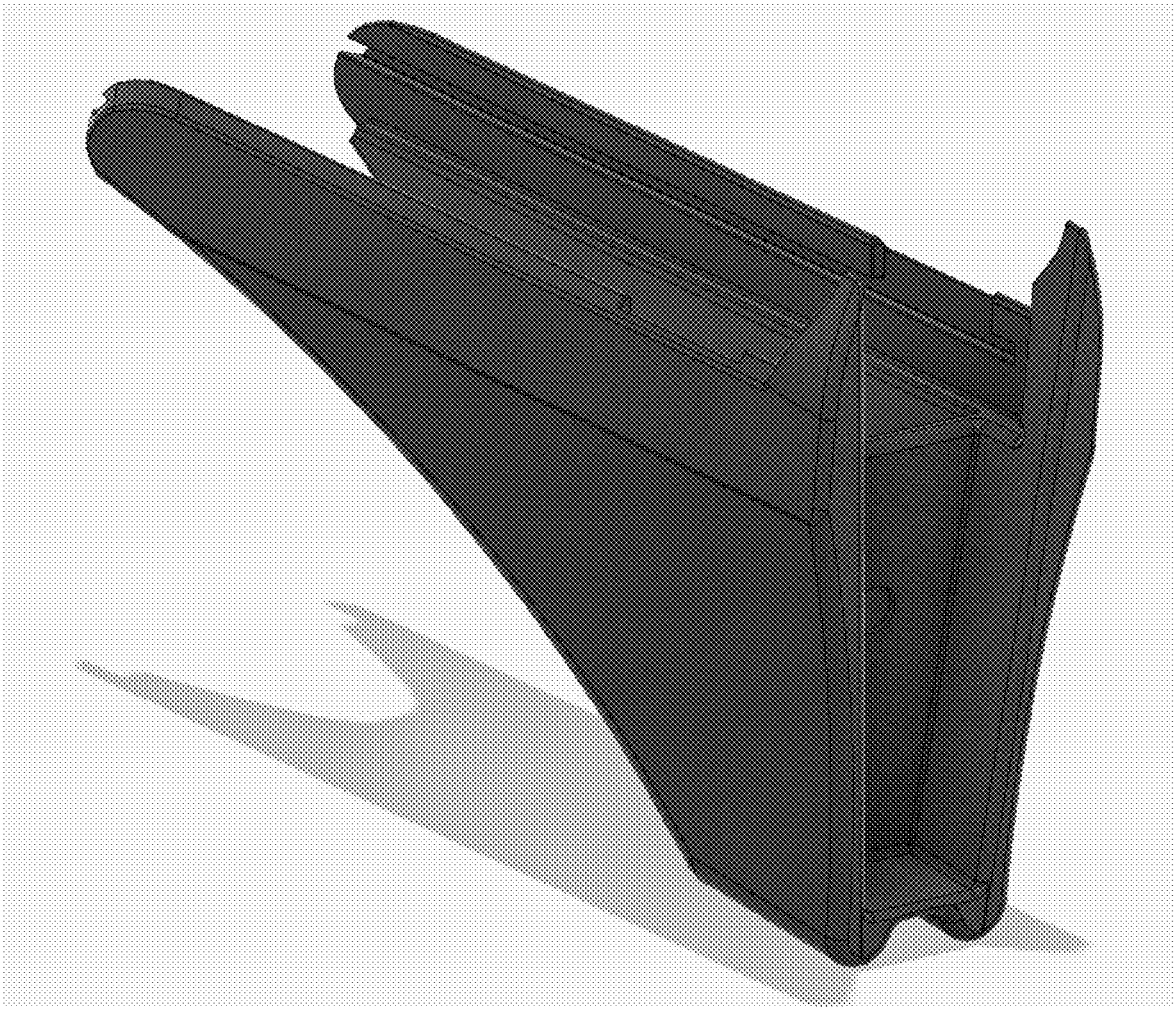
Figure 26:
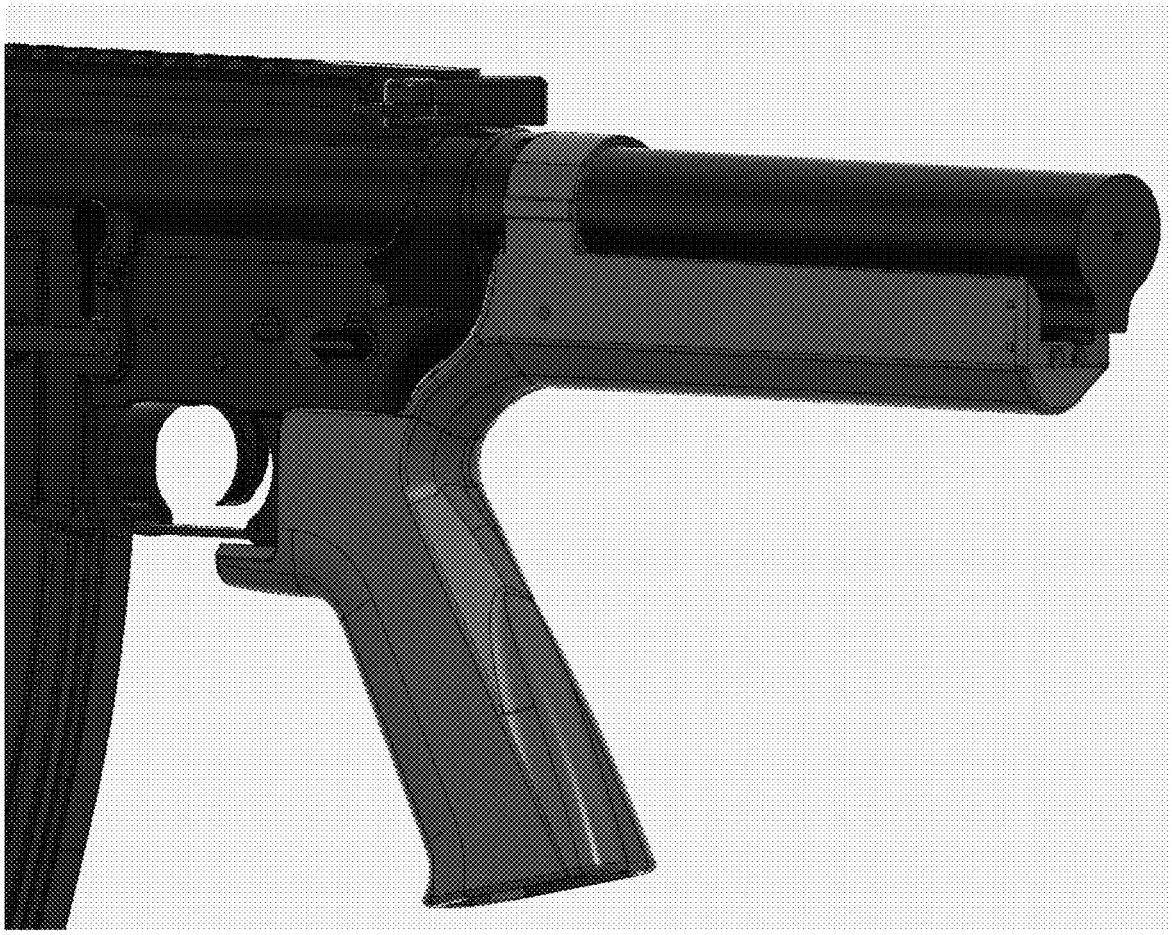
FIGS. 26-28 show an embodiment of a lower stock assembly in accordance with this disclosure, shown attached to a firearm.
Figure 27:
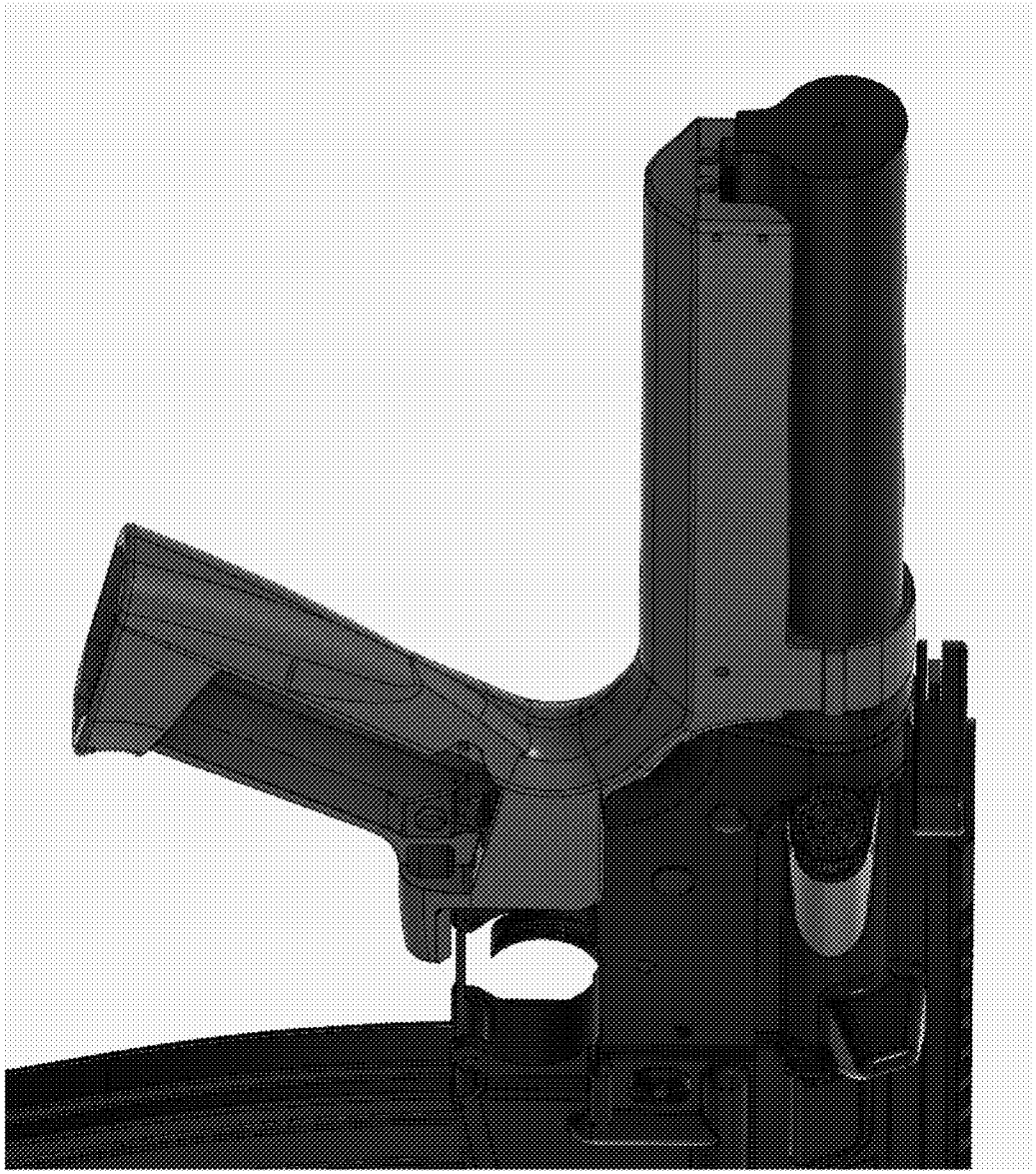
Figure 28:
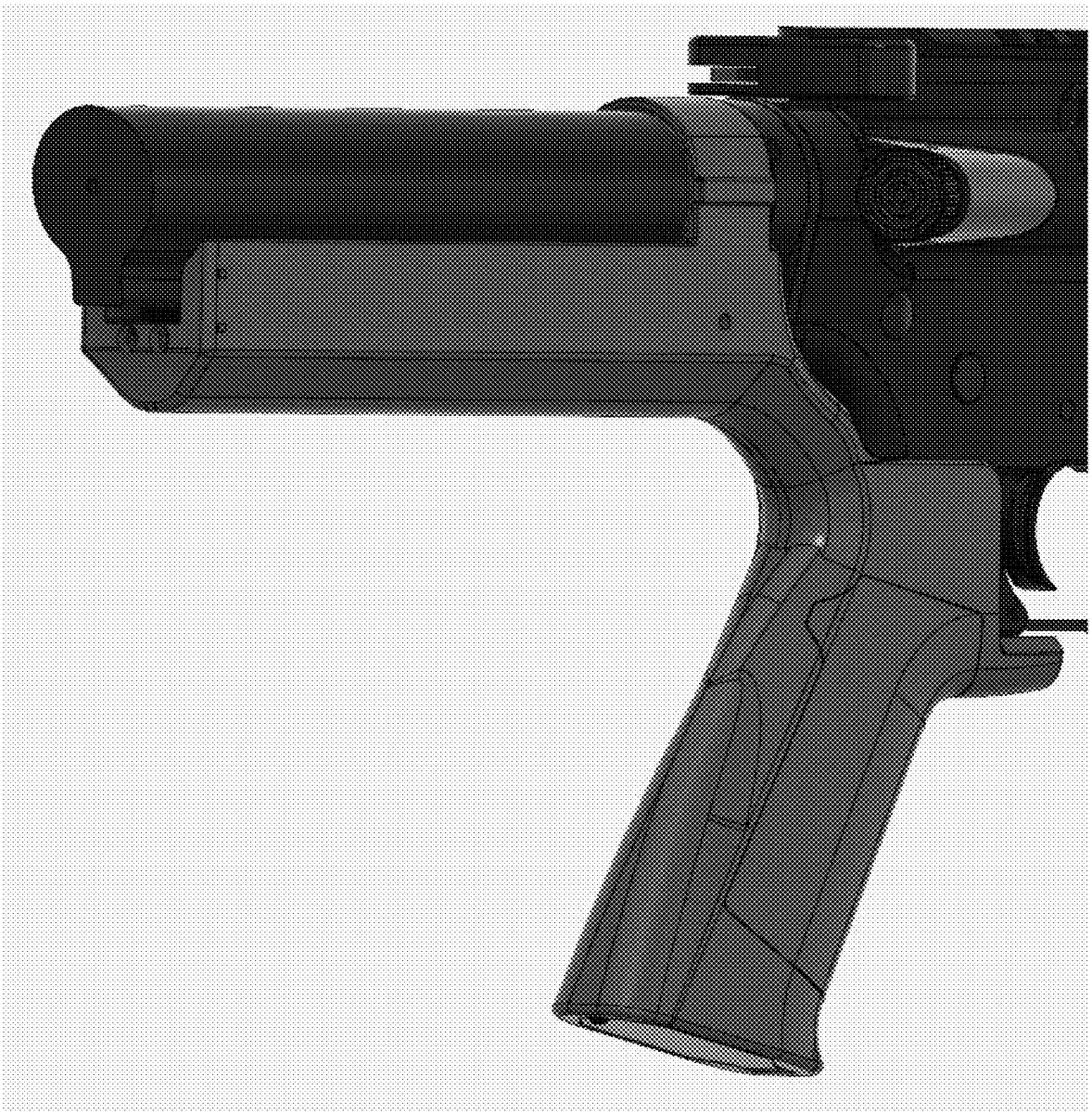
Figure 29:
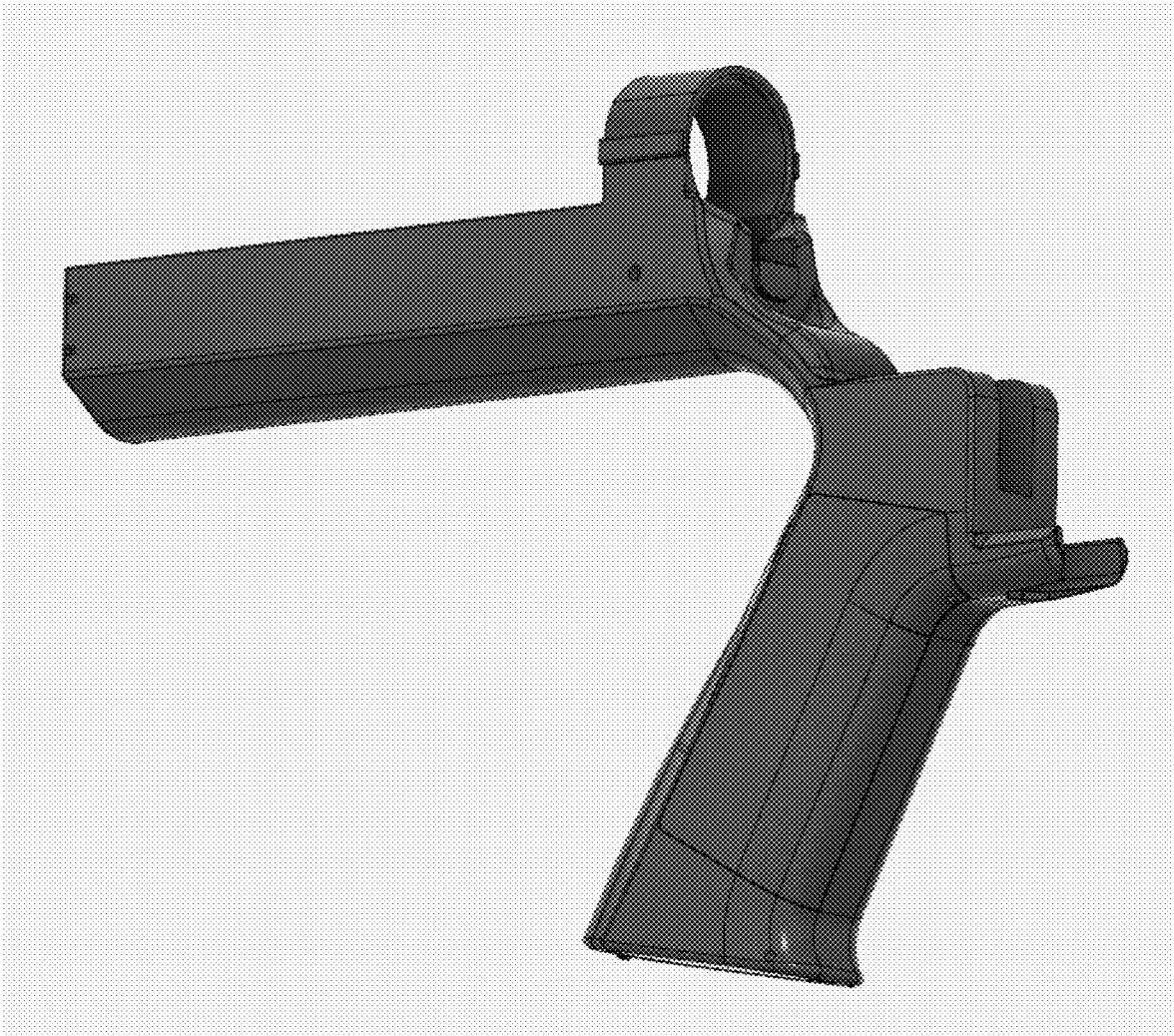
FIGS. 29-34 show an embodiment of the lower stock assembly of FIGS. 26-28, shown in isolation.
Figure 30:
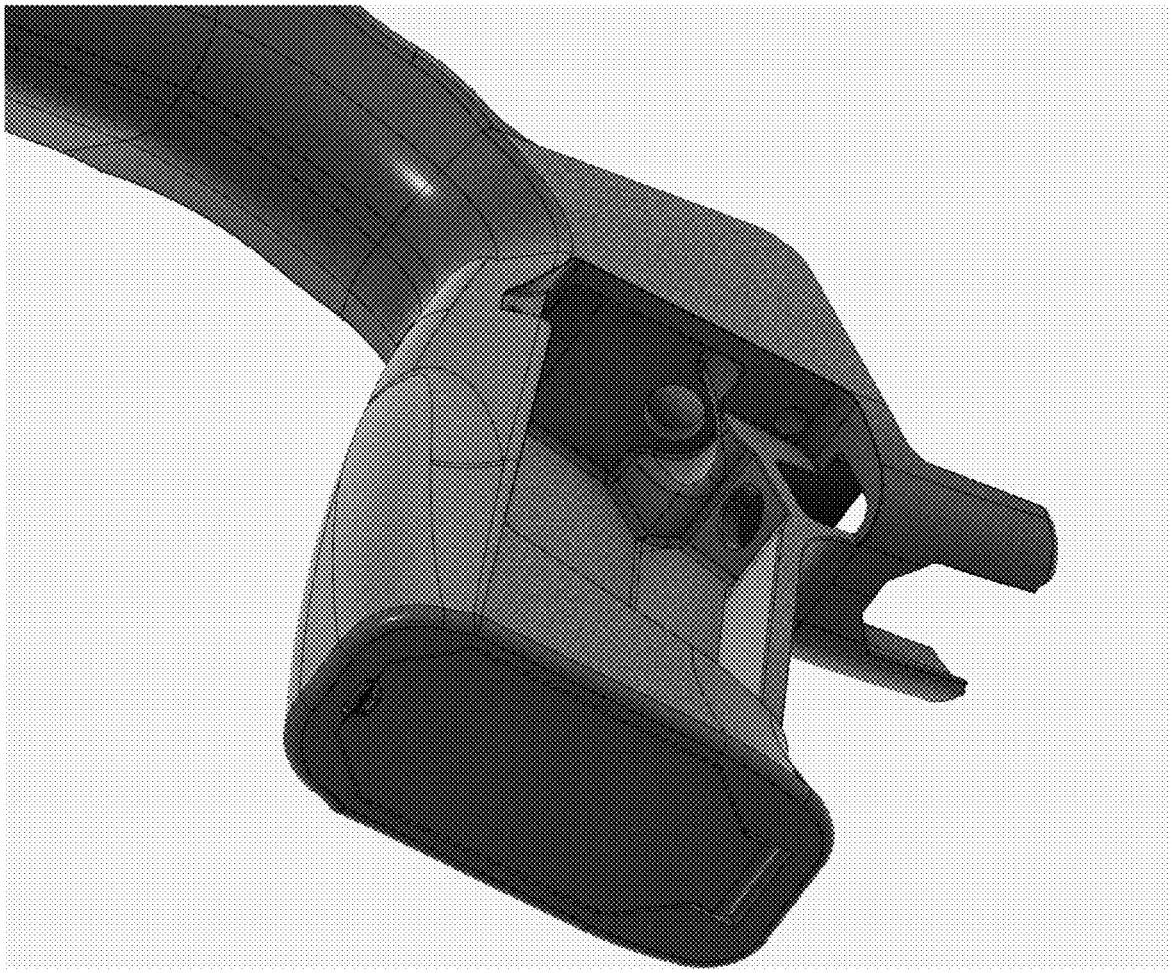
Figure 31:
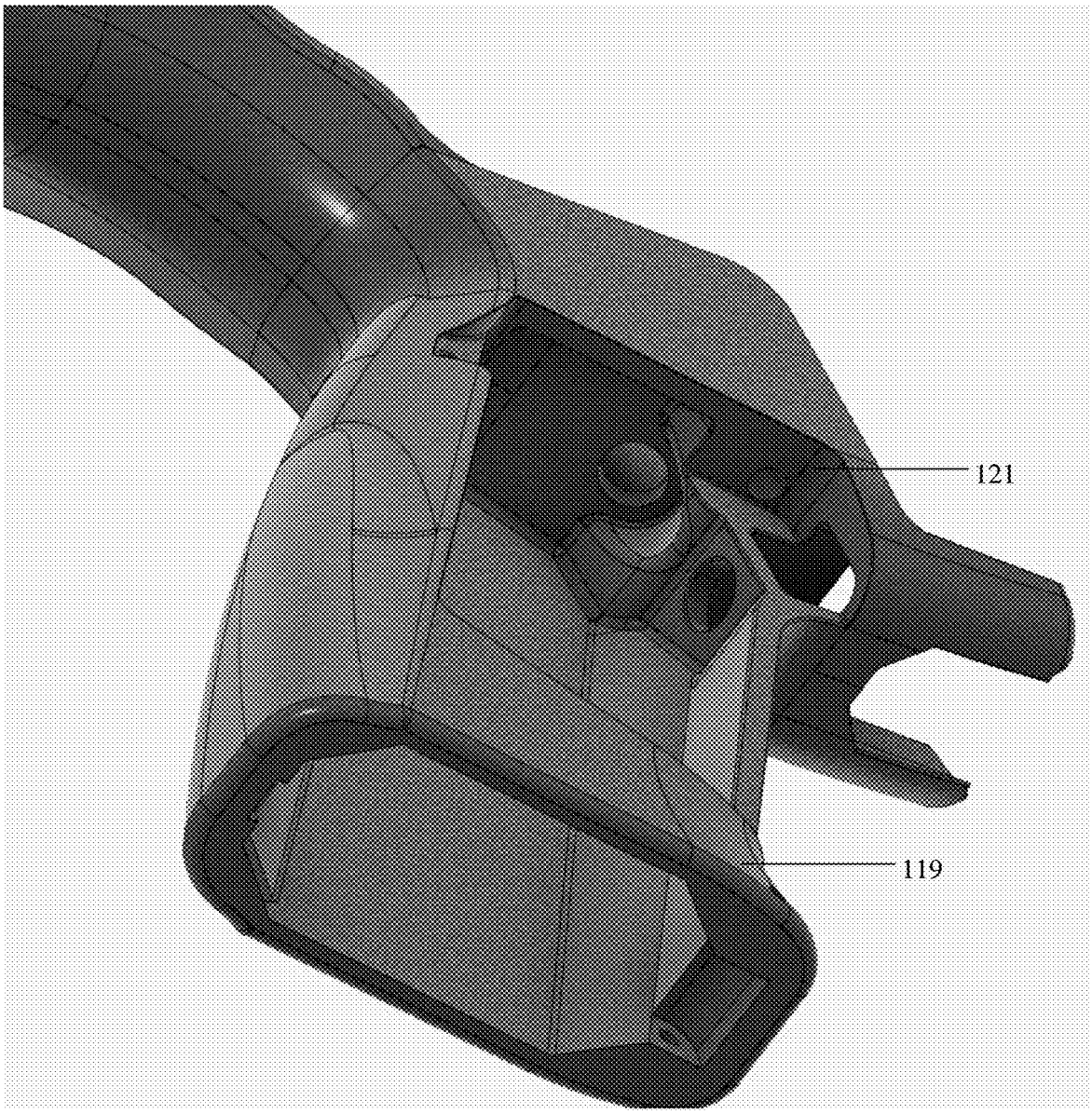
Figure 32:
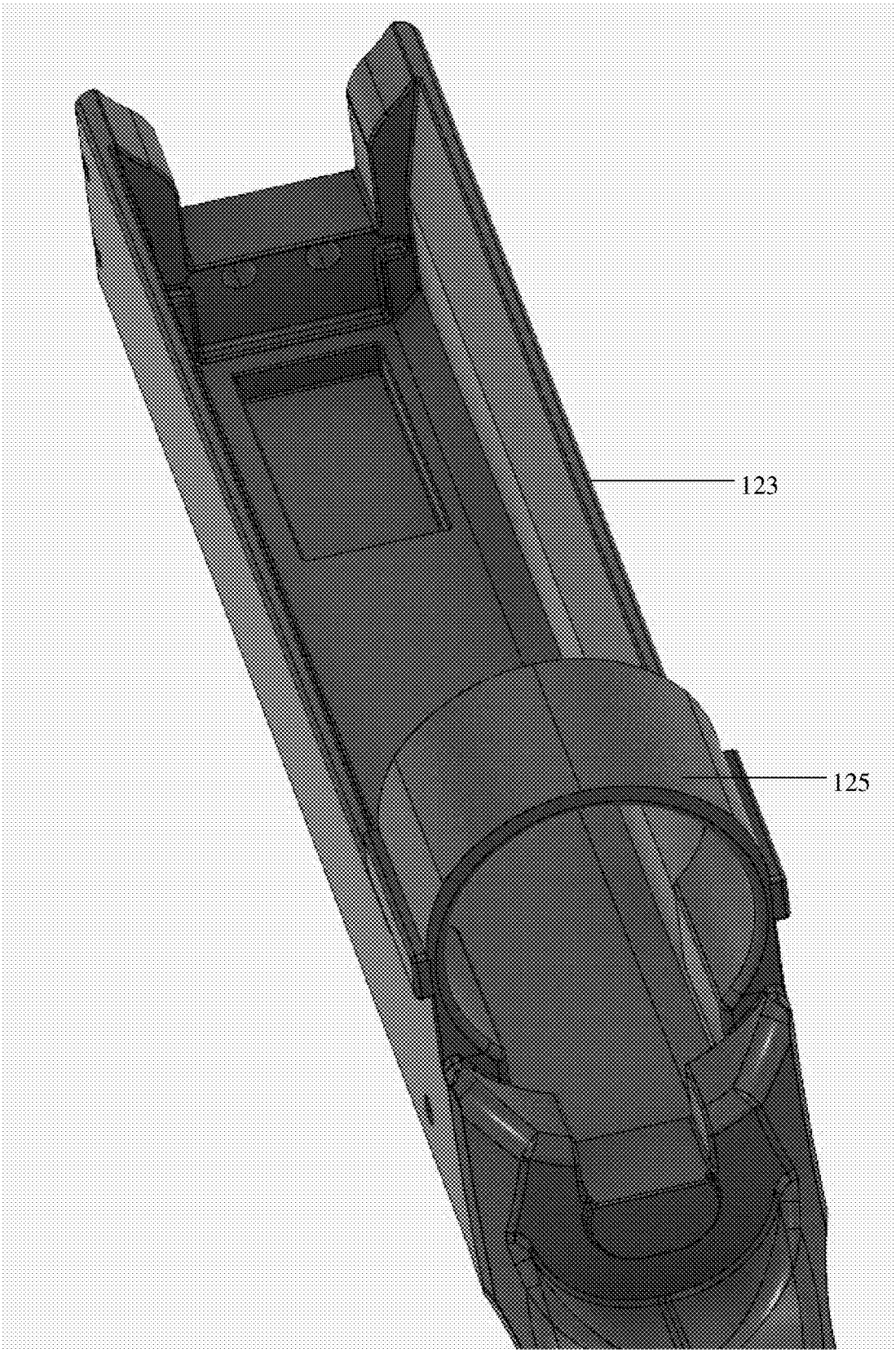
Figure 33:
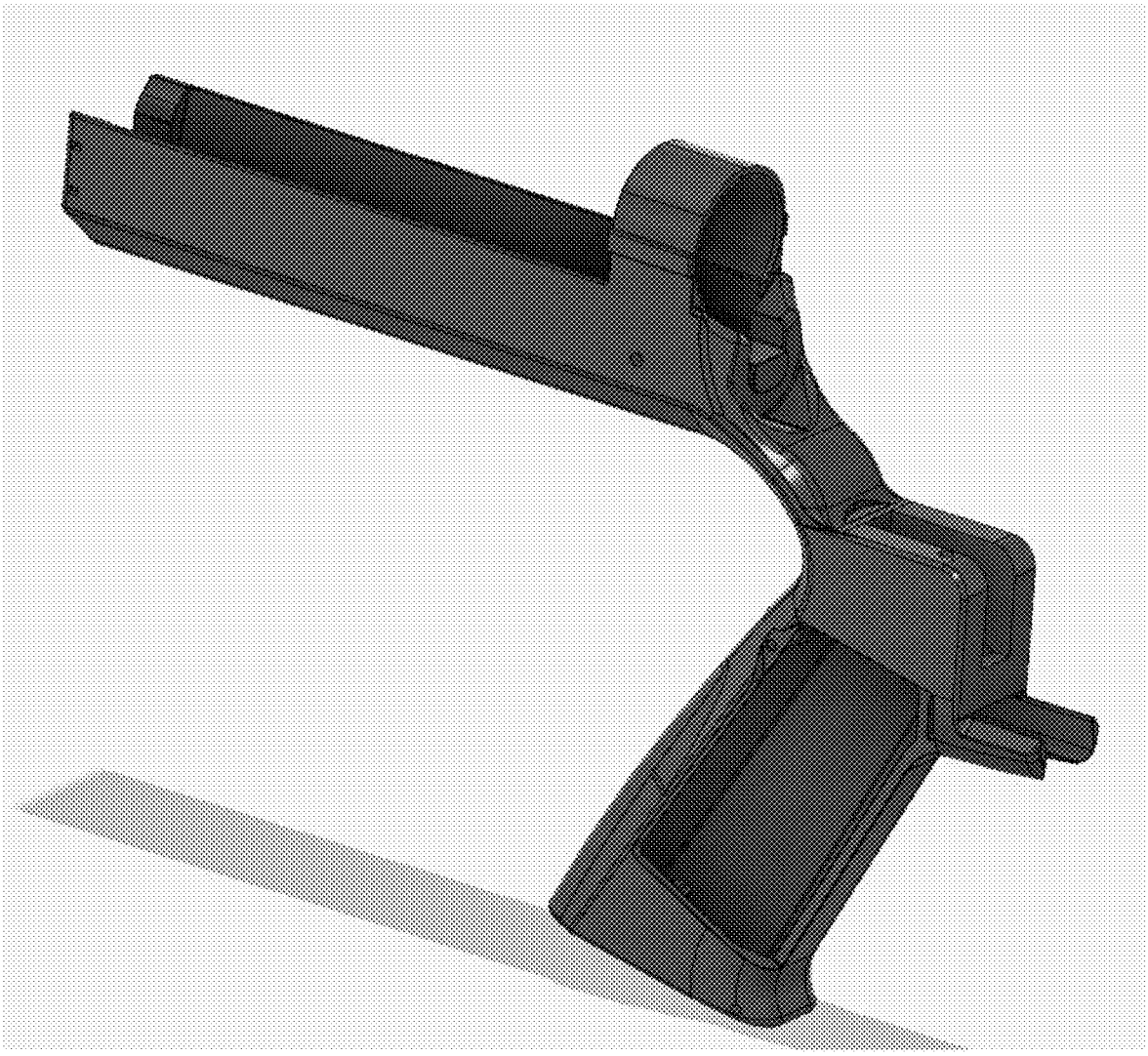
Figure 34:
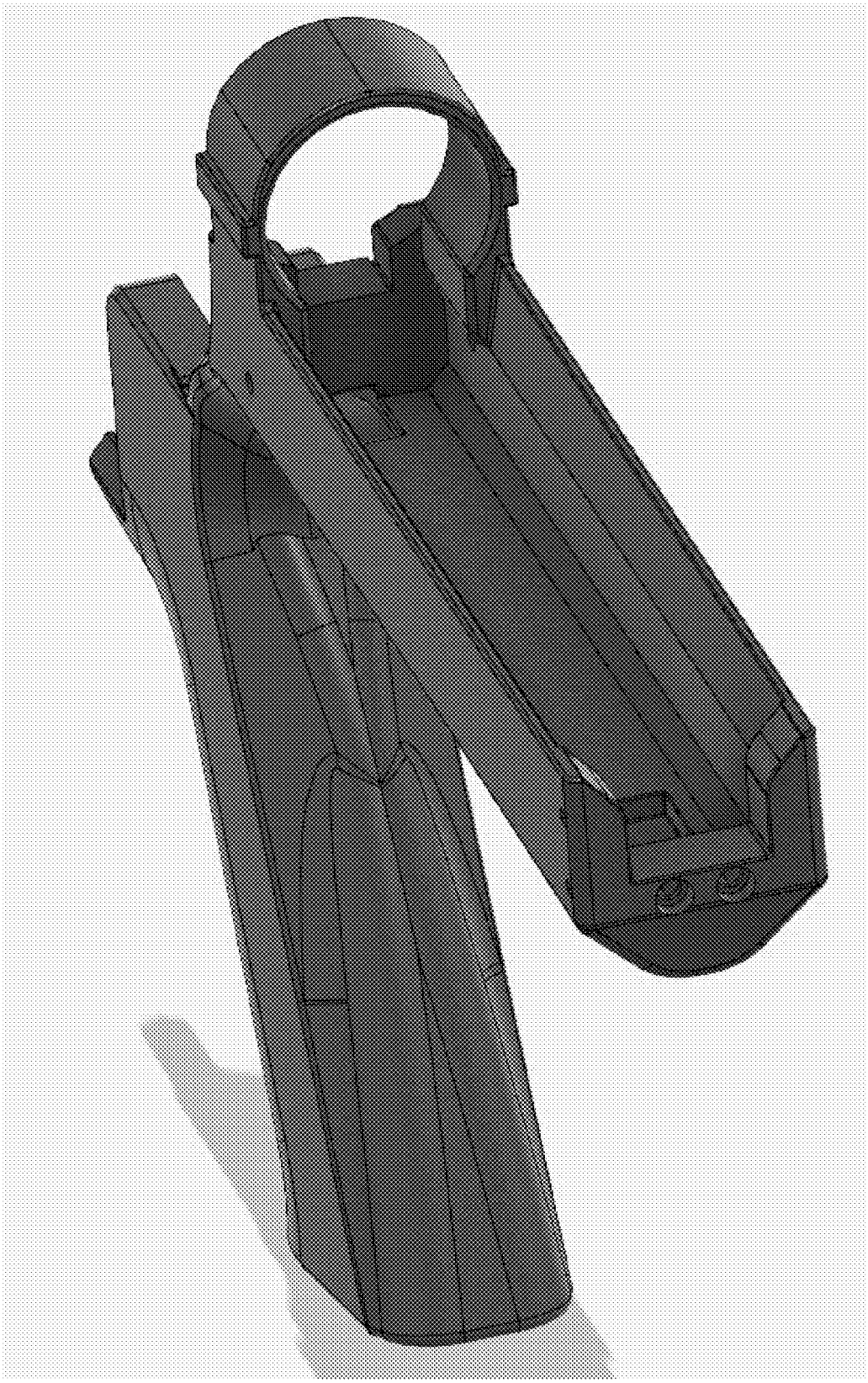
Figure 35:
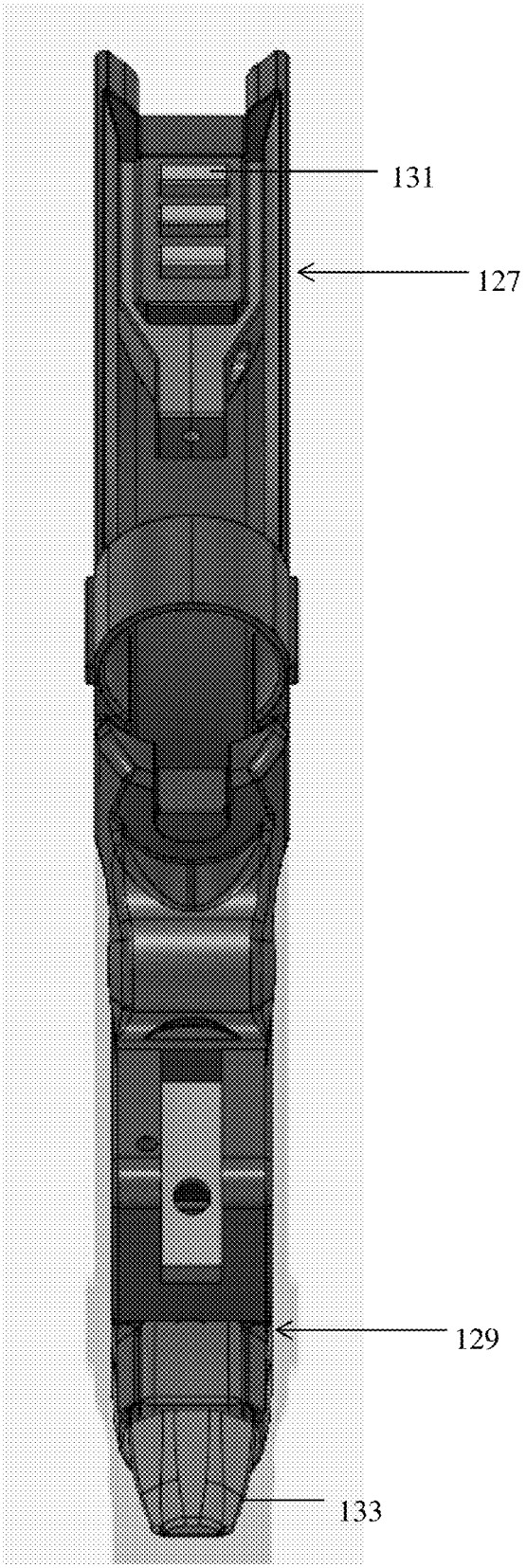
FIG. 35-38 show an embodiment of a stock control system disposed within the lower stock assembly of FIGS. 26-34, shown in isolation and having a stock actuator assembly and a stock latch assembly.
Figure 36:
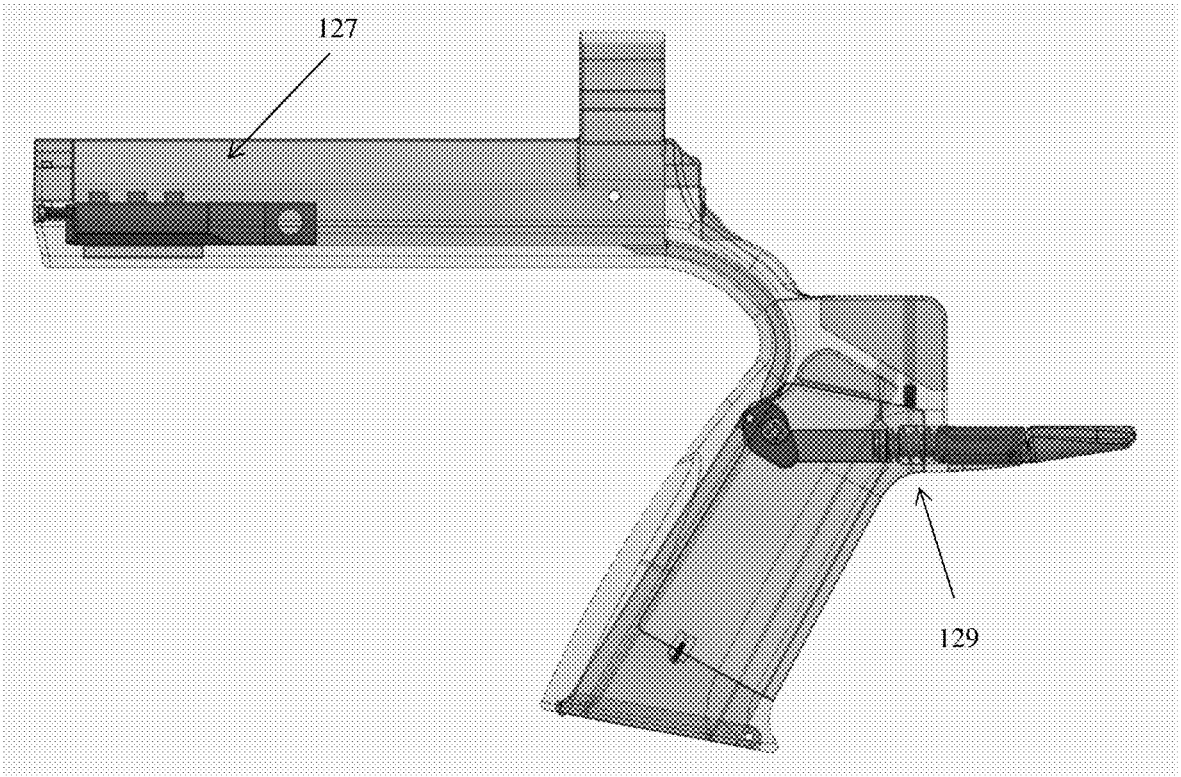
Figure 37:
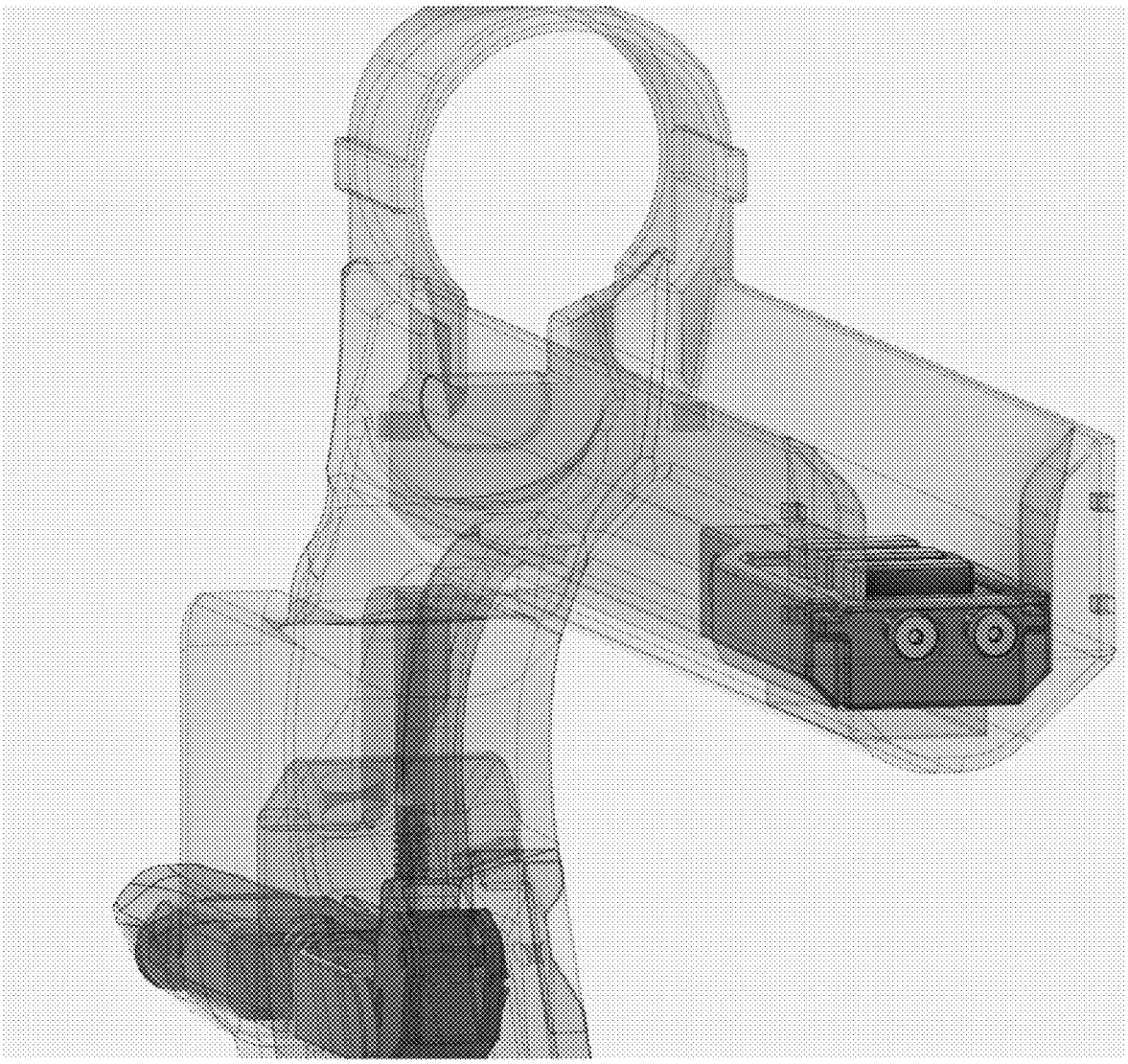
Figure 38:
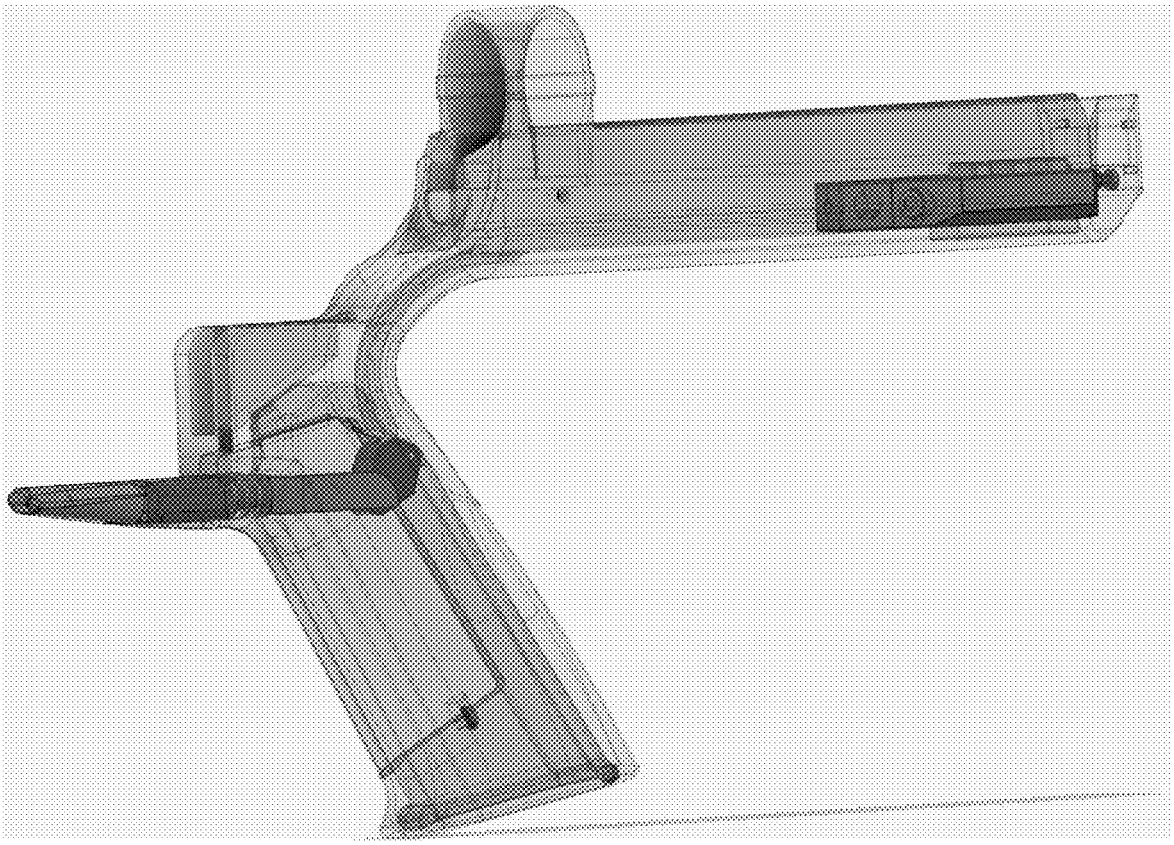
Figure 39:
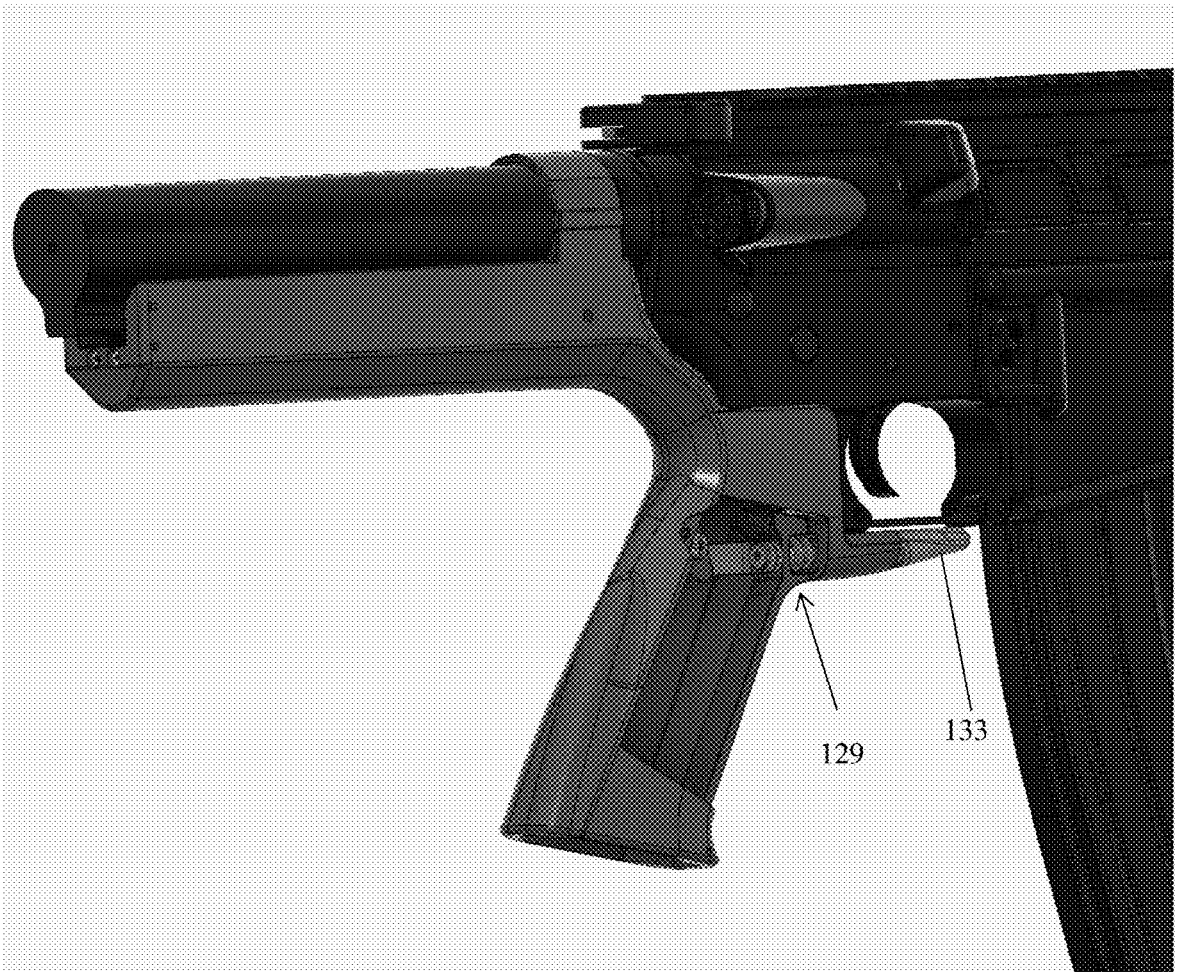
FIGS. 39-42 show the embodiment of FIG. 35-38 disposed within the lower stock assembly of FIGS. 26-34, shown attached to a firearm.
Figure 40:
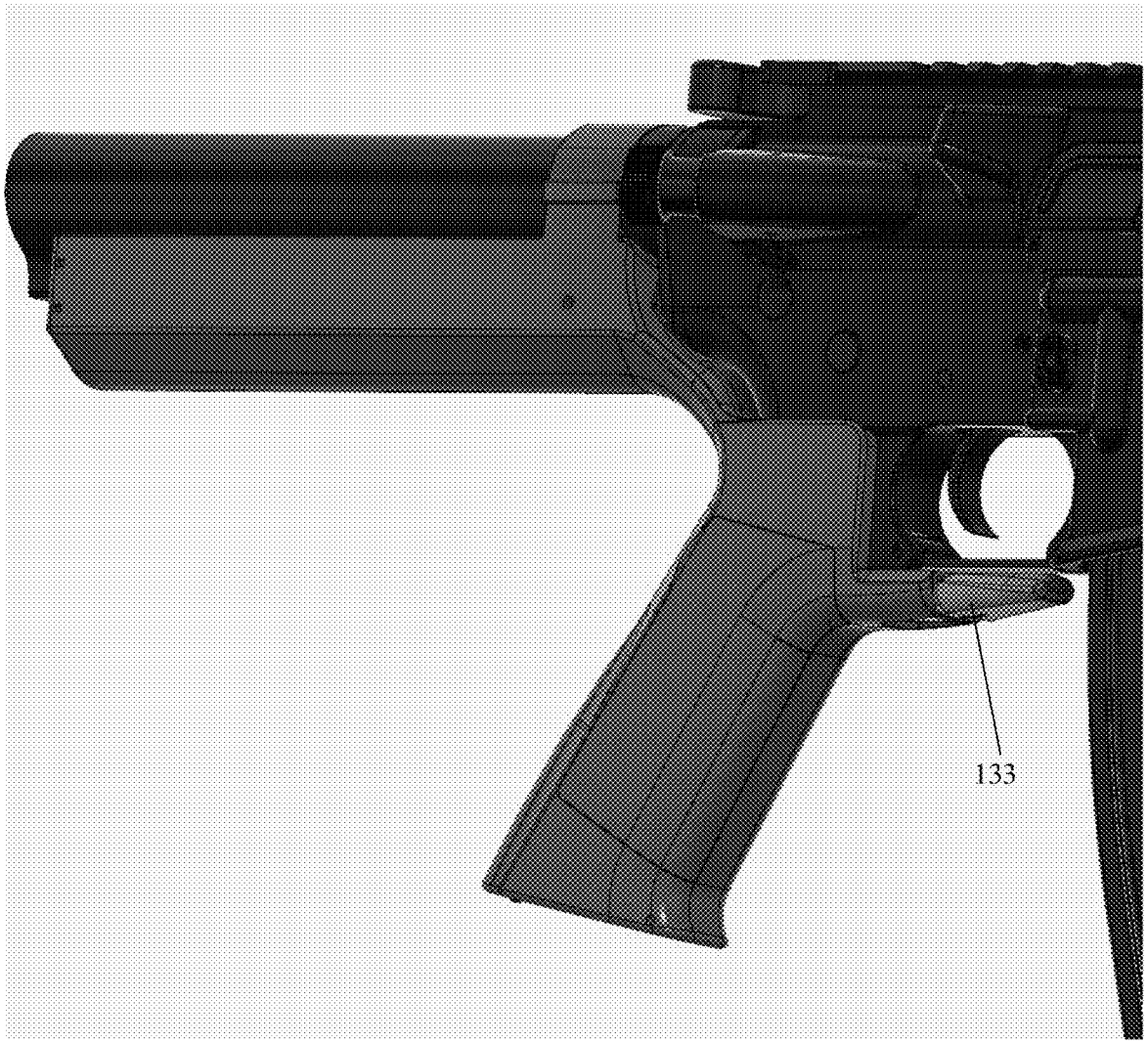

FIGS. 22 and 23 show the portions described above slidably disposed on a lower stock assembly 105 and in an extended position. FIGS. 24 and 25 show an embodiment of a lower cover 107 in accordance with this disclosure. FIGS. 26-28 show an embodiment of a lower stock assembly 105 in accordance with this disclosure, shown attached to a firearm.

FIGS. 29-34 show an embodiment of the lower stock assembly 105 of FIGS. 26-28, shown in isolation. As shown, the lower stock assembly 105 can include a handle 119 that defines an internal compartment 121, e.g., for housing components of an actuation system described herein. The lower stock assembly 105 can also include an extension 123, e.g., for housing components of a latching system as described herein. The extension 123 can include a buffer tube ring 125 for orienting and hanging the lower stock assembly 105 from a buffer tube of a rifle (e.g., an AR-15).

FIG. 35-38 show an embodiment of a stock control system disposed within the lower stock assembly 105, shown in isolation and having a stock actuator assembly 129 and a stock latch assembly 127.

Figure 56:
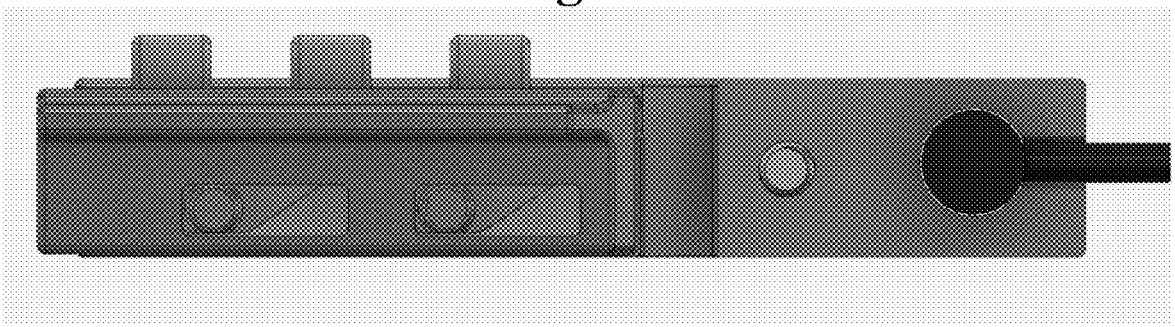
Figure 57:
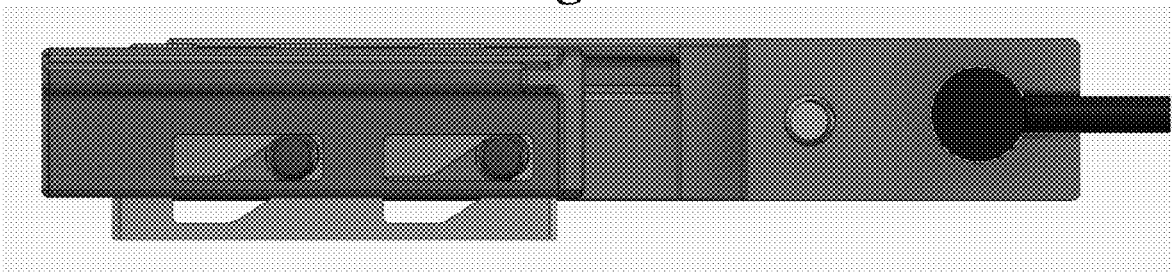
Figure 58:
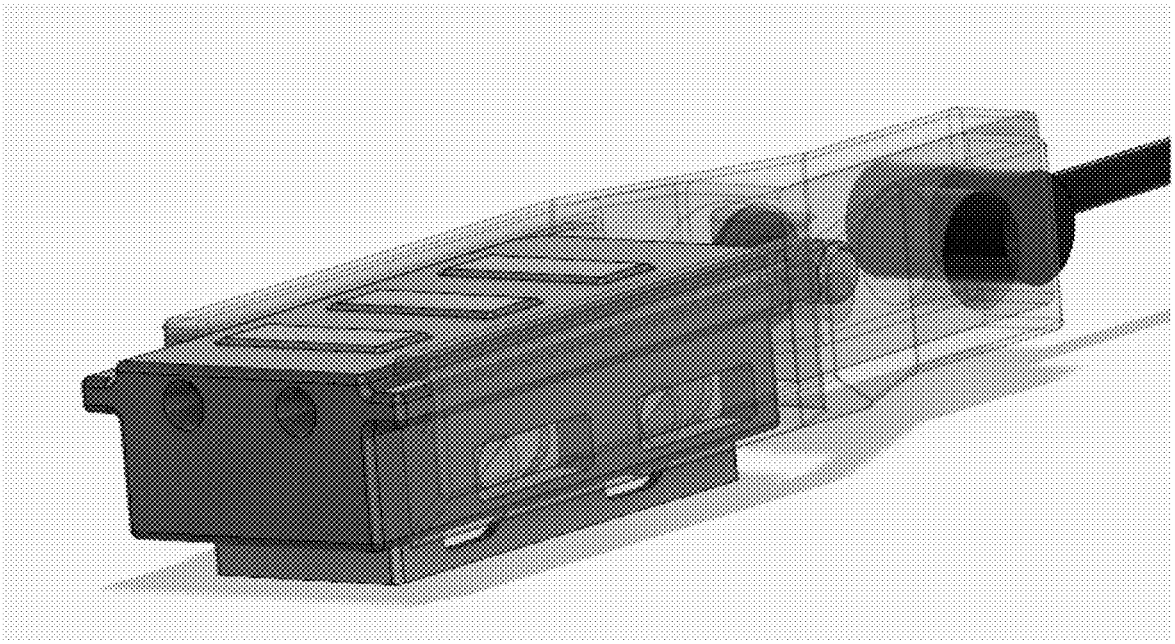
Figure 59:
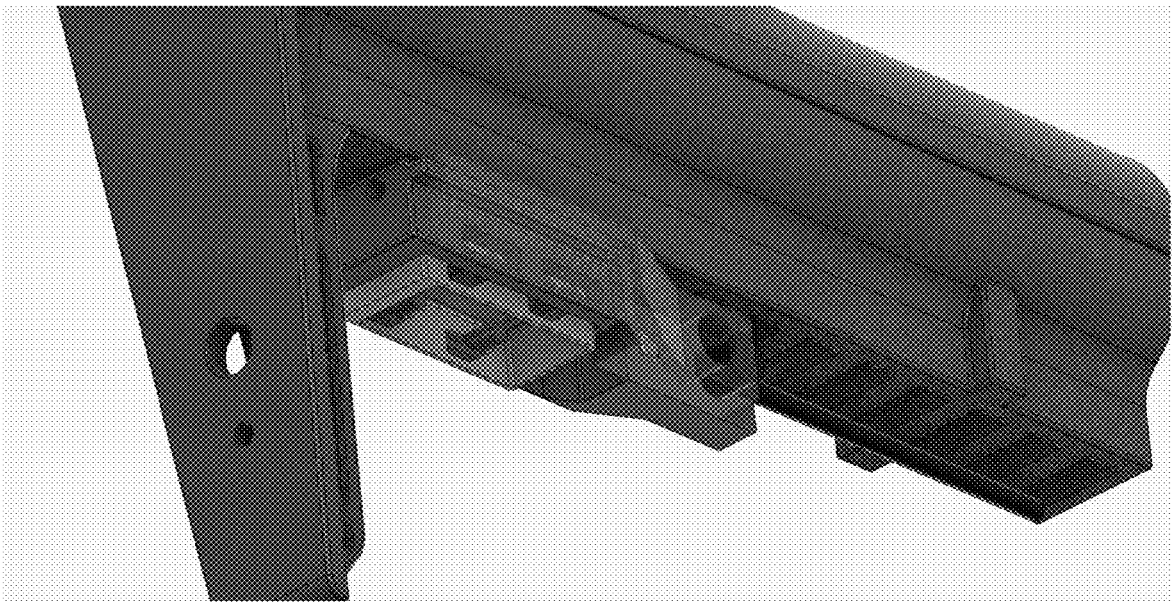
Figure 60:
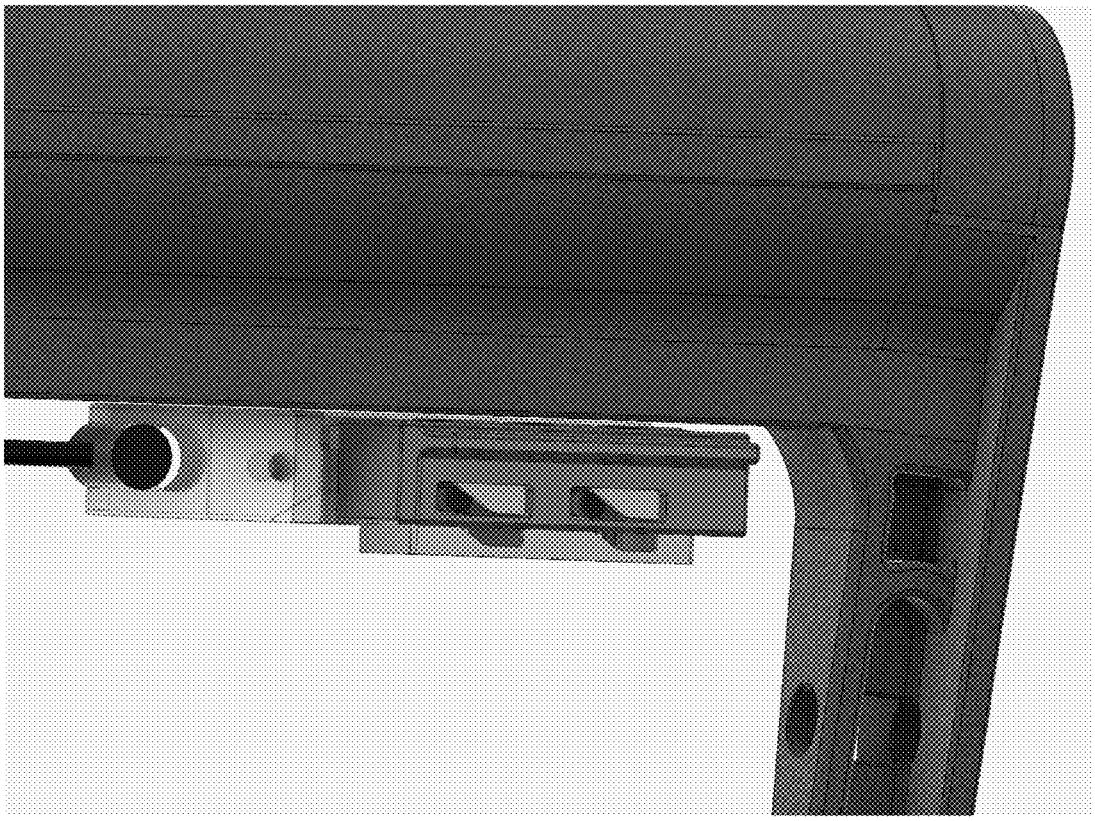
Figure 61:
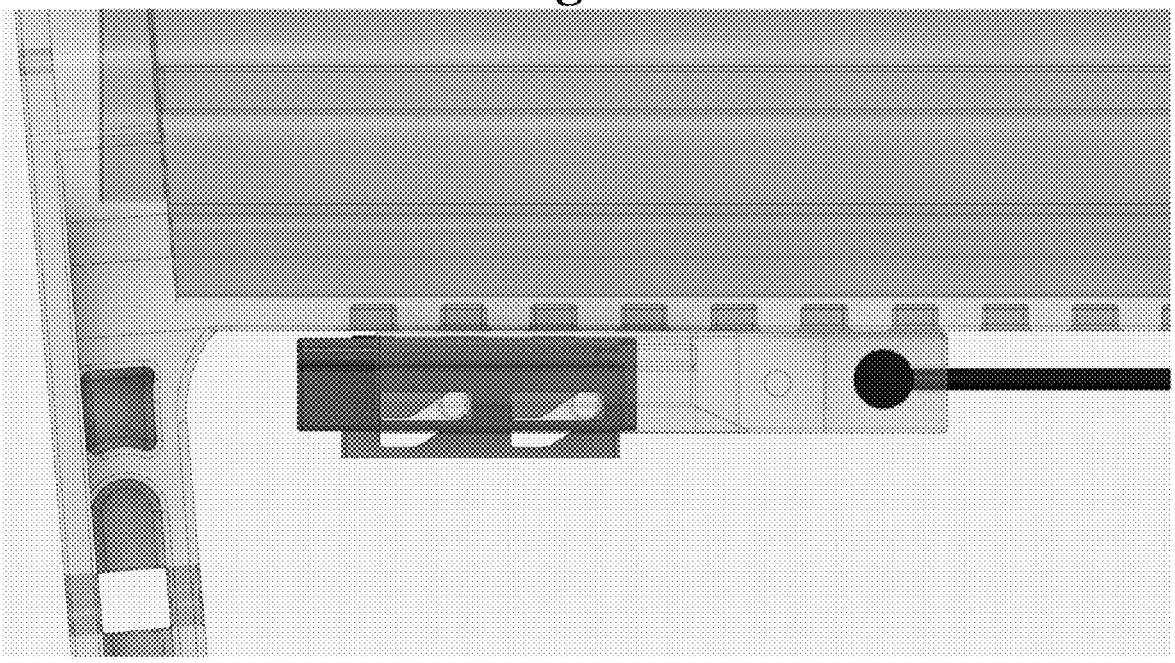
Figure 62:
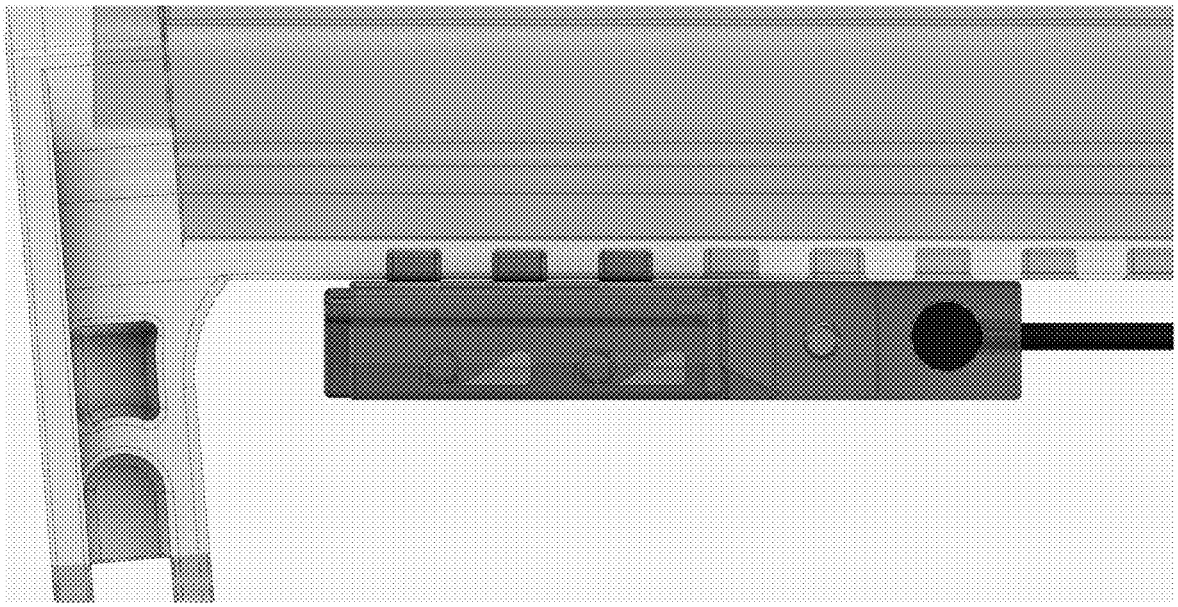
Figure 63:
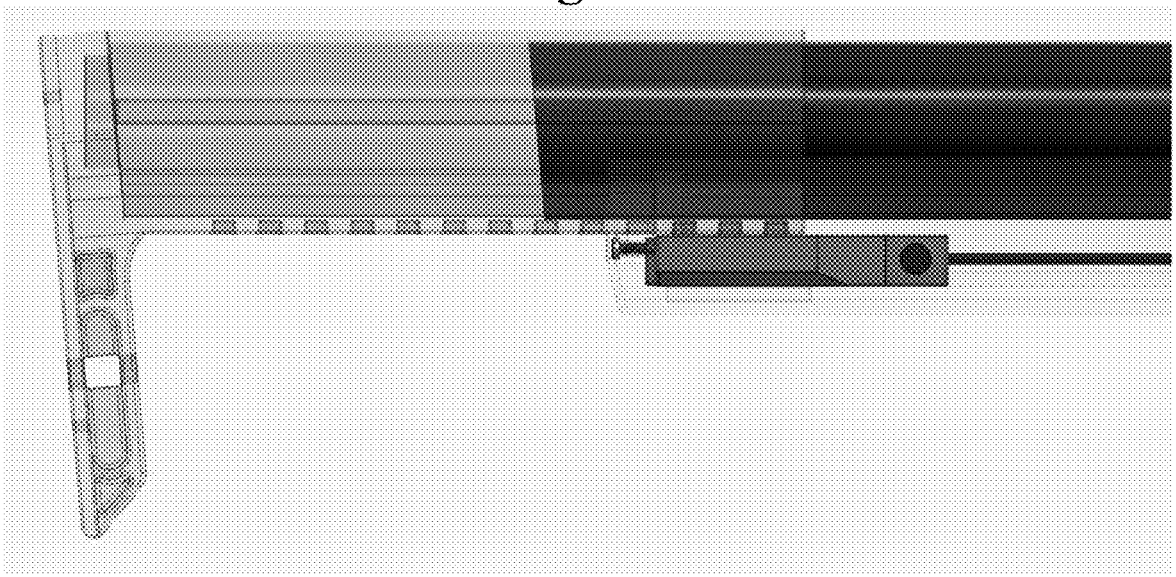

As shown, the latch assembly 127 can be disposed within the lower stock assembly 105, e.g., at the extension 123. The latch assembly 127 is configured to be moveable between a latched position where the buttstock slider 101 cannot slide relative to the firearm and an unlatched position where the buttstock slider 101 is free to slide relative to the firearm. The actuator assembly 129 is configured to move the latch assembly 127 between the latched position (e.g., as shown in FIG. 56) and the unlatched position (e.g., as shown in FIG. 57).

FIGS. 39-42 show the actuation assembly 129 disposed within the lower stock assembly 105, shown attached to a firearm. FIGS. 43-48 show an embodiment of the actuator assembly 109 in isolation. The actuator assembly 129 can include an actuation trigger 133 that is configured to be positioned adjacent a grip of the firearm (e.g., handle 119) when the system 100 is installed on a firearm such that a user can actuate the latch assembly 127 without removing a hand from the firearm or grip. In certain embodiments, the actuation trigger 133 can be configured to be positioned below a trigger guard of the firearm when the system 100 is installed on the firearm such that the user's trigger finger or other trigger hand digit (e.g., middle finger, ring finger, pinky) can actuate the actuation trigger 133 without removing a hand from the firearm or grip.

Figure 41:
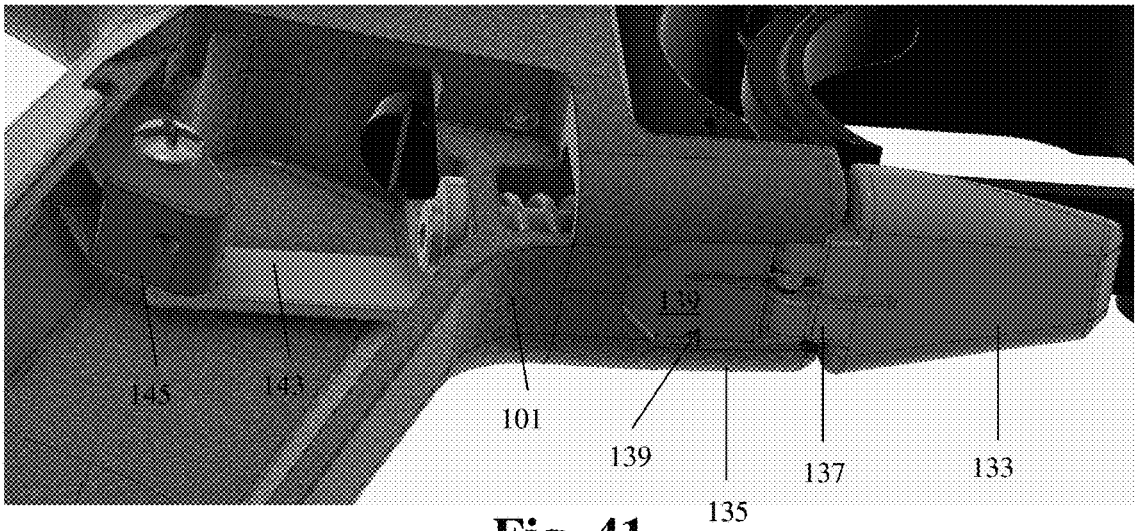
Figure 42:
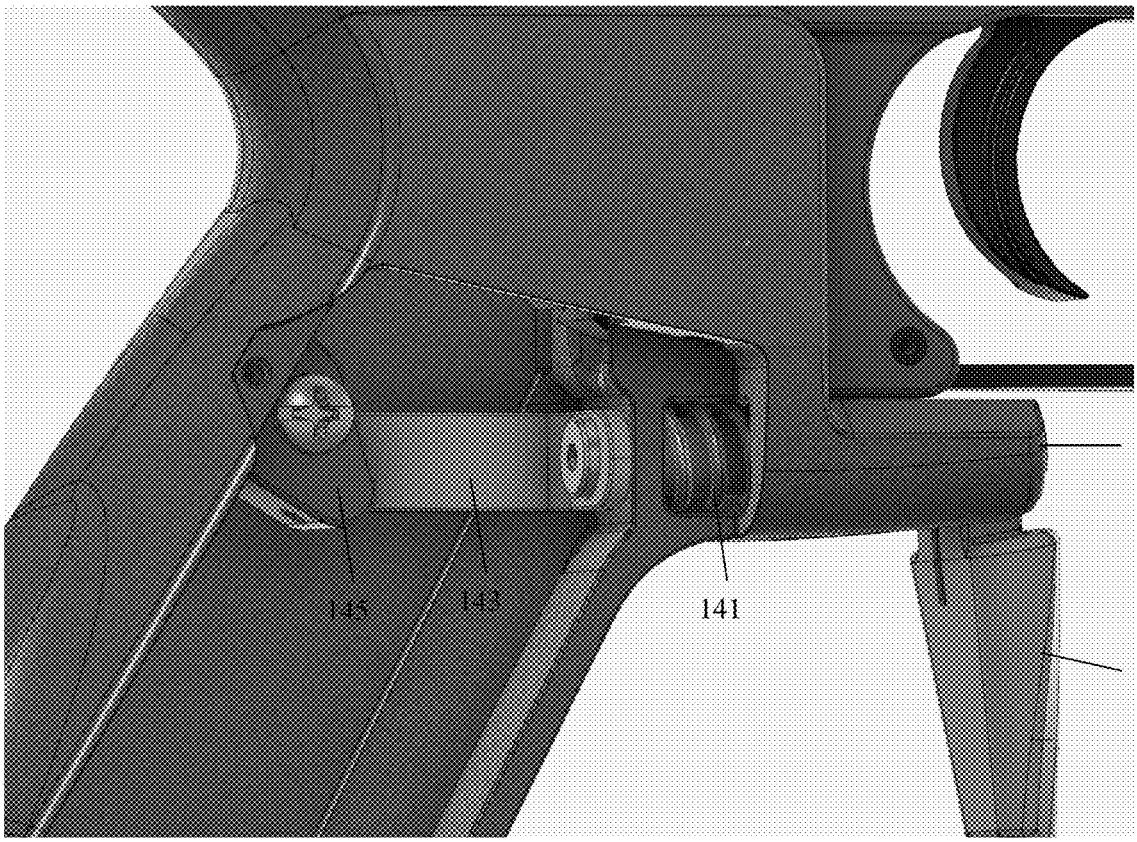
Figure 43:
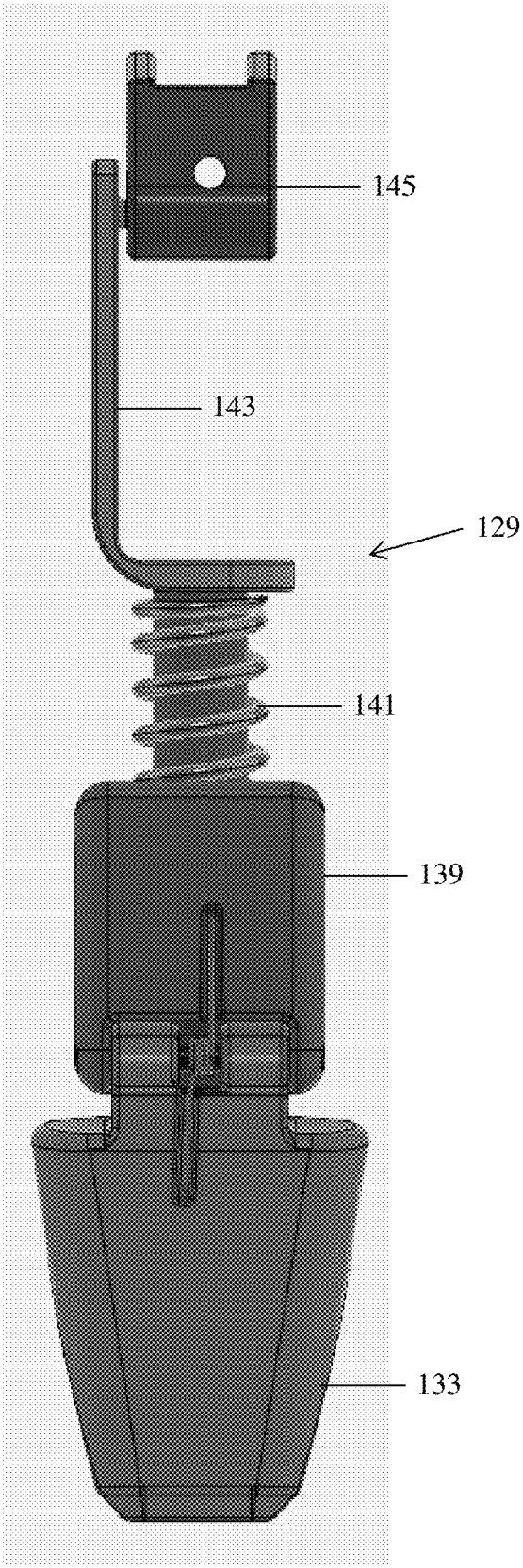
FIGS. 43-48 show the embodiment of the actuator assembly of FIGS. 35-42 shown in accordance with this disclosure, shown in isolation.
Figure 44:
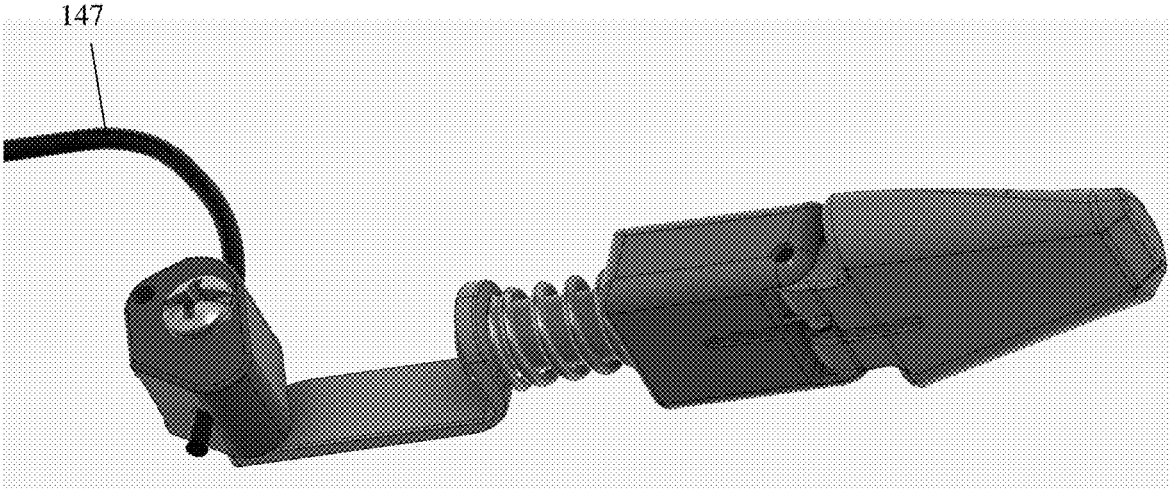
Figure 45:
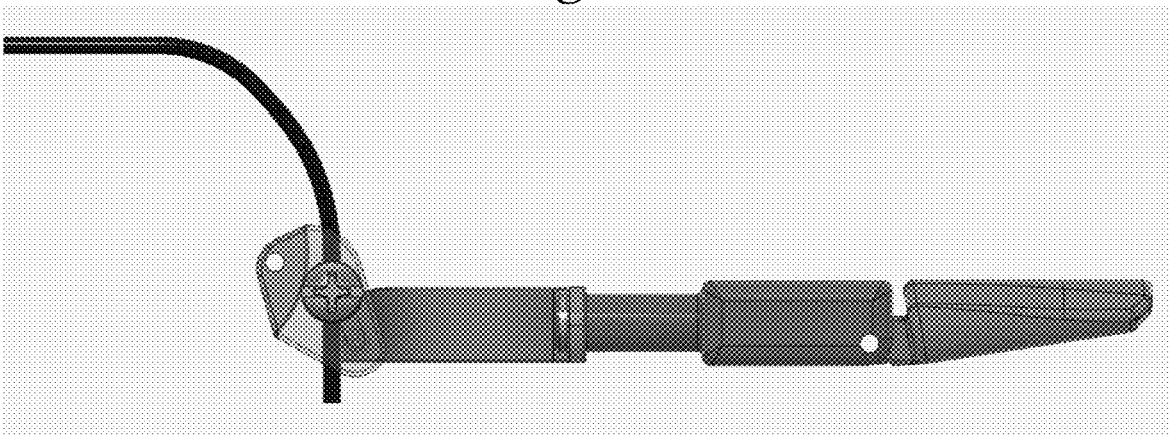
Figure 46:
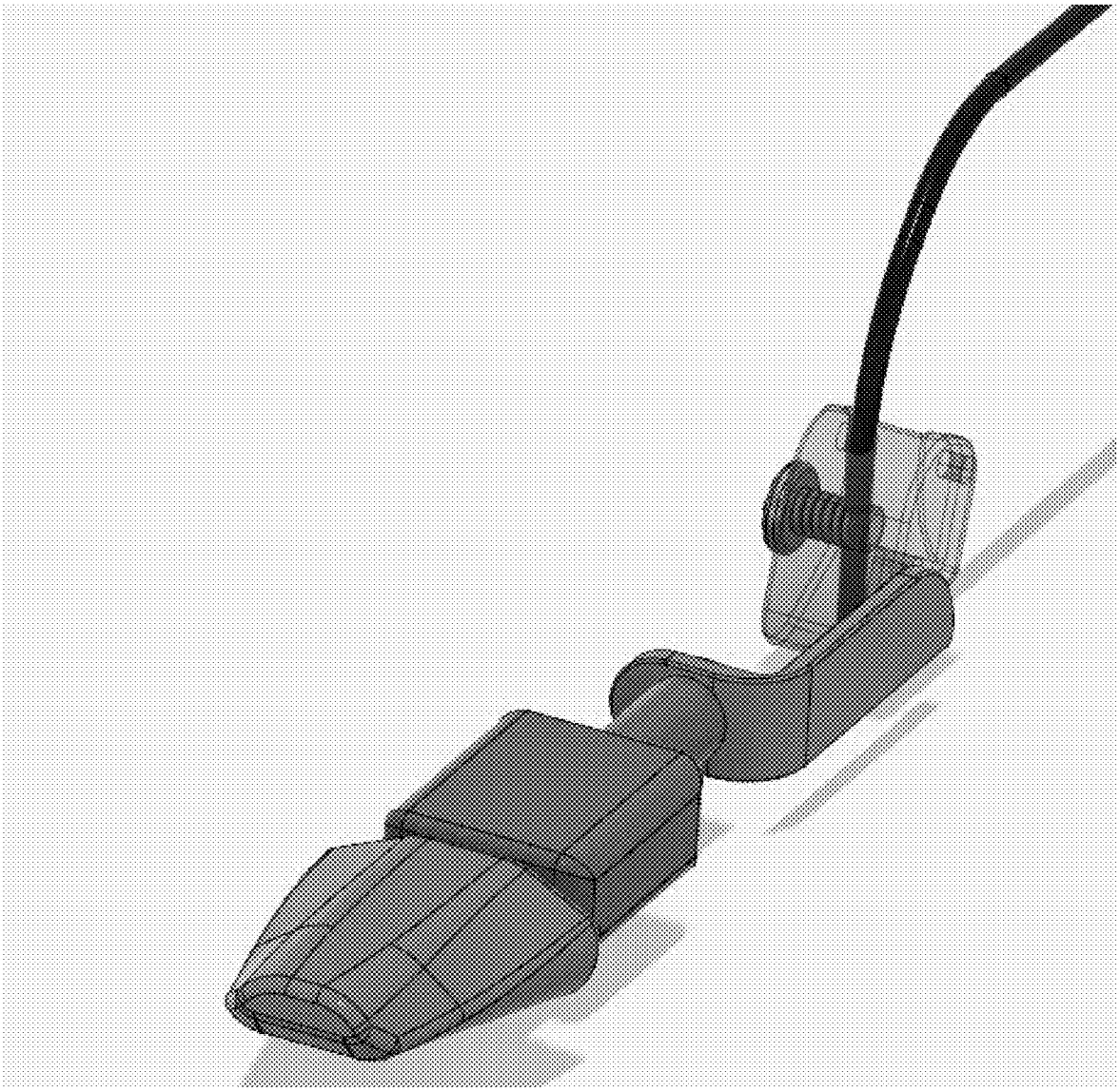
Figure 47:
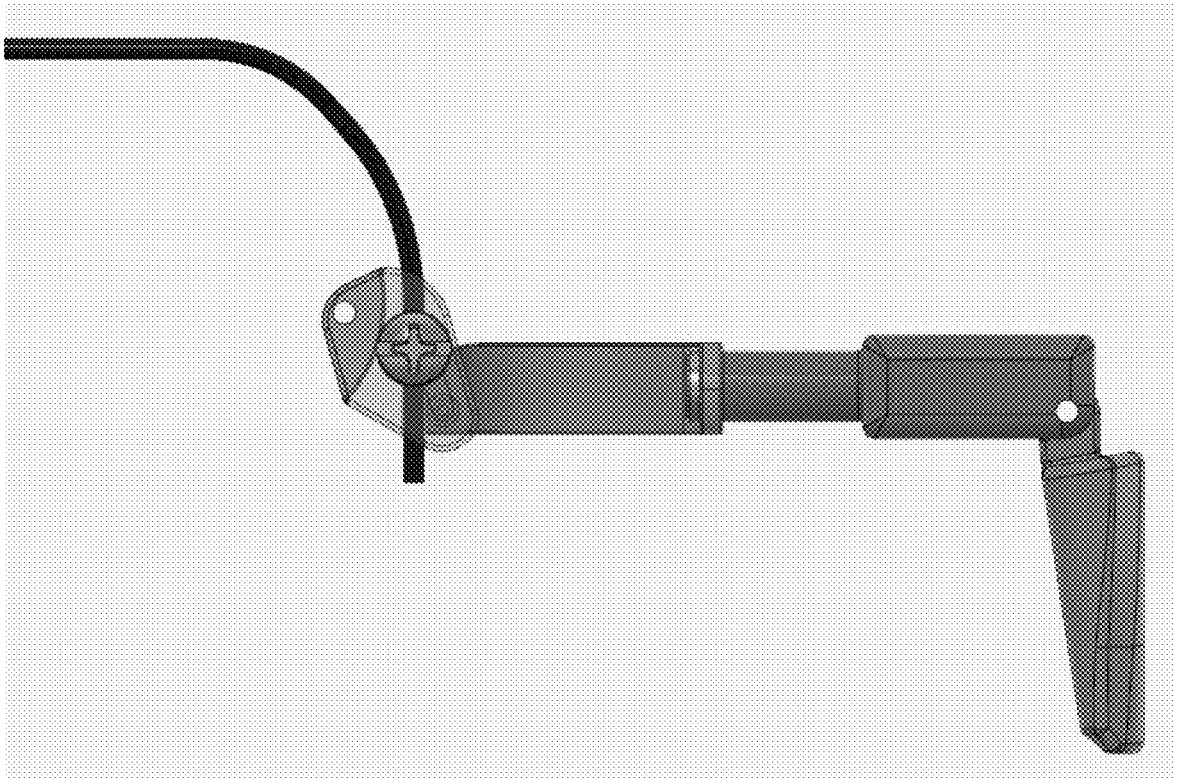
Figure 48:
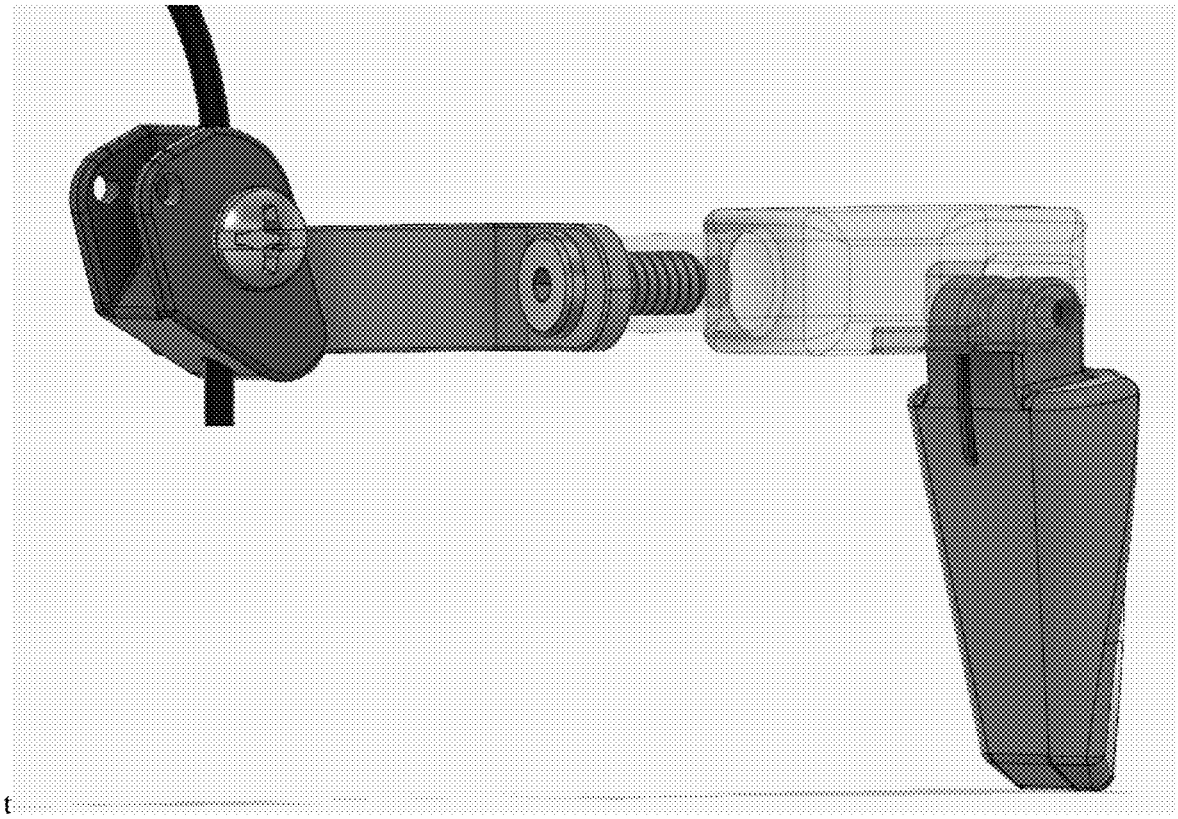
Figure 49:
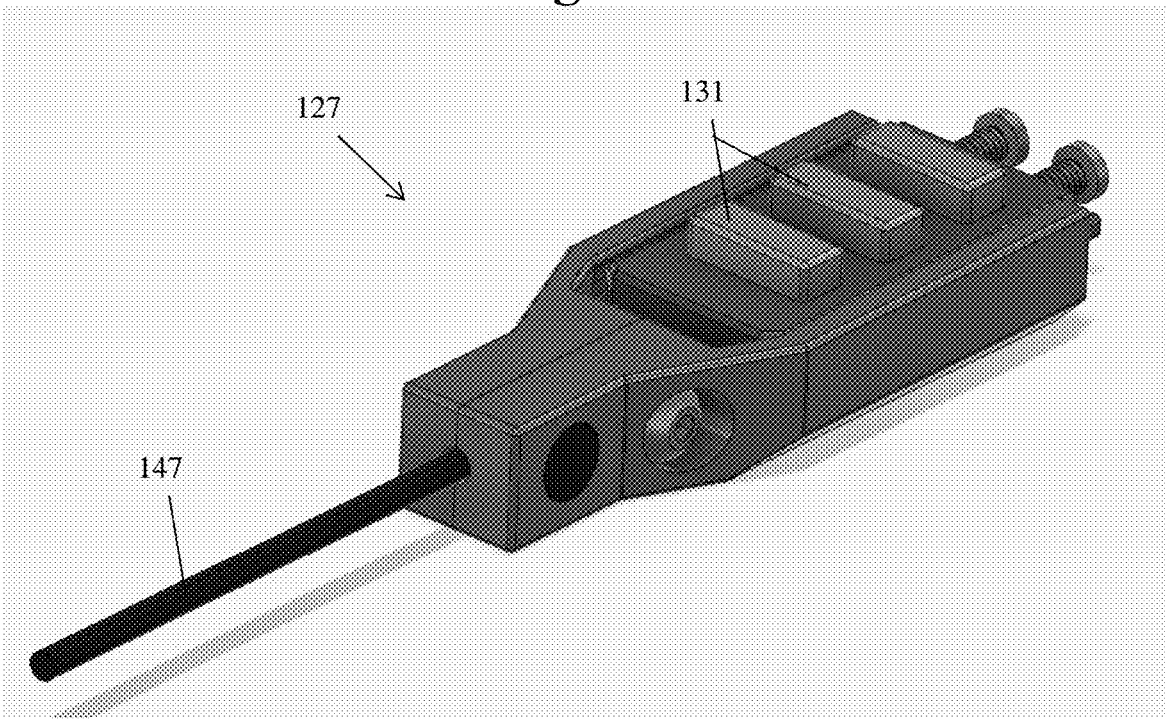
FIGS. 49-58 show the embodiment of the latch assembly of FIGS. 35-42 in accordance with this disclosure, shown in isolation.
Figure 50:
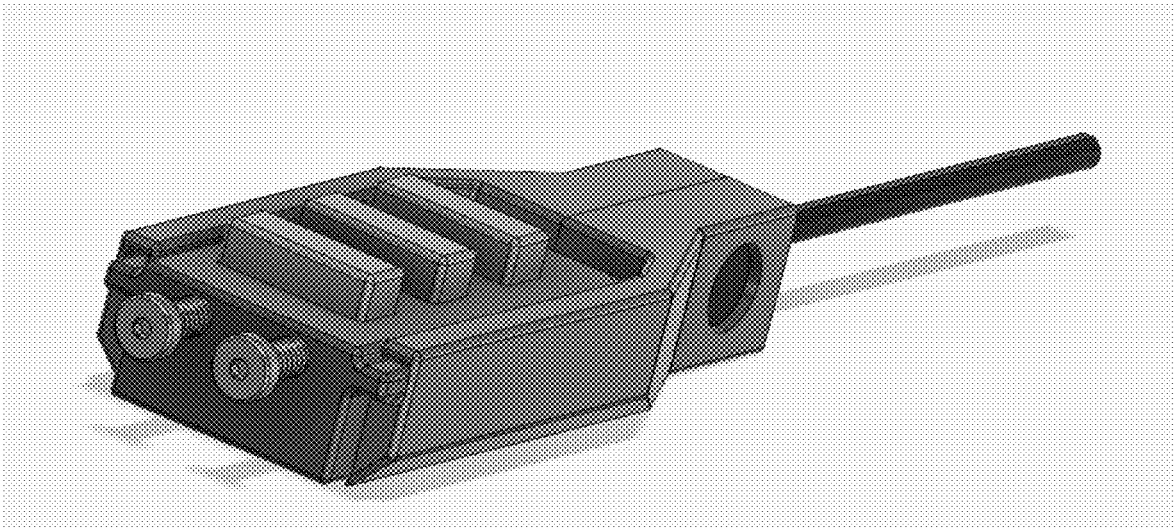
Figure 51:
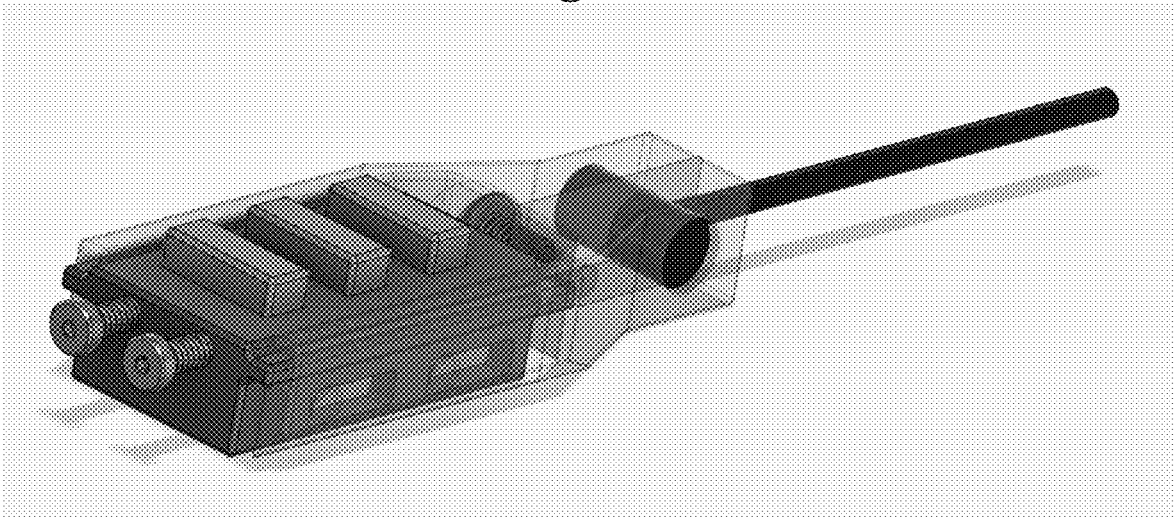
Figure 52:
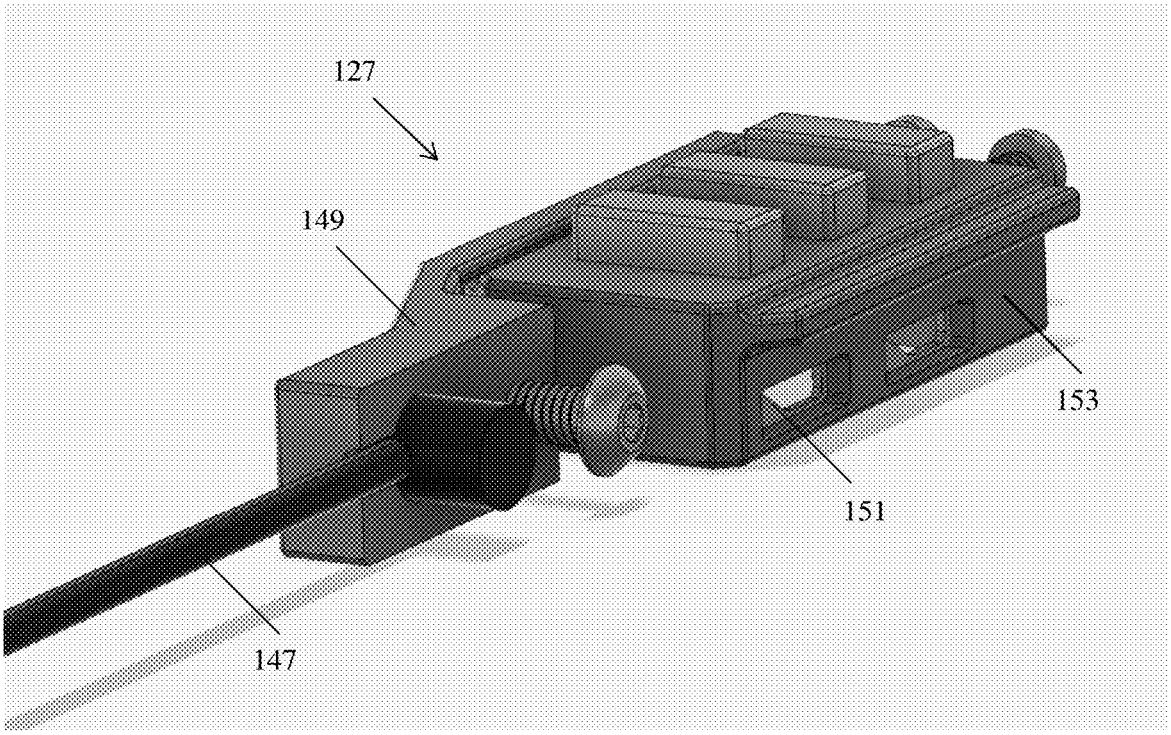
Figure 53:
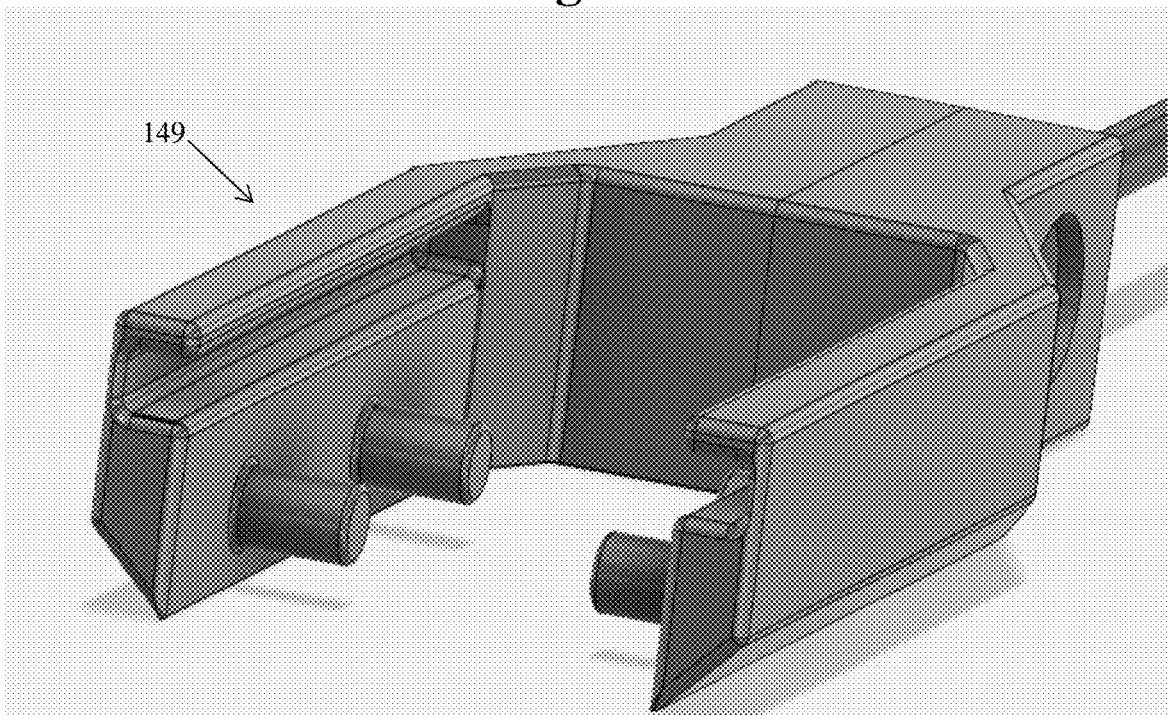
Figure 54:
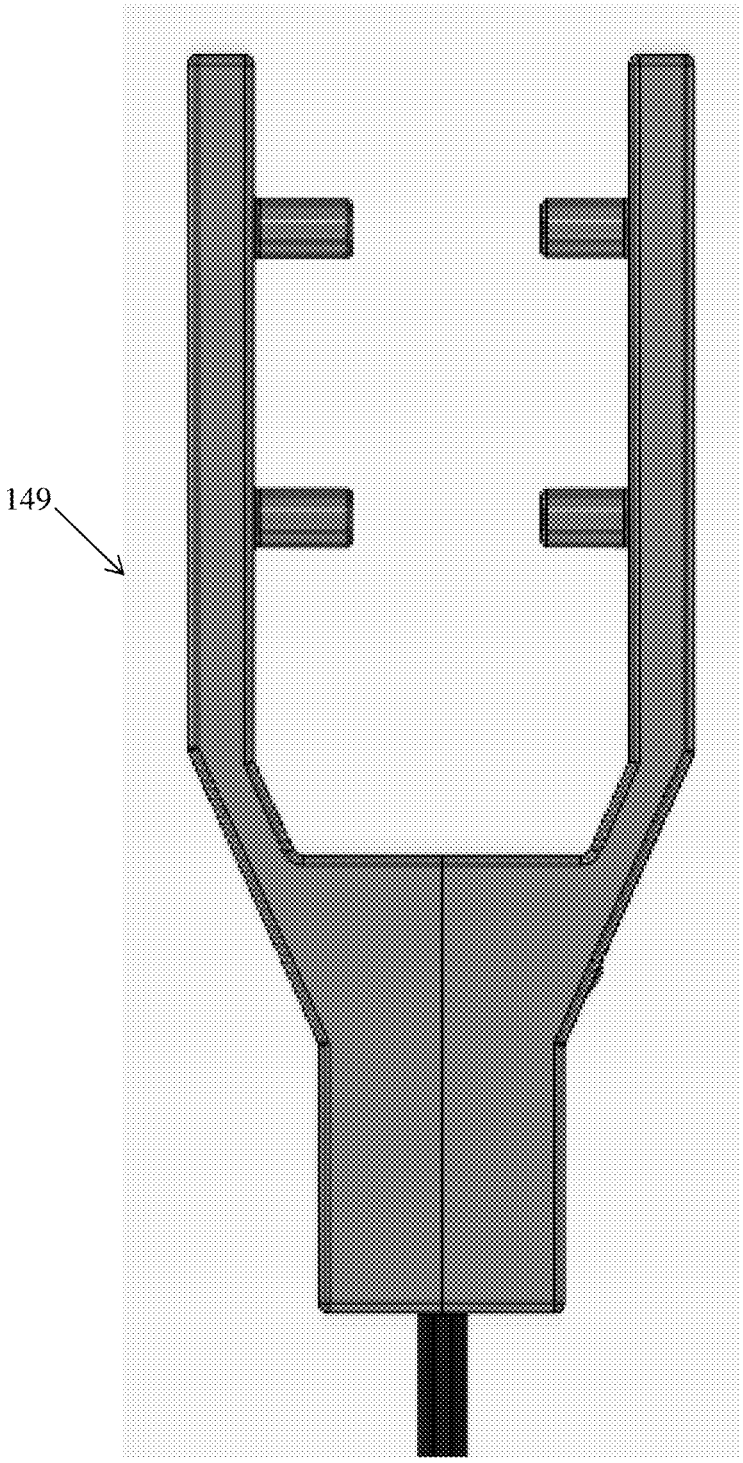
Figure 55:
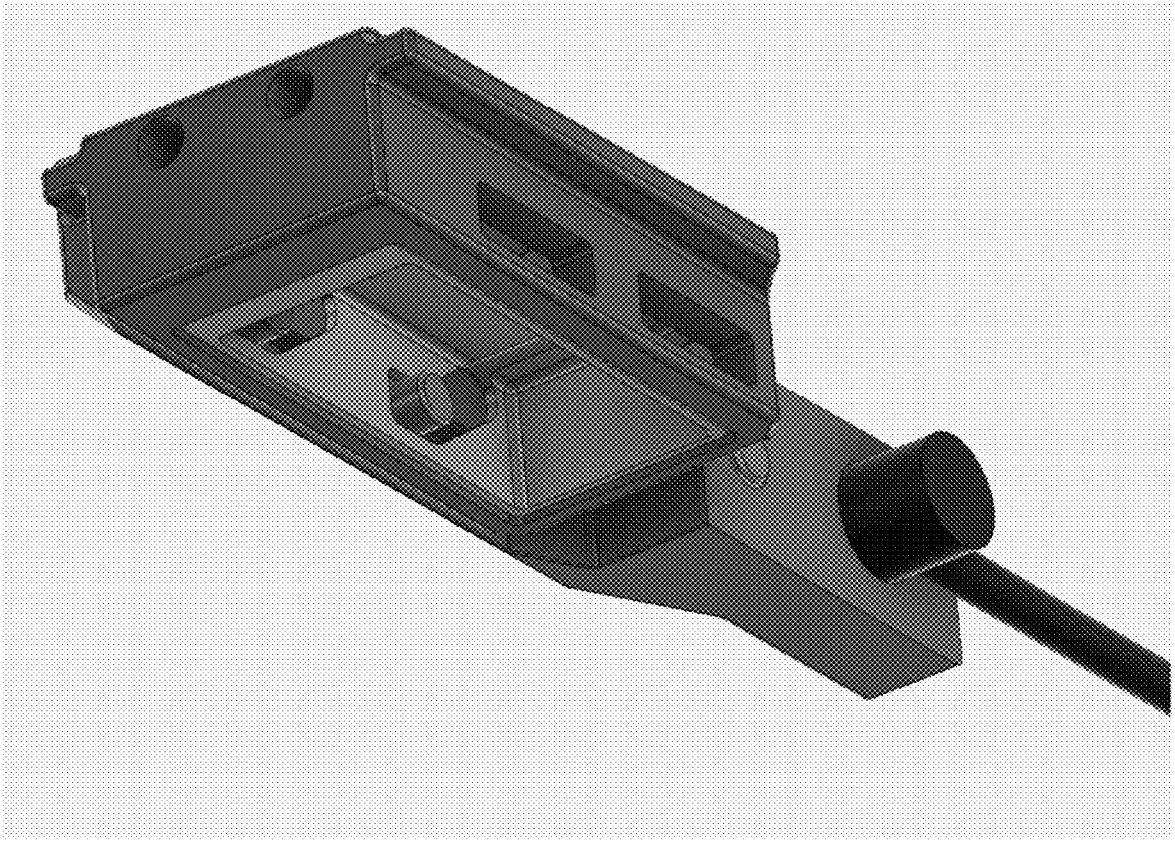

Referring to FIGS. 41-43, for example, the actuation assembly 129 can include an actuation pusher 139, a lever arm 143, and a rocker 145. The pusher 139 can be slidably disposed within the lower stock assembly 101 and can be biased to an unactuated position (as shown in FIGS. 42 and 43) by a spring 141 or any other suitable biasing member. The spring 141 pushes against an inner wall of the lower stock assembly 101 and the pusher 139 to bias the pusher 139 outward. The pusher 139 can be fixed to the lever arm 143, which can be pinned or slotted to the rocker 145. The rocker 145 can be rotatably connected to the lower stock assembly 101 in any suitable manner to allow rotation of the rocker when the lever arm 143 pushes on the rocker 145. As shown in FIGS. 44-48, the rocker 145 can receive and/or retain to a wire or linkage 147 for connecting the rocker 145 to the latch assembly 127.

Referring to FIGS. 41, 42, 46, 47, and 48, the actuation trigger 133 can be a two stage actuation trigger moveable between a first position (e.g., as shown in FIG. 41) and a second position (e.g., as shown in FIG. 42). In the first position, the actuation trigger 133 cannot be moved (e.g., cannot be pushed rearward) to actuate the actuation assembly 129 and the latch assembly 127. In certain embodiments, for example, the lower stock assembly 101 can include a lip 135 dimensioned to block motion of the actuation trigger 133 in the first position (e.g., as shown in FIG. 41), and the actuation trigger 133 can be sized and shaped (e.g., arrowhead like as shown) to be blocked by the lip 135.

In the second position (e.g., as shown in FIG. 42), the actuation trigger 133 can be moved to actuate that actuation assembly 129 and the latch assembly 127. For example, a neck 137 of the actuation trigger 133 can fit through a slot 139 defined by the lip 135, thereby allowing actuation of the actuation assembly 129 in the second position. The actuation trigger 133 can be biased to the first position (e.g., via a torsional spring as shown), which can prevent a user from accidentally actuating the stock assembly. It is contemplated that any suitable single stage or multistage actuation trigger can be used.

Figure 64:
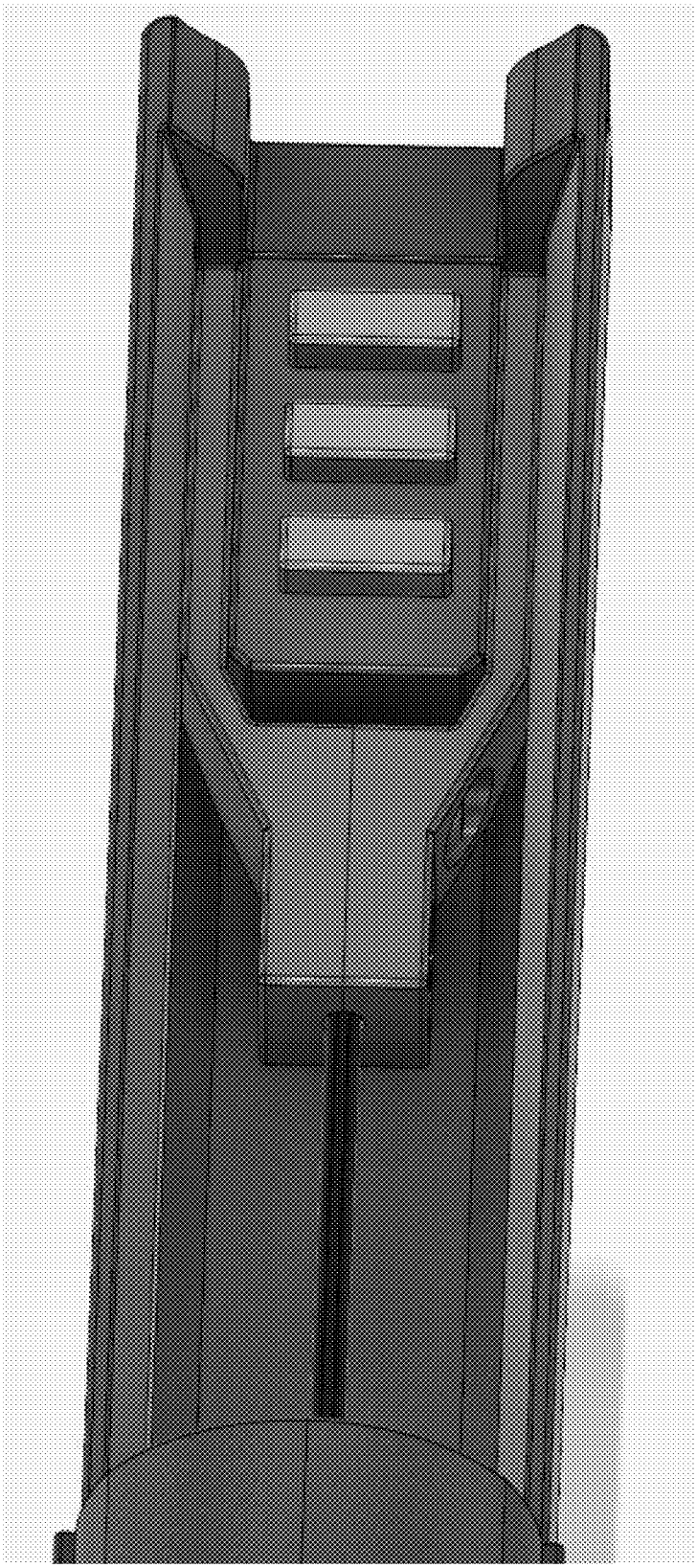
FIGS. 64 and 65 show the latch assembly disposed in the lower stock assembly and attached thereto.
Figure 65:
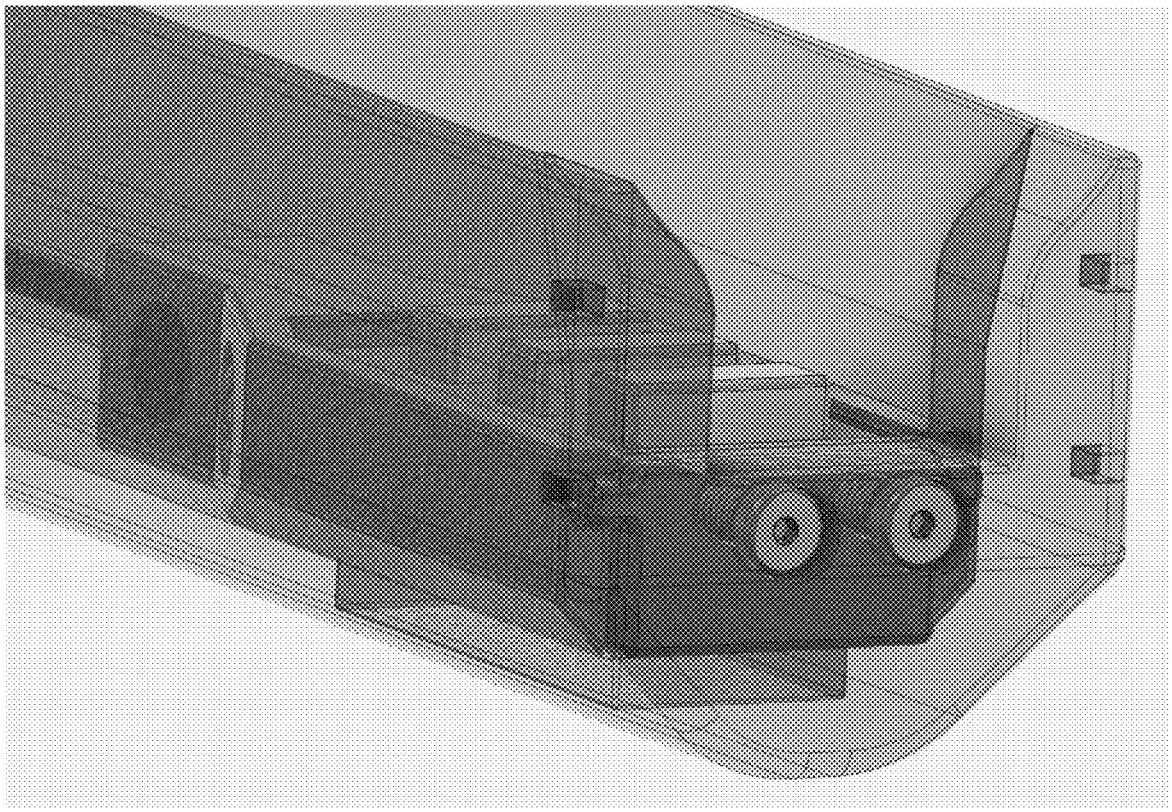
Figure 66:
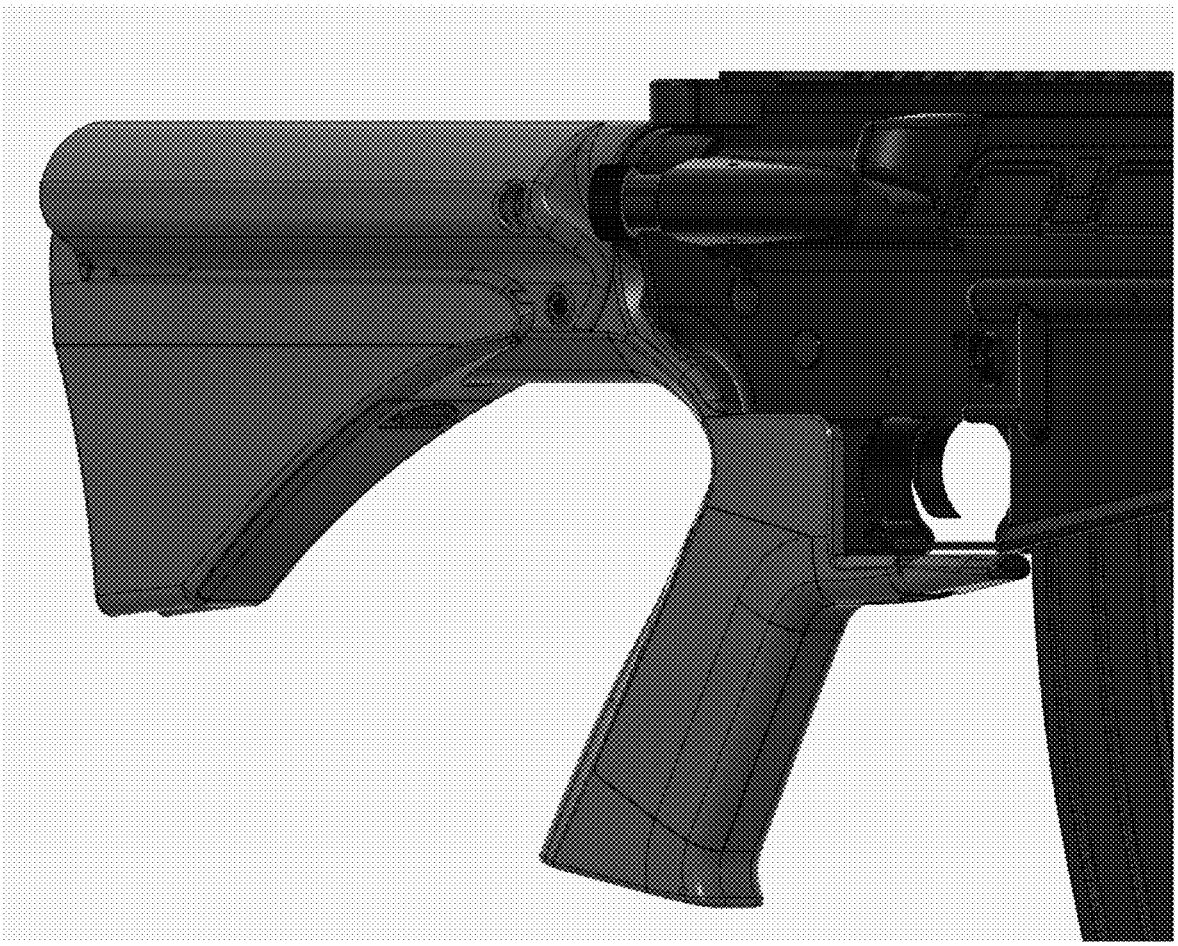
FIGS. 66-73 show the embodiment of an adjustable stock assembly disposed on a firearm in accordance with this disclosure.
Figure 67:
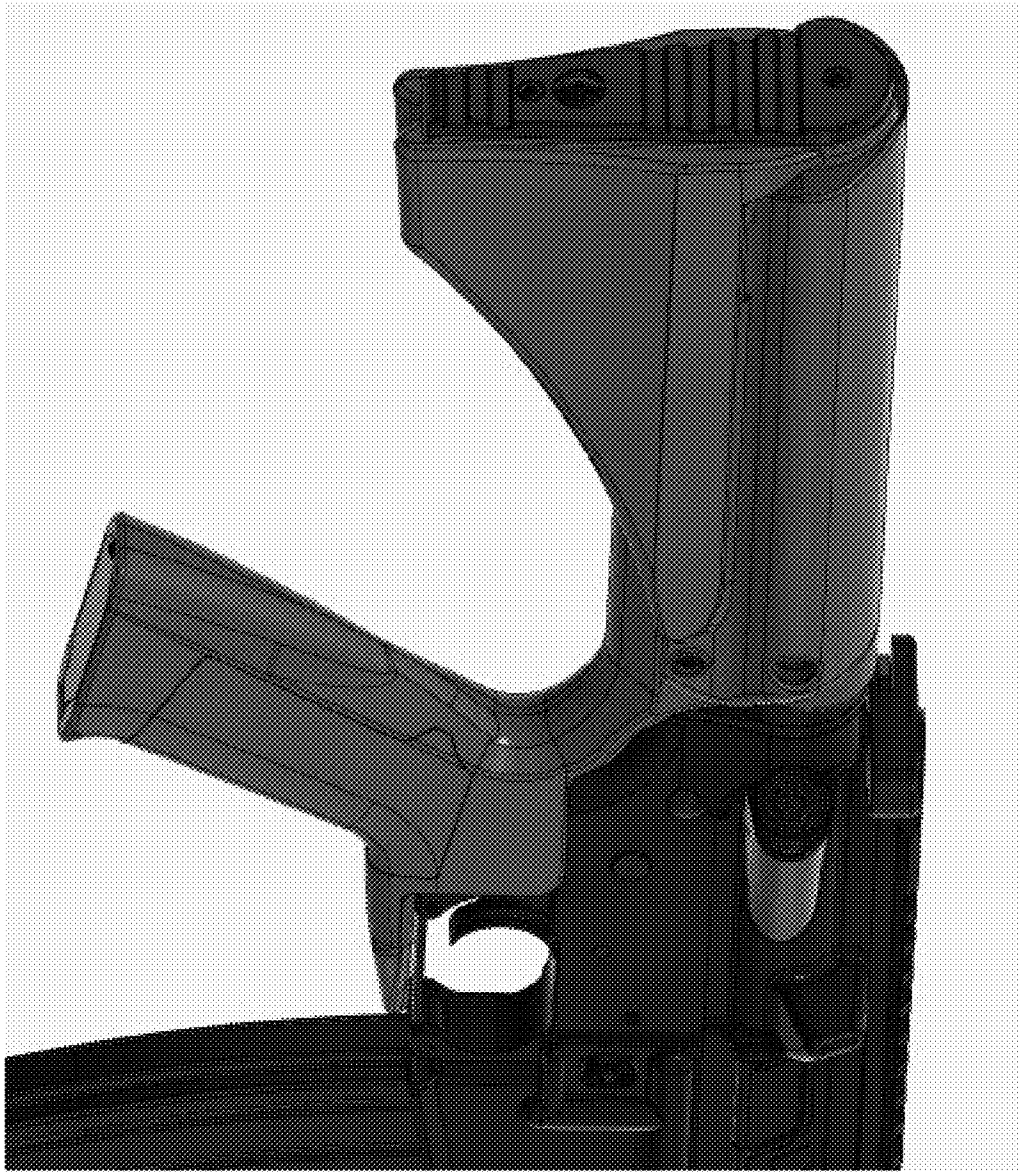
Figure 68:
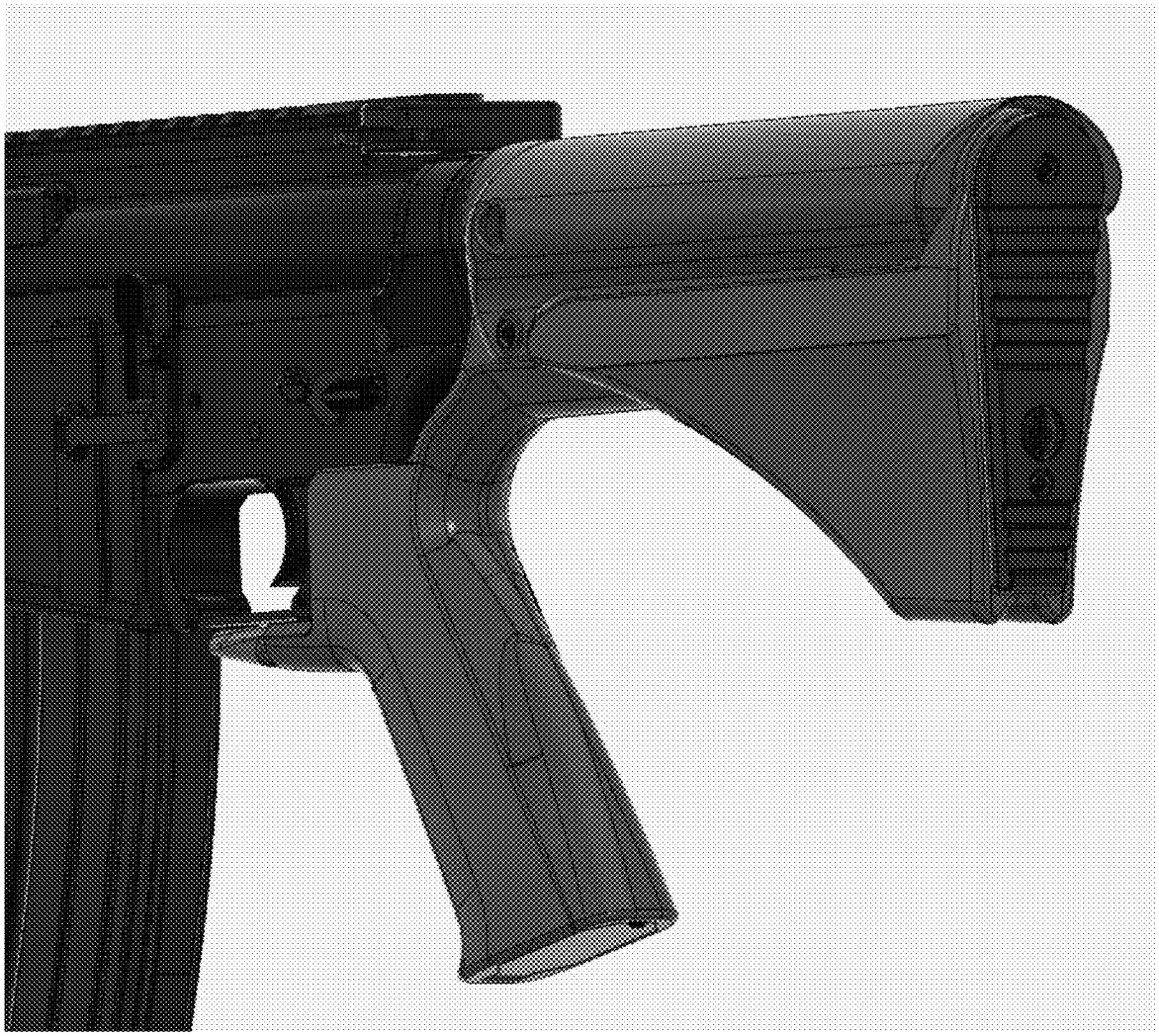
Figure 69:
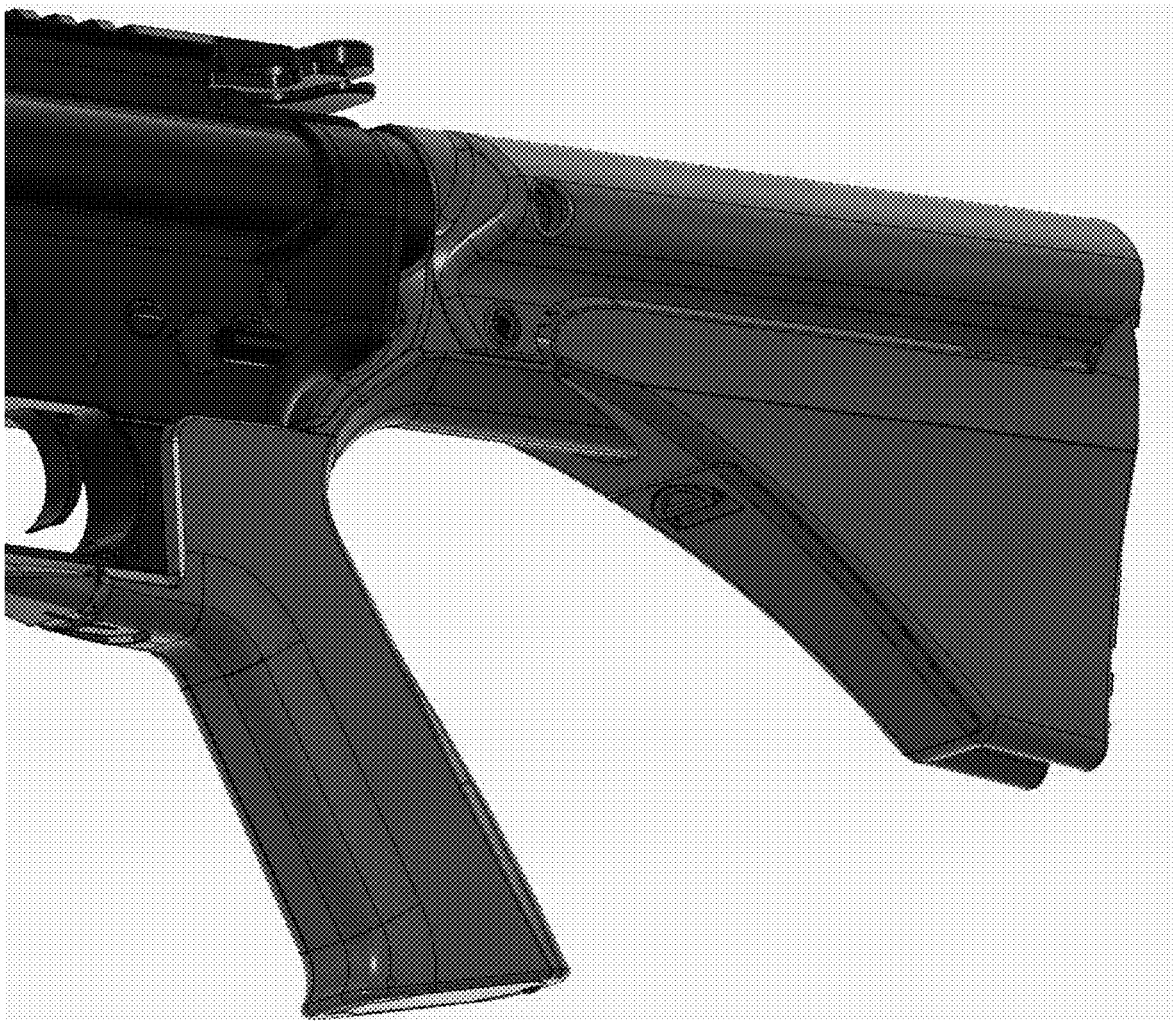
Figure 70:
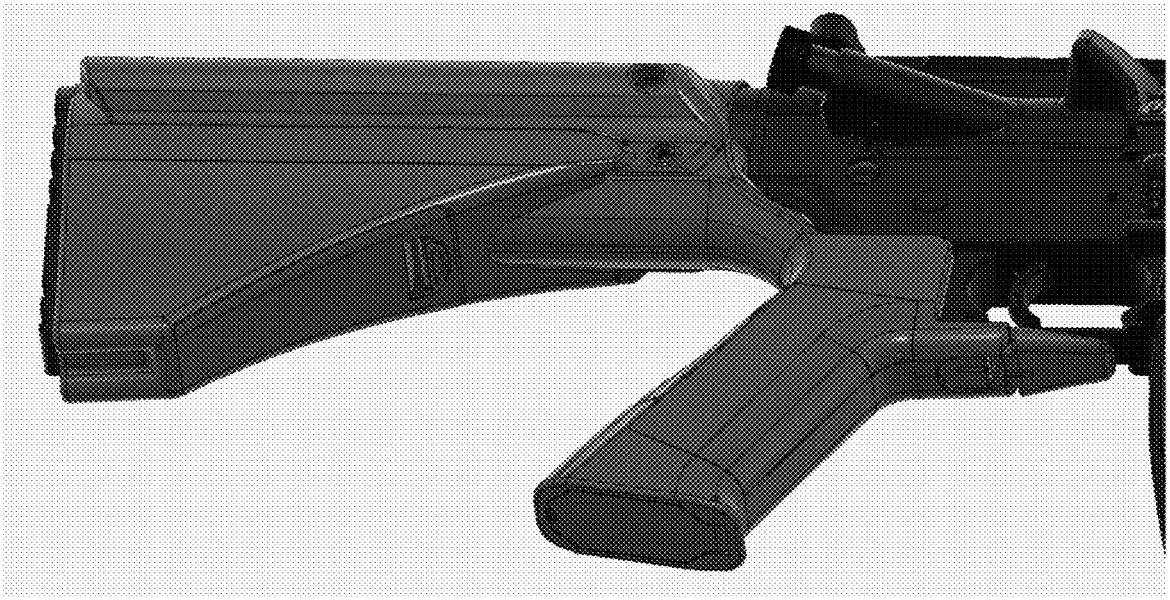
Figure 71:
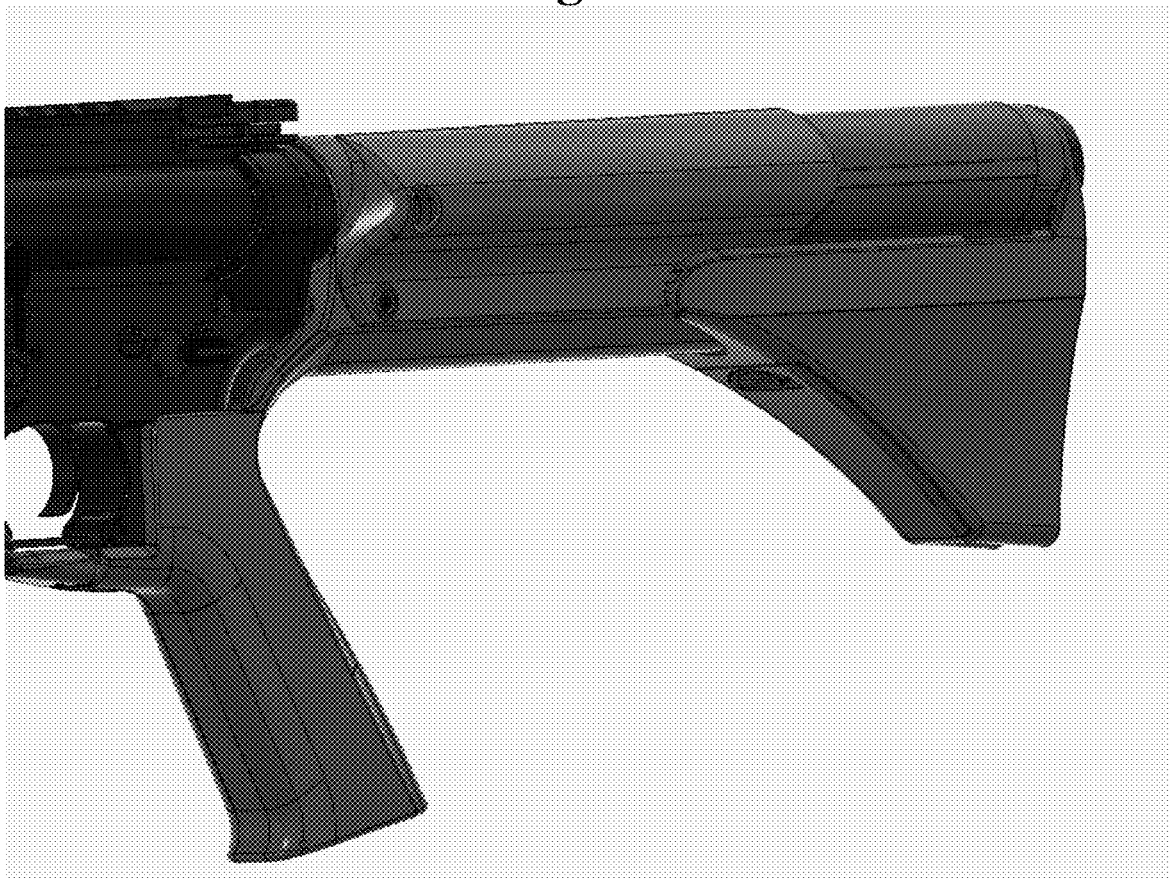
Figure 72:
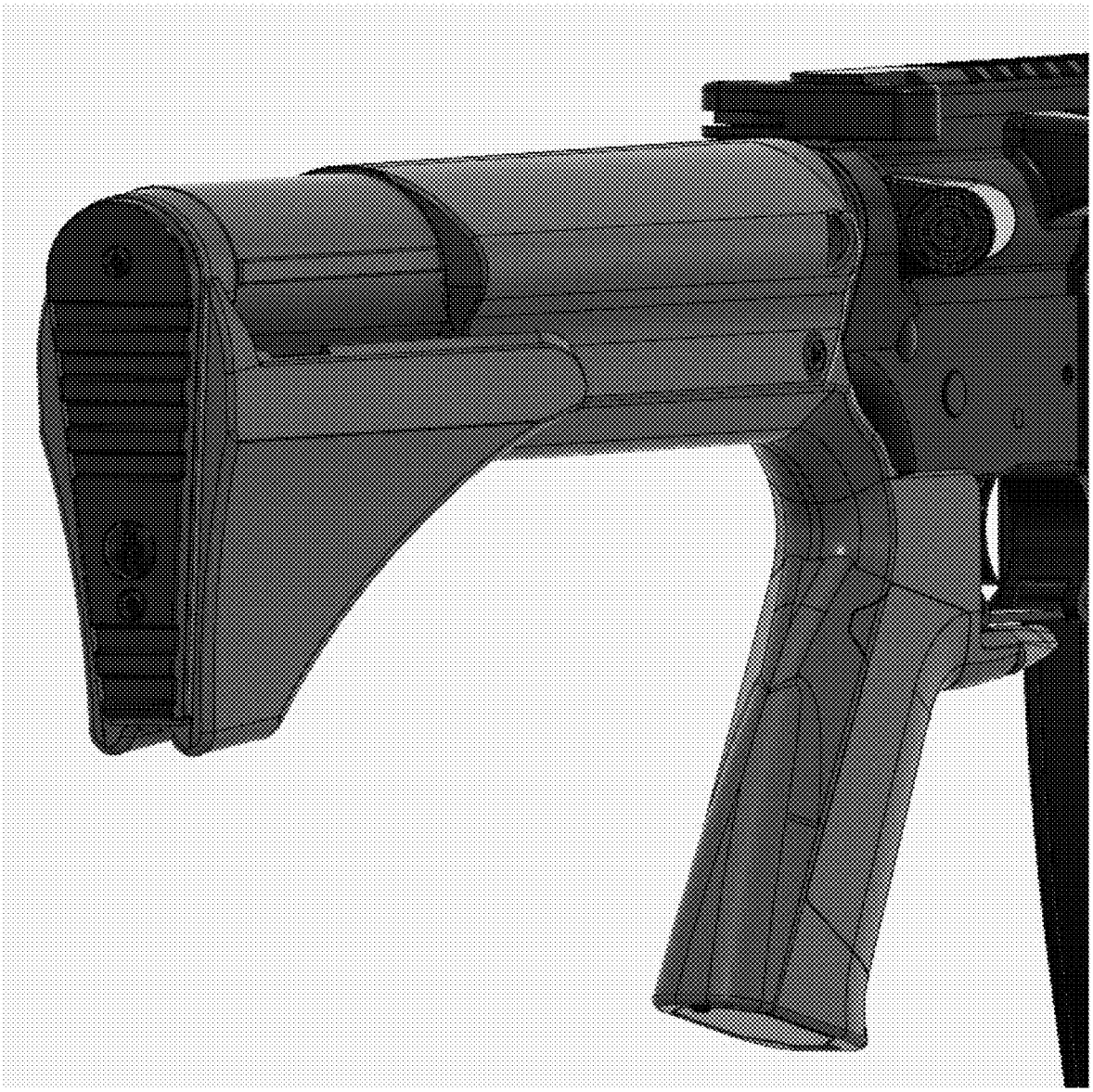
Figure 73:
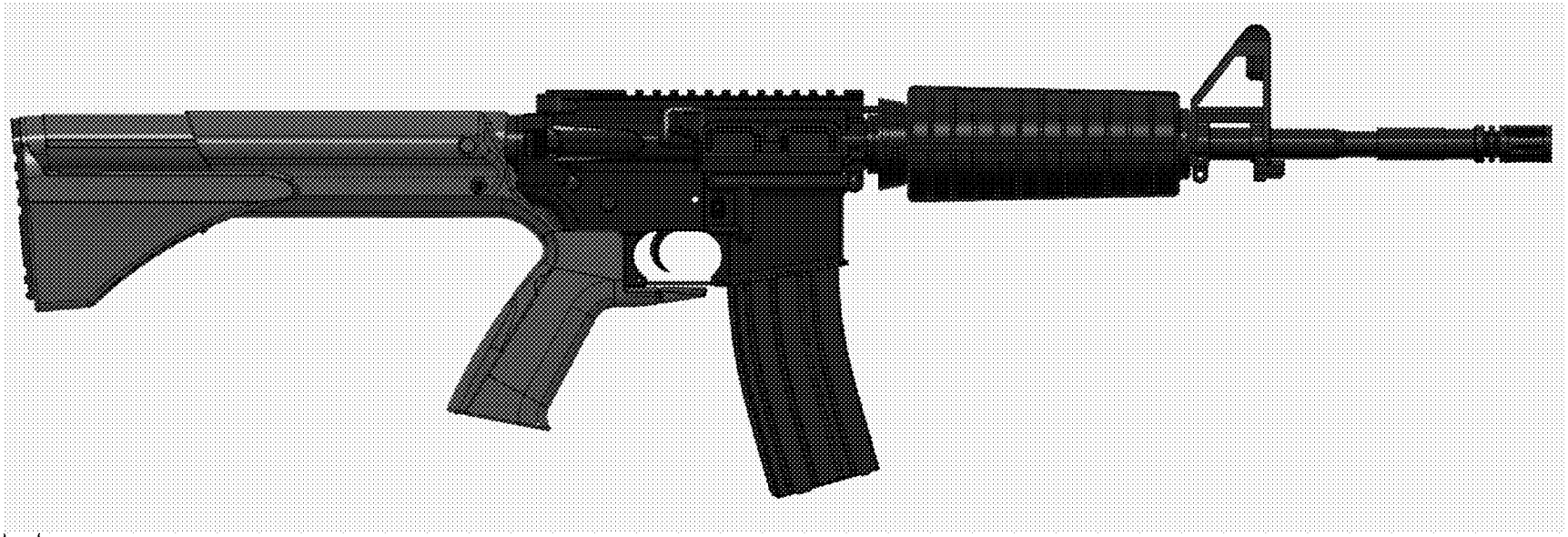

FIGS. 49-58 show the embodiment of the latch assembly 127 in accordance with this disclosure, shown in isolation. FIGS. 59-63 show the latch assembly 127 disposed relative to the buttstock slider 101. FIGS. 64 and 65 show the latch assembly 127 disposed in the lower stock assembly 101 and attached thereto.

Referring additionally to FIGS. 49-65, the latch assembly 127 can include at least one latch tooth 131 configured to mate with the plurality of buttstock slider grooves 103 when the latch assembly 131 is in the latched position. The latch assembly 131 can be biased to the latched position in any suitable manner (e.g., via one or more springs).

As shown, the latch assembly 127 can include a plurality of lever teeth 131 configured to mate with a plurality of buttstock slider grooves 103 in a latched position. Referring to FIG. 52-58, the latch assembly 127 can include a cam member 149 and a follower member 151 having the at least one latch tooth 131. The actuator assembly 129 can be operatively connected to the cam member 149 to move the cam member 149 relative to the follower member 151 to cause the follower member 151 to move relative to the buttstock slider 101. In certain embodiments, the actuator assembly 129 can be connected to the cam member 149 via the wire or linkage 147 such that actuation of the actuator trigger 133 causes a cam member 149 of the latch assembly 127 to be pulled relative to a follower member 151 to cause the follower member to move away from the buttstock slider 101 toward the unlatched position. The follower member 151 can be biased toward the latched position (e.g., upward) by a spring disposed between the follower member 151 and the lower stock assembly 101, or by the cam member 149 being biased (e.g., via a spring) to push back against the follower member 151 toward the latched position, or in any other suitable manner as appreciated by those having ordinary skill in the art in view of this disclosure.

The latch assembly 127 can include a cam housing 153 that can be fixed to the extension 123 of the lower stock assembly 101 (e.g., via one or more screws as shown). The cam housing 153 can constrain the cam member 149 to sliding motion and constrain the follower member 151 to up and down motion between the latched and unlatched position. As shown, the cam member 149 can include one or more posts that can slide within one or more slots of the cam housing 153. The one or more posts can interact with one or more cam slots defined in the follower member 151 to force the follower member 151 to move up and/or down. This camming action is shown in FIGS. 56 and 57, for example. Any other suitable latching mechanism is contemplated herein.

Figure 11:
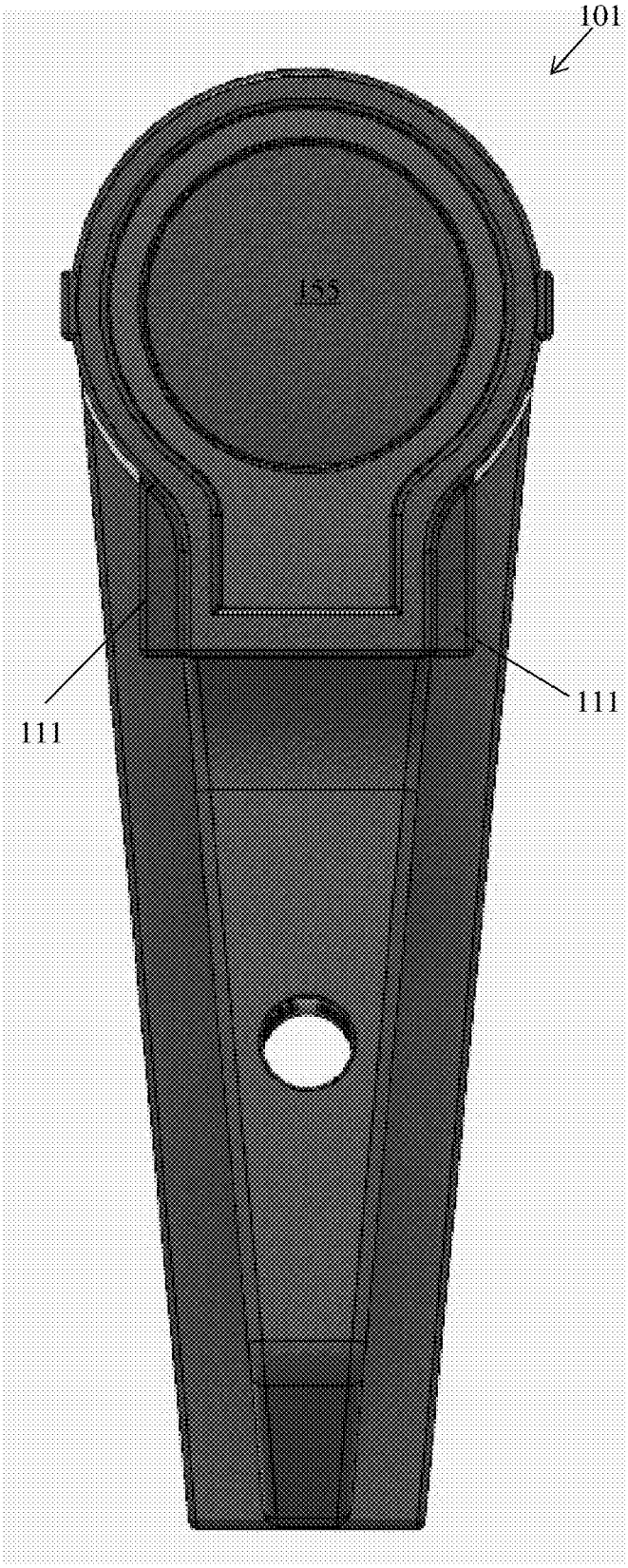
Figure 12:
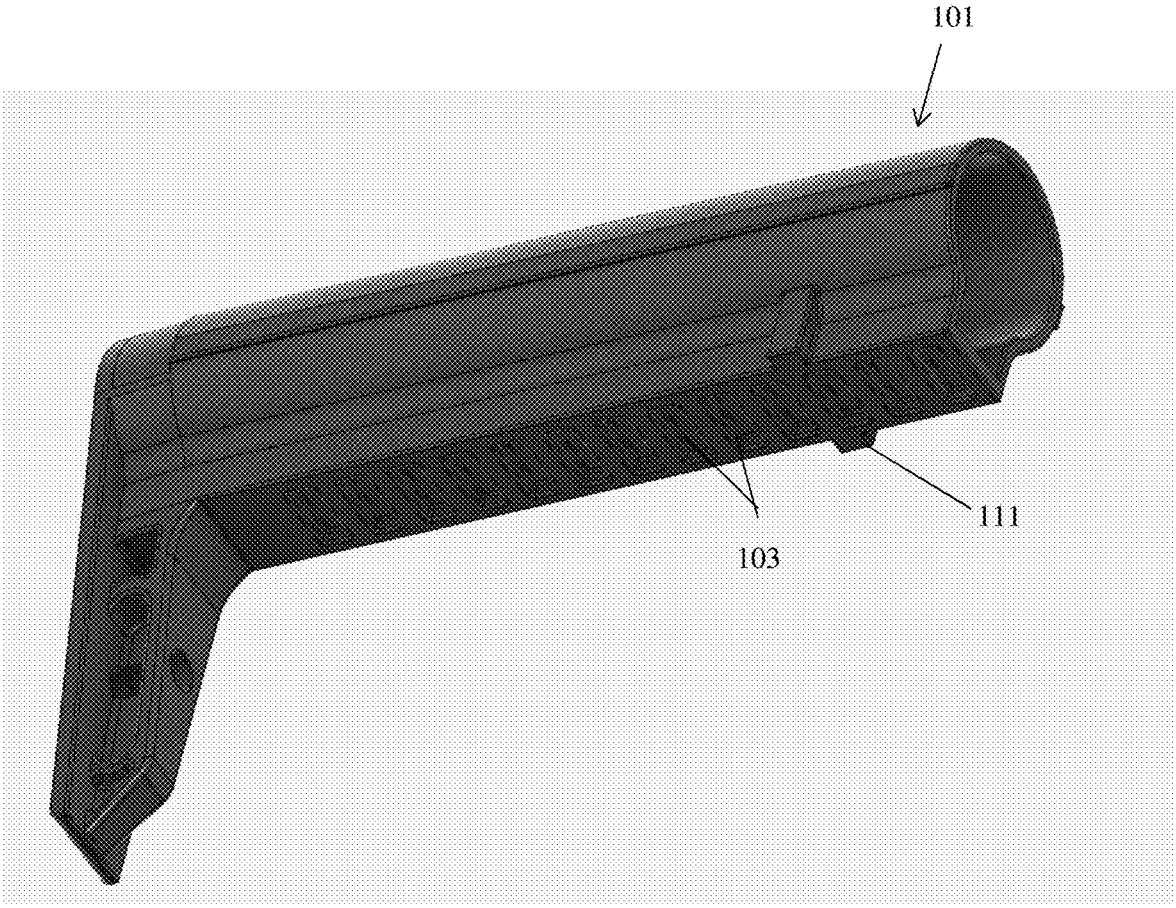
Figure 13:
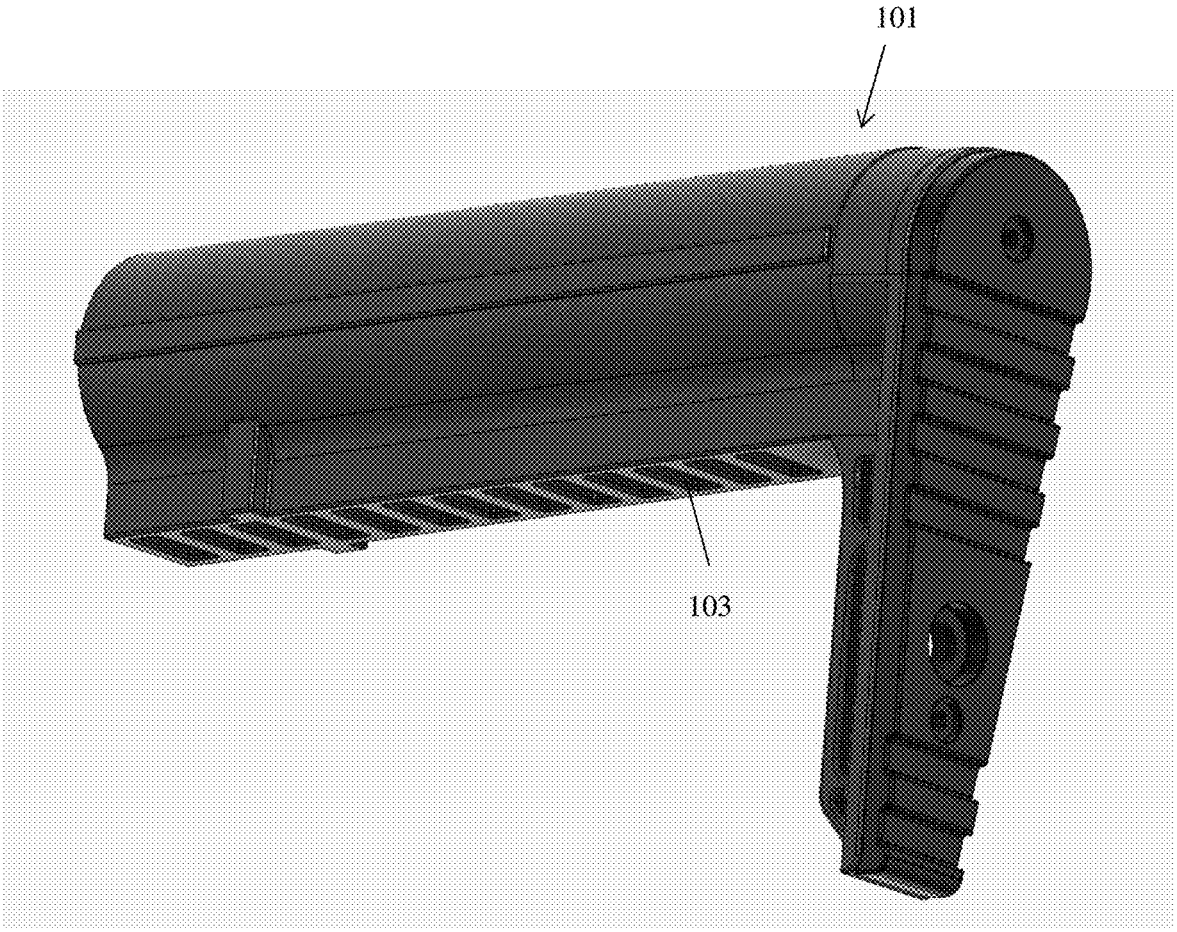
Figure 14:
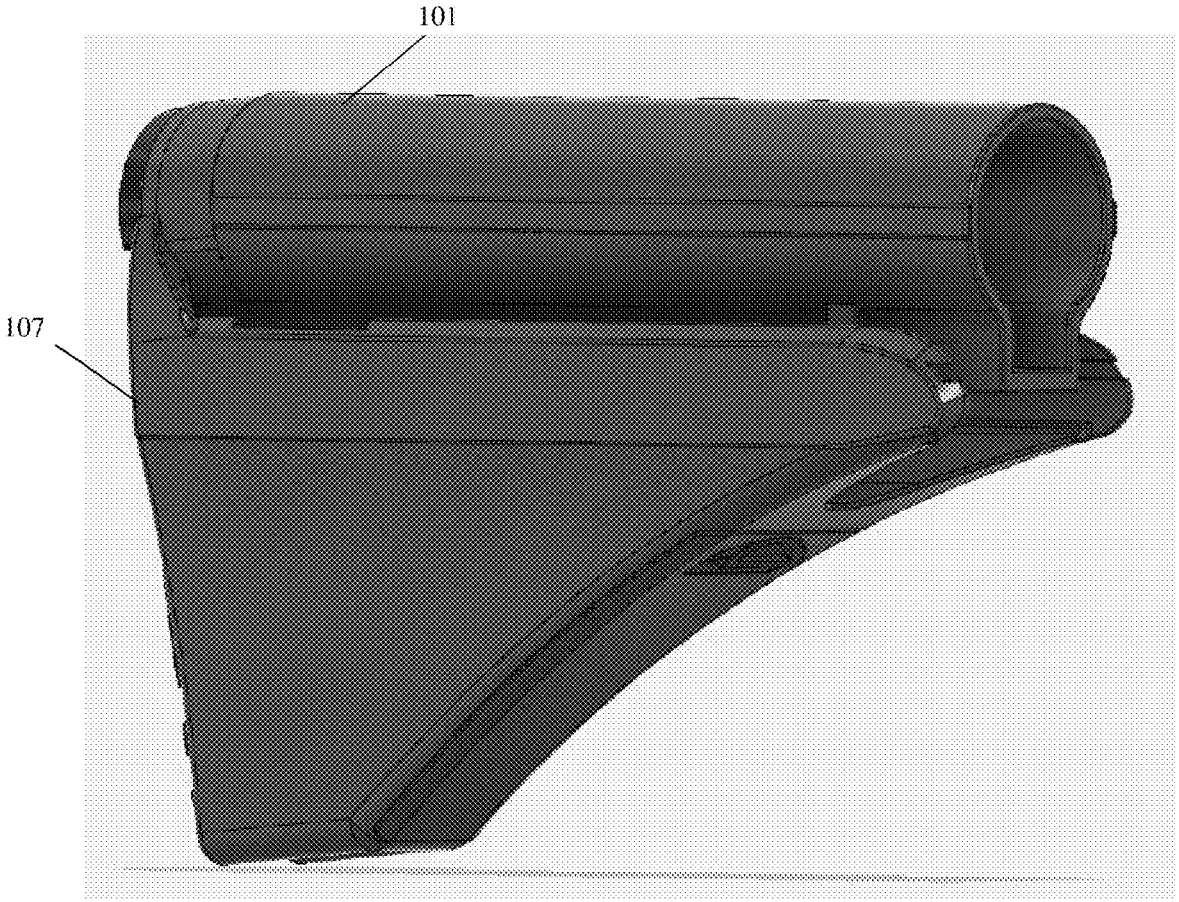
Figure 15:
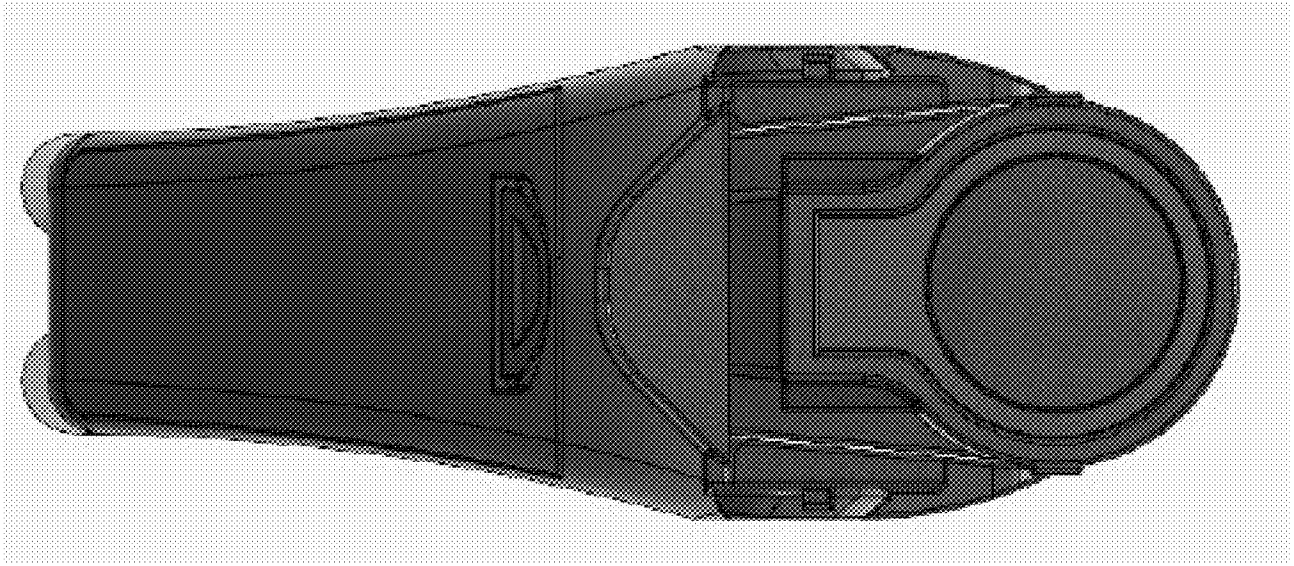

FIGS. 66-73 show an embodiment of an adjustable stock assembly 100 disposed on a firearm in accordance with this disclosure. The buttstock slider 101 can be biased to the at least one extended position. For example, the buttstock slider 101 can be biased with one or more internal springs (not shown) disposed within the buttstock slider 101. For example, the buttstock slider 101 can be configured to be slidably mounted over a buffer tube of the firearm (e.g. as shown in FIG. 66-73), and the internal spring can be positioned between the buffer tube and an internal surface 155 (e.g., as shown in FIG. 11) of the buttstock slider 101 to bias the buttstock slider 101 to the at least one extended position.

The firearm can be an AR-15. Any other suitable firearm (including airsoft or any other suitable projectile launchers) is contemplated herein.

Embodiments allow for a quick retractable single trigger actuator, accessible from either side of the rifle (ambidextrous) which can stay in a position preventing accidental actuation. Certain embodiments include an actuator placed under the trigger guard in a position which does not restrict any other potential manipulations of the weapon, yet is immediately accessible to the weapons operator.

Certain embodiments include a two stage (or multi-stage) actuator system, which prevents accidental actuation of stock in an austere environment. Certain embodiments must be manipulated in two different directions to release the latch system and allow expansion or retraction of the buttstock slider 101.

Embodiments include both a stock and pistol grip in one piece with stock actuator located below trigger guard. Embodiments include a smooth exterior design, which can prevents hangup of the weapon in operational environment, e.g., vehicle deployments, airborne jumping operations, or close quarters movements. Certain embodiments include a multi-piece modular system which can allow end purchases to configure their stock for their specific operational mission.

Embodiments include a finger operated actuator that is well suited for middle finger manipulation, allowing the thumb to stay securely wrapped around pistol grip for solid grip. The human thumb is the anchor of strength of the human hand in gripping, and an operator may desire to keep the thumb in position when actuating the stock.

Certain embodiments, include an internally encased working system protected from environmental elements. Embodiments allow stock actuation without removal of either hand from the weapon or loss of aim in use.

While certain embodiments of biasing are described above (e.g., via internal and/or external springs), any other suitable biasing system (e.g., pressure actuated) is contemplated herein. Also, it is contemplated that no biasing is necessary, and that systems as described above can be utilized in embodiments having no biasing.

Also, while this disclosure shows the "collapsed position" as pushed inward and the one or more "extended positions" as extending further from the firearm via a sliding motion, it is contemplated that the terms can be generically applied to any first stowed position and any second position. For example, the "collapsed position" could additionally or alternatively refer to a folded position for a folding stock and the "extended position" could be an unfolded position. One having ordinary skill in the art understands that various portions of this disclosure can be modified and/or applied to any suitable type of fixed stock or adjustable stock, and for any suitable firearm.

Certain embodiments as described above allow a user (e.g., of a shoulder fired weapon) to expand and collapse the buttstock slider 101 of a firearm without ever having to remove one or both hands from the firearm. For example, if the buttstock is too short, a user can actuate the actuator assembly 129 to move the latch assembly 127 to the unlatched position. In embodiments that are biased, the buttstock slider 101 will move to a more extended position while the latch assembly 129 is in the unlatched position.

The user can select any suitable extended position (e.g., by resisting the force of the bias with the users shoulder until the buttstock as reached a desired extended position), or the user can allow the buttstock 101 to extend to the maximum extension (e.g., until the buttstock 101 hits the buttstock stop 111). At the desired position or at maximum extension, the user can then release the actuator and allow the latch assembly 129 to spring back into contact with the buttstock slider 101 to prevent the buttstock slider 101 from moving back toward the collapsed position or further extended. To move the buttstock slider 101 back to the collapsed position, the user can actuate the actuation assembly 129 and compress the buttstock slider 101 (e.g., using a shoulder) until a desired collapsed position is reached.

Embodiments of this disclosure can be drop in capable for easy installation and/or removal from standard mil-spec buffer tubes and components thereof, which eliminated the need to purchase any other third parties accessories or remove any integral parts of a standard firearm (e.g., an AR-15).

Embodiments that allow the buttstock slider 101 to be manipulated without removing either hand from the weapon can protect the user where removing one's hand from the weapon could prove fatal for that user. Additionally, embodiments as disclosed above do not require the use of the buffer tube or any holes of the buffer tube. In that respect, such embodiments are self-contained extension systems that can install on any firearm or component thereof without modification or the need to limit the design to buffer tube specifications. The term "firearm" as used herein means any suitable gun or any other suitable device or projectile launcher. For example, embodiments can be used on, e.g., an airsoft gun, a crossbow, or any other suitable device as well as any traditional firearm such as a rifle or handgun. Any embodiments and/or portion(s) thereof can be made of any suitable material (e.g., metal, plastic).

Any suitable combination(s) of any disclosed embodiments and/or any suitable portion(s) thereof is contemplated therein as appreciated by those having ordinary skill in the art.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. An adjustable stock system for a firearm, comprising:

a lower stock assembly configured to mount to a firearm;

a buttstock slider configured to be slidably movable relative to the firearm between a collapsed position and at least one extended position, wherein the buttstock slider includes a plurality of buttstock grooves defined therein;

a latch assembly disposed within the lower stock assembly, the latch assembly configured to be moveable between a latched position where the slider cannot slide relative to the firearm and an unlatched position where the buttstock slider is free to slide relative to the firearm, the latch assembly including at least one latch tooth configured to mate with the plurality of buttstock slider grooves when the latch assembly is in the latched position, wherein the latch assembly is biased to the latched position, wherein the latch assembly includes a cam member and a follower member having the at least one latch tooth; and an actuator assembly configured to move the latch assembly between the latched position and the unlatched position, wherein the actuator assembly is operatively connected to the cam member to move the cam member relative to the follower member to cause the follower member to move relative to the buttstock slider, wherein the actuator assembly is connected to the cam member via a wire or linkage such that actuation of an actuator trigger causes the cam member of the latch assembly to be pulled relative to a follower member to cause the follower member to move away from the buttstock slider toward the unlatched position.

2. The system of claim 1, wherein the latch assembly includes a plurality of lever teeth configured to mate with a plurality of buttstock slider grooves in a latched position.

3. The system of claim 1, wherein the actuator assembly includes an actuation trigger that is configured to be positioned adjacent a grip of the firearm when the system is installed on a firearm such that a user can actuate the latch assembly without removing a hand from the firearm or grip.

4. The system of claim 3, wherein the actuation trigger is configured to be positioned below a trigger guard of the firearm when the system is installed on the firearm such that the user's trigger finger or other trigger hand digit can actuate the actuation trigger without removing a hand from the firearm or grip.

5. The system of claim 1, wherein the buttstock slider is biased to the at least one extended position.

6. The system of claim 5, wherein the buttstock slider is biased with one or more internal springs disposed within the buttstock slider.

7. The system of claim 6, wherein the buttstock slider is configured to be slidably mounted over a buffer tube of the firearm, wherein the internal spring is positioned between the buffer tube and an internal surface of the butt stock to bias the buttstock to the at least one extended position.

8. The system of claim 7, wherein the firearm is an AR platform rifle.

9. An adjustable stock system for a firearm, comprising:

an actuator assembly; and a latch assembly including:

a cam housing fixed to an extension of a lower stock assembly of the firearm;

a cam member slidably seated within a cam housing and operatively connected to the actuator assembly; and a follower member having at least one latch tooth mated with the cam member, wherein the actuator assembly is configured to move the cam member relative to the follower member to cause the follower member to move from a latched position to an unlatched position.

10. The system of claim 9, further comprising:

the lower stock assembly configured to mount to a firearm; and a buttstock slider having a plurality of buttstock slider grooves configured to be slidably attached to the firearm or stock system for moving relative to the firearm between the latched and unlatched position, wherein actuation of the actuator assembly causes a cam member to slide relative to the follower member to cause the follower member to move away from the buttstock slider toward the unlatched position.

11. The system of claim 10, wherein the latch assembly further includes a plurality of lever teeth configured to mate with the plurality of buttstock slider grooves in the latched position.

12. The system of claim 10, wherein the follower member is biased toward the latched position by a spring disposed between the follower member the lower stock assembly.

13. The system of claim 9, wherein the cam member is biased to push back against the follower member toward the latched position.

14. The system of claim 9, wherein the cam member further includes one or more posts configured to engage and slide within one or more slots defined within the cam housing.

15. The system of claim 14, wherein the one or more posts are configured to interact with one or more cam slots defined in the follower member to force the follower member to move between the latched and unlatched position.

16. The system of claim 15, wherein the one or more slots in the cam housing constrain the cam member to sliding motion and constrain the follower member to up and down motion between the latched and unlatched position.

* * * * *